US008342374B2

(12) United States Patent
Yount et al.

(10) Patent No.: US 8,342,374 B2
(45) Date of Patent: Jan. 1, 2013

(54) FRAGILE PREMIUM SEPARATOR

(75) Inventors: Andrew Yount, Lombard, IL (US); William Day, Spanish Fort, AL (US)

(73) Assignee: Insight Promotions, LLC, Barlett, IL (US)

( * ) Notice: Subject to any disclaimer, the term of this patent is extended or adjusted under 35 U.S.C. 154(b) by 781 days.

(21) Appl. No.: 12/369,356

(22) Filed: Feb. 11, 2009

(65) Prior Publication Data

US 2010/0200473 A1 Aug. 12, 2010

(51) Int. Cl.
*B26F 3/00* (2006.01)
*B26F 3/02* (2006.01)

(52) U.S. Cl. ..... 225/100; 225/4; 225/5; 225/101; 225/105; 225/106

(58) Field of Classification Search ..... 53/235, 53/244, 255, 260, 473, 475; 209/559, 603, 209/617, 642, 917; 221/30, 69, 70, 87, 88; 225/4, 5, 93, 94, 100, 101, 105, 106, 2, 96; 294/87.1, 198

See application file for complete search history.

(56) References Cited

U.S. PATENT DOCUMENTS

| | | | | | |
|---|---|---|---|---|---|
| 3,895,751 | A | * | 7/1975 | Shepherd | 225/3 |
| 3,984,030 | A | * | 10/1976 | Morini | 221/30 |
| 3,999,694 | A | * | 12/1976 | Vossen | 225/100 |
| 4,069,957 | A | * | 1/1978 | Moffitt | 225/5 |
| 4,167,911 | A | * | 9/1979 | Masuda et al. | 111/105 |
| 4,215,626 | A | | 8/1980 | Giulianotto | |
| 4,261,497 | A | | 4/1981 | Roetter et al. | |
| 4,375,189 | A | * | 3/1983 | Berner et al. | 101/68 |
| 4,454,973 | A | | 6/1984 | Irvine | |
| 4,455,809 | A | | 6/1984 | Dallaserra | |
| 4,498,894 | A | | 2/1985 | Kuckhermann | |
| 4,666,367 | A | * | 5/1987 | Sticht | 414/751.1 |
| 4,851,075 | A | | 7/1989 | Parker | |
| 4,858,804 | A | | 8/1989 | Sharp, Jr. | |
| 4,858,844 | A | * | 8/1989 | Stenqvist | 242/521 |
| 4,874,194 | A | * | 10/1989 | Borcea et al. | 294/207 |
| 4,997,119 | A | * | 3/1991 | Meschi | 225/100 |
| 5,079,901 | A | | 1/1992 | Kotsiopoulos | |

(Continued)

FOREIGN PATENT DOCUMENTS

JP 59057859 A 9/1982

OTHER PUBLICATIONS

IDS Packaging—Package Solutions, downloaded on Feb. 15, 2008 at http://www.idspackaging.com/packaging/us/longford/packaging_feeders/899_0/g_supplier.html.

*Primary Examiner* — Stephen Choi
*Assistant Examiner* — Samuel A Davies
(74) *Attorney, Agent, or Firm* — Momkus McCluskey, LLC; Jefferson Perkins

(57) ABSTRACT

Upstream and downstream grippers clamp to one or more seal zones on a bandolier of packaged premiums, such that the downstream gripper(s) and upstream clipper(a) are on opposite sides of a wakened separation line. The upstream and downstream gripper(s) are independently displaced by motive devices in a downstream direction. Further displacement of the downstream gripper(s) relative to the upstream gripper(s) causes the separation line to tear, thus separating an end premium package from the rest of the bandolier. In one embodiment, the grippers clamp to the seal zones at locations offset from the bandolier axis and to one side thereof, thus causing a gradual tearing along the separation line and easier, less stressful separation.

6 Claims, 52 Drawing Sheets

U.S. PATENT DOCUMENTS 5,090,591 A * 2/1992 Long ..... 221/25
5,154,333 A * 10/1992 Bauer et al. ..... 225/1
5,230,453 A * 7/1993 Meschi ..... 225/100
5,239,809 A 8/1993 Long
5,297,710 A * 3/1994 Juras ..... 225/2
5,297,711 A * 3/1994 Kogan ..... 225/98
5,312,032 A 5/1994 Rautenberg et al.
5,320,341 A * 6/1994 Pease et al. ..... 271/277
5,362,013 A 11/1994 Gietman, Jr. et al.
5,427,294 A 6/1995 VandenHeuvel et al.
5,501,064 A * 3/1996 Ingram et al. ..... 53/473
5,549,233 A 8/1996 Clauser
5,588,280 A 12/1996 Kotsiopoulos
5,704,959 A * 1/1998 Lisec ..... 65/174
5,752,365 A 5/1998 Johnson et al.
5,784,861 A 7/1998 Kotsiopoulos
5,785,224 A * 7/1998 Nowakowski ..... 225/4
5,794,406 A 8/1998 Reichental et al.
5,803,261 A 9/1998 Nowakowski et al.
5,845,462 A 12/1998 Kuehl et al.
5,865,358 A * 2/1999 Fernandez ..... 225/101
5,941,053 A 8/1999 Kotsiopoulos
5,941,054 A 8/1999 Valyi
5,966,906 A 10/1999 Kuehl et al.
6,033,353 A 3/2000 Lencoski et al.
6,035,610 A * 3/2000 Vonderhorst et al. ..... 53/435
6,082,079 A 7/2000 Kuehl et al.
6,257,475 B1 7/2001 Ishii et al.
6,460,440 B1 * 10/2002 Tsune ..... 83/153
6,485,285 B1 * 11/2002 Shiotani ..... 425/139
6,599,384 B2 7/2003 Milner et al.
6,625,956 B1 9/2003 Soudan
6,722,108 B1 4/2004 Kotsiopoulos
6,725,628 B2 4/2004 Lohrey et al.
6,751,935 B2 6/2004 Brenkus
6,835,042 B2 * 12/2004 de Koning ..... 414/736
7,032,774 B2 4/2006 Boehm et al.
7,063,083 B2 * 6/2006 Ohmiya et al. ..... 125/23.01
7,201,343 B2 4/2007 Mabit
7,370,783 B2 * 5/2008 Hubrecht ..... 225/101
7,650,731 B2 * 1/2010 Nowakowski et al. ..... 53/520
2001/0000612 A1 5/2001 Nowakowski
2003/0070401 A1 4/2003 Brenkus
2004/0149767 A1 8/2004 Boehm et al.
2004/0250514 A1 12/2004 Brenkus
2006/0010835 A1 1/2006 Shaw et al.
2008/0098696 A1 5/2008 Gallimore
2008/0098697 A1 * 5/2008 Murray ..... 53/457
2008/0289301 A1 11/2008 Gallimore
2009/0005203 A1 1/2009 Nowakowski et al.
2009/0071994 A1 * 3/2009 Jans ..... 225/1

* cited by examiner

FRAGILE PREMIUM SEPARATOR

BACKGROUND OF THE INVENTION

Packaged goods, such as boxes of cereal, often have a premium or prize inserted in them. These premiums or prizes typically are provided in a bandolier of serial packages, each package containing one such prize and being separated from adjacent packages by a seam or seal. Apparatus has been developed to automatically separate one packaged premium from a bandolier of such premiums and to insert the premium into the larger package of goods.

Interest in such inserted premiums has increased because they can be a targeted and very effective form of marketing. A sample inserted into a larger package or box of goods bought by a consumer has no extra distribution cost, has typically negligible additional weight and is highly targeted at a group of consumers which the marketer is trying to reach: consumers who have actually made a decision to buy a related product.

Conventional apparatus for doing this have placed limitations on the kinds of premiums which can be inserted: they have to be tough. Where a premium takes the form of a paper coupon or other flat medium, a bandolier of such coupons can pass through sets of rollers. The coupons are separated by lines of perforations. To separate a coupon from the bandolier, one set of rollers stops and another adjacent set keeps going, having the effect of putting tension on a perforation line and bursting the coupon along the perforation line from the rest of the bandolier. Typical of this kind of premium insertion apparatus is U.S. Pat. No. 6,722,108 issued to Kotsiopoulos. But burst-roller coupon inserters of this type would simply smash a fragile packaged premium. Quite apart from the fact that a pair of friction rollers would simply smash flat any fragile premium inserted into them, the sudden acceleration involved in bursting one premium from another can damage a fragile packaged premium (such as a pretzel or other baked good) to such an extent that the premium will be rendered unacceptable. A need therefore persists in developing premium separators and inserters which will place less stress on the packaged premium.

SUMMARY OF THE INVENTION

According to one aspect of the invention a fragile premium separator is provided which has at least one upstream gripper and at least one downstream gripper, both arranged along a path of a bandolier of packaged premiums. The packaged premiums are separated from each other by transverse seal zones, each one of which has a perforated, slotted, creased or otherwise wakened separation line. Each gripper has at least one finger which, in an unactuated state, is disposed above a plane occupied by the bandolier. Opposed to this is a corresponding, opposed surface of the gripper which is disposed below the plane. When actuated, the finger will clamp a selected packaged premium to the opposed surface, at a location within a selected premium package seal zone and to one side of the separation line. In a preferred embodiment the opposed surface of the gripper terminates a second finger which is disposed below the bandolier plane.

In one embodiment, an upstream gripper motive device is operable to translate the upstream gripper upstream and downstream along the path, while a downstream gripper motive device is independently operable to translate the downstream gripper upstream and downstream along the path. There can be several modes of operation of the separator. In each of them, at some point after the upstream and downstream grippers have clamped to selected seal zones such that a separation line is disposed between them, the downstream gripper is displaced relative to the upstream gripper, tearing off the last premium from the rest of the bandolier.

In one embodiment, there are provided left and right upstream grippers and left and right downstream grippers, and these are each translated up and down the bandolier path in tandem by the respective motive devices. In a preferred embodiment, at least one, additional stationary gripper is provided to be upstream of the mobile upstream gripper. This stationary gripper(s) can be used to hold the bandolier when the upstream and downstream grippers translate back to their respective beginning positions at the end of one separation cycle.

According to another aspect of the invention, upstream and downstream grippers are provided for only one side of the bandolier. That is, if the bandolier path is considered to have an axis, the upstream and downstream grippers are both to one side of it. After the downstream and upstream grippers have clamped to one or more selected seal zones such that a separation line is interposed between them, a downstream gripper motive device coupled to the downstream gripper translates it in a downstream direction relative to the upstream gripper. When this happens, the premium(s) downstream from the separation line begin to be torn off of the bandolier at the separation line, starting at the side on which the upstream and downstream grippers are disposed. The tearing action continues along the separation line, through its intersection with the bandolier axis, and to the other side. This separation mode is particularly preferred where the packaged premium is fragile and it is desired to minimize the stress placed on the premium during the separation process. It has been found that the amount of tension needed to effect a separation using a one-sided tearing method is two to three times less than a two-sided separation on the same packaged premium.

In a preferred embodiment, the separator according to the invention can be controlled by a controller to separate a packaged premium from the end of a bandolier in any of multiple modes. In a first, "pull" mode, the upstream gripper(s) clamp to an upstream one of two premium package seal zones, while the downstream gripper(s) clamp to a downstream one of two premium package seal zones, in such a way that one separation line is disposed between the two. In a second, "push" mode, the upstream gripper(s) clamp to a selected seal zone, and the downstream gripper(s) clamp to the same seal zone—but on a side of the separation line opposite from the upstream gripper. In a third, "on the fly" mode, the upstream and downstream gripper(s) clamp to a single or two adjacent seal zones, such that a single separation line is interposed between them, and both the upstream and downstream gripper(s) are advanced downstream. However, the downstream gripper(s) are advanced at a faster rate than are the upstream gripper(s), causing (in the instance that there are grippers on only one side of the axis) a gradual tearing of the wakened separation line.

In the above modes, it is preferred that a sensor inform the controller of the position of a leading edge of the bandolier to correctly actuate the grippers and the motive devices.

In a further embodiment, two upstream grippers and two downstream grippers are capable of separate actuation and displacement, as by providing a separate cylinder and motive device for each gripper. These grippers may be controlled by a controller in such a way that after the terminal premium package is separated from the bandolier, it is "thrown" rather than simply dropped. In one mode of operation of this embodiment, grippers on one side of the bandolier path are used to tear and throw the end premium package, and then grippers on the other side of the bandolier path are used to tear and throw the next packaged premium. In another mode of operation of this embodiment, the downstream grippers are actuated at the same time to tear and throw the end premium.

BRIEF DESCRIPTION OF THE DRAWINGS

Further aspects of the invention and their advantages can be discerned in the following detailed description, in which like characters denote like parts and in which.

DETAILED DESCRIPTION

Figure 1:
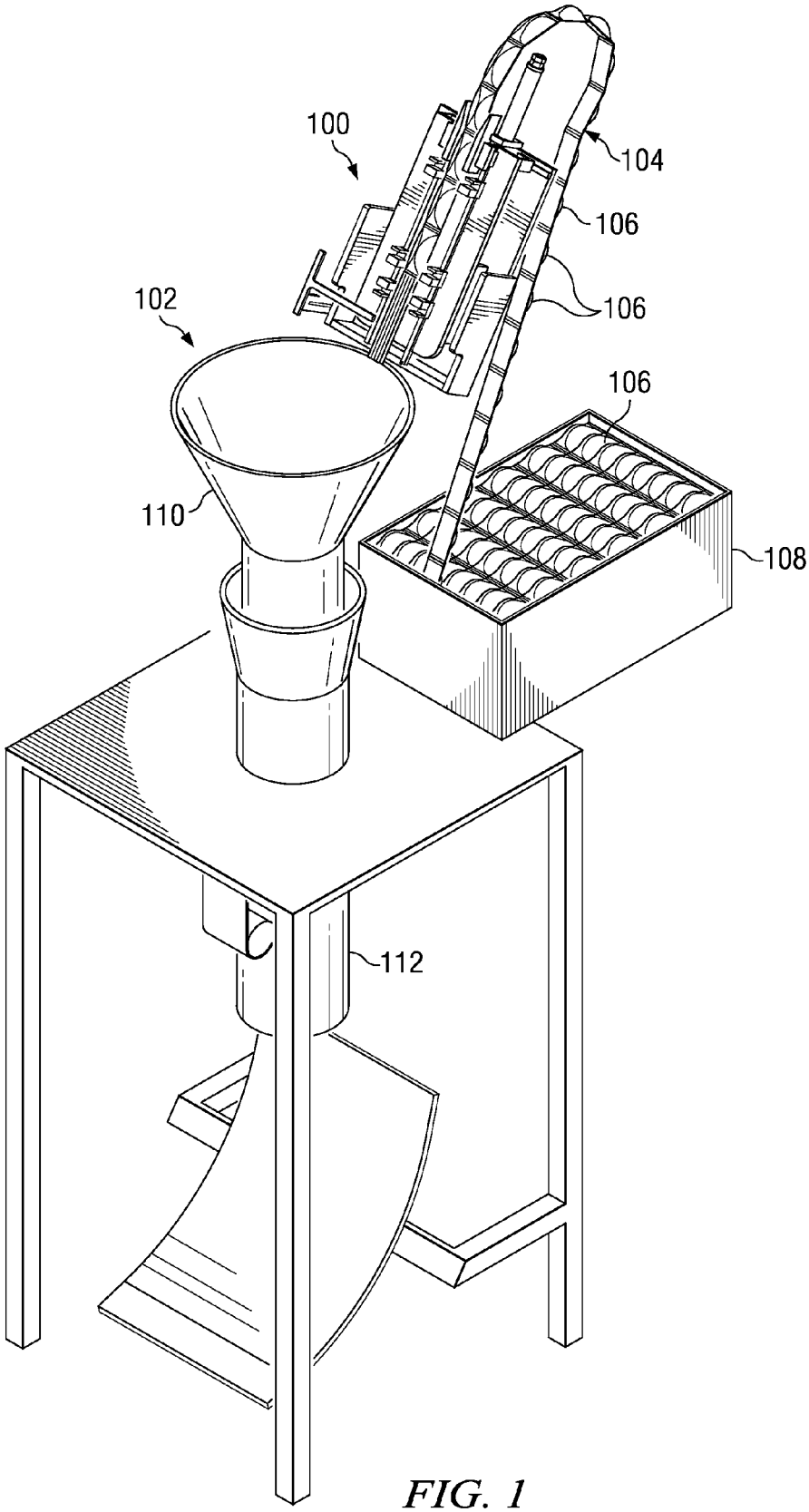
FIG. 1 is an isometric view of a fragile premium separator according to the invention, as shown incorporated into a representative package inserter and a bandolier of fragile premiums.

FIG. 1 shows how a fragile separator 100 according to the invention might be employed as a portion of a vertical-form fill bagger assembly indicated generally at 102. The separator 100 receives a bandolier 104 of packaged premiums 106; the packaged premiums 106 are joined end to end and may be of a fragile variety, such as a cracker, pretzel or other baked good. The bandolier 104 may be fed into the separator 100 from a carton 108 or the like.

Figure 18:
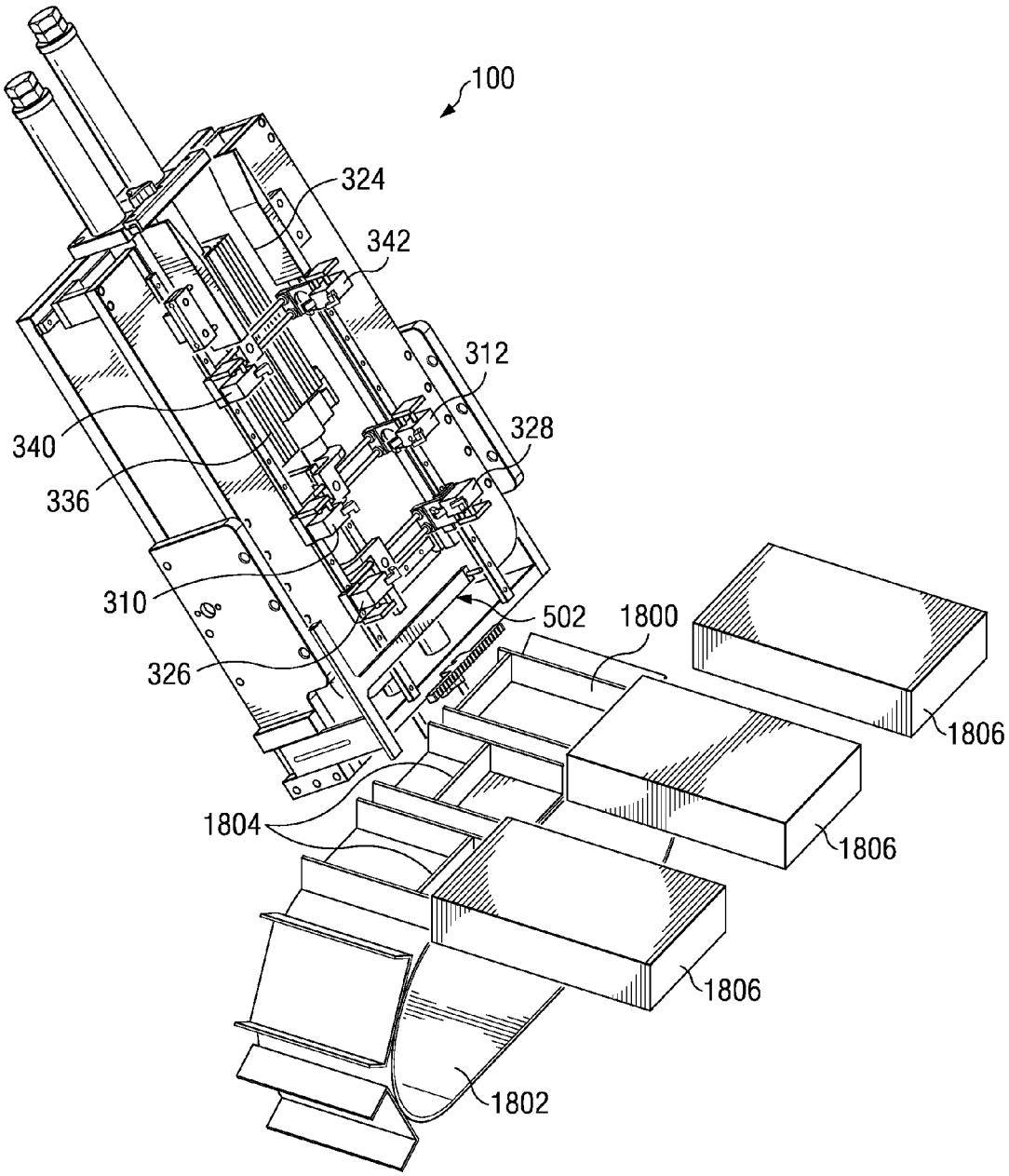
FIG. 18 is an isometric view of a premium separator according to the invention as used in conjunction with a second package inserter.
Figure 19:
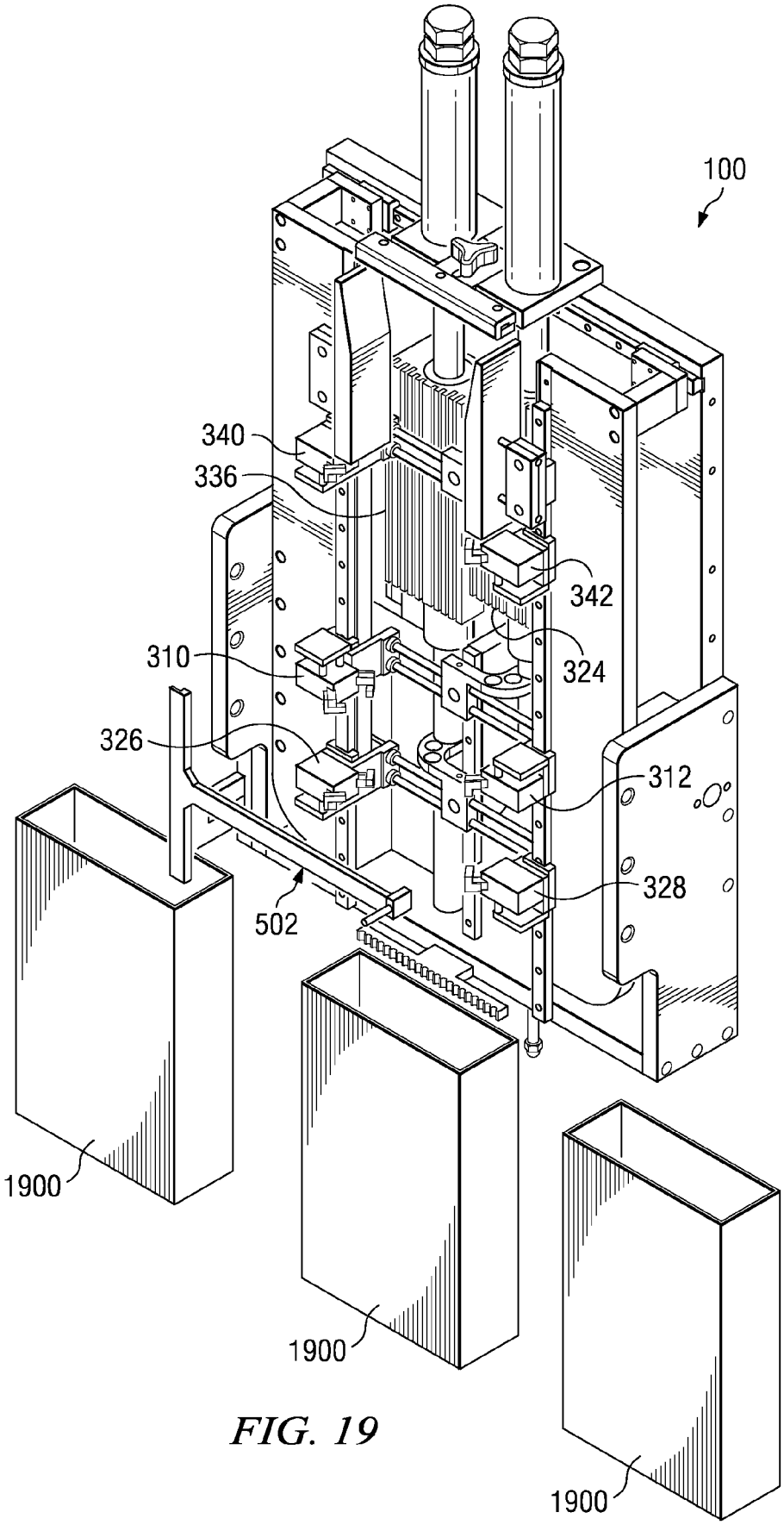
FIG. 19 is an isometric view of a premium separator according to the invention as used in conjunction with a third package inserter.

The separator serially separates the premiums 106 from the bandolier 104, and in this embodiment drops a separated packaged premium 106 into a chute 110. The chute 110 also receives a measured allotment of dry goods such as cereal. The chute 110 feeds the dry goods and packaged premium 106 into a bagger tube 112. The tube 112 carries on its outside surface a continuous sleeve of flexible bagging material, such as plastic (not shown). This sleeve of bagging material is periodically closed and sealed around the contents, forming a series of individual sealed bags which are cut from each other. The bags (not shown) can then be inserted into cardboard cartons or the like. The assembly 102 is only one of many kinds of inserter apparatus which can employ the invention. Two others are shown in FIGS. 18 and 19 and will be described below.

Figure 2:
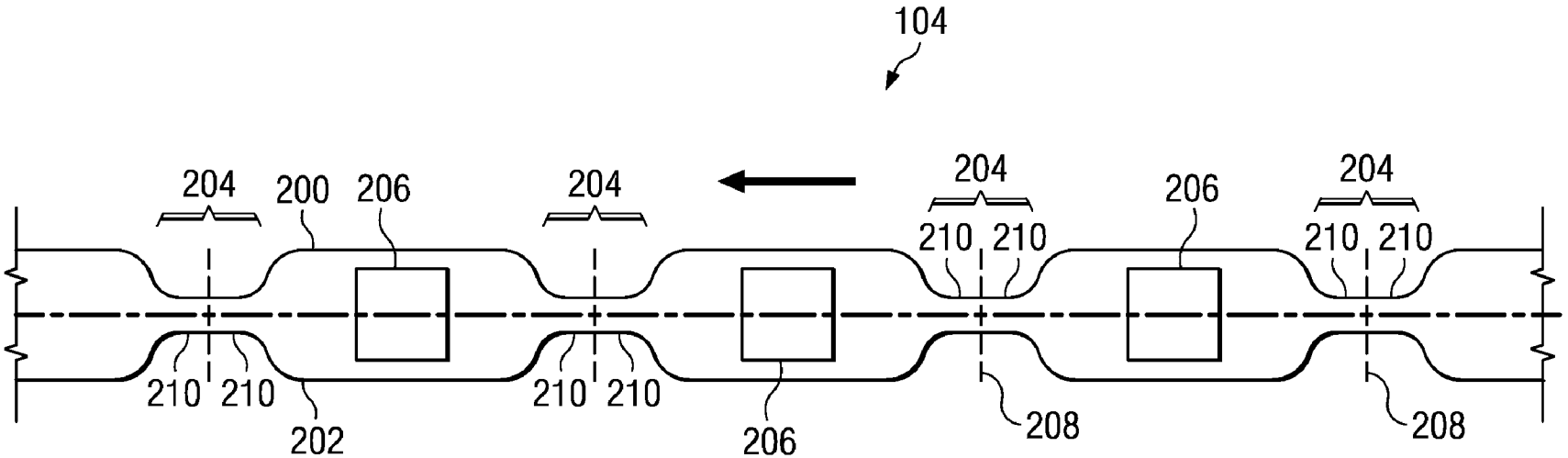
FIG. 2 (PRIOR ART)
FIG. 2 is a schematic axial cross-sectional view of a portion of a bandolier of fragile premiums according to the prior art.

A schematic cross-sectional view of a typical bandolier 104 of packaged premiums is shown in FIG. 2. The bandolier 104 has an upper sheet 200 and a lower sheet 202, which are joined together at their sides (not shown in this section) and along the axial length of the bandolier at periodic seal zones 204 as by heat fusion. A premium 206 is housed by the package 106 thus formed. Each seal zone 204 has a wakened separation line 208 which may be formed by creasing, cutting or perforation. The separation line 208 divides each seal zone 204 into adjacent subzones 210. In performing a separation of a terminal one of the packages 106 from the bandolier 104 according to the invention, care is taken not to impact the possibly fragile premiums 206, but instead to grasp each package 106 only in the area of the seal zones 204 upstream or downstream from it (downstream being indicated by the direction arrow). As will be hereinafter explained, grippers according to the invention clamp packages 106 only in the seal zones 204, by clamping lower sheet 202 to upper sheet 200. Each gripper is controlled to land within a seal zone, but entirely within a single subzone 210 rather than straddling any separation line 208.

Figure 3:
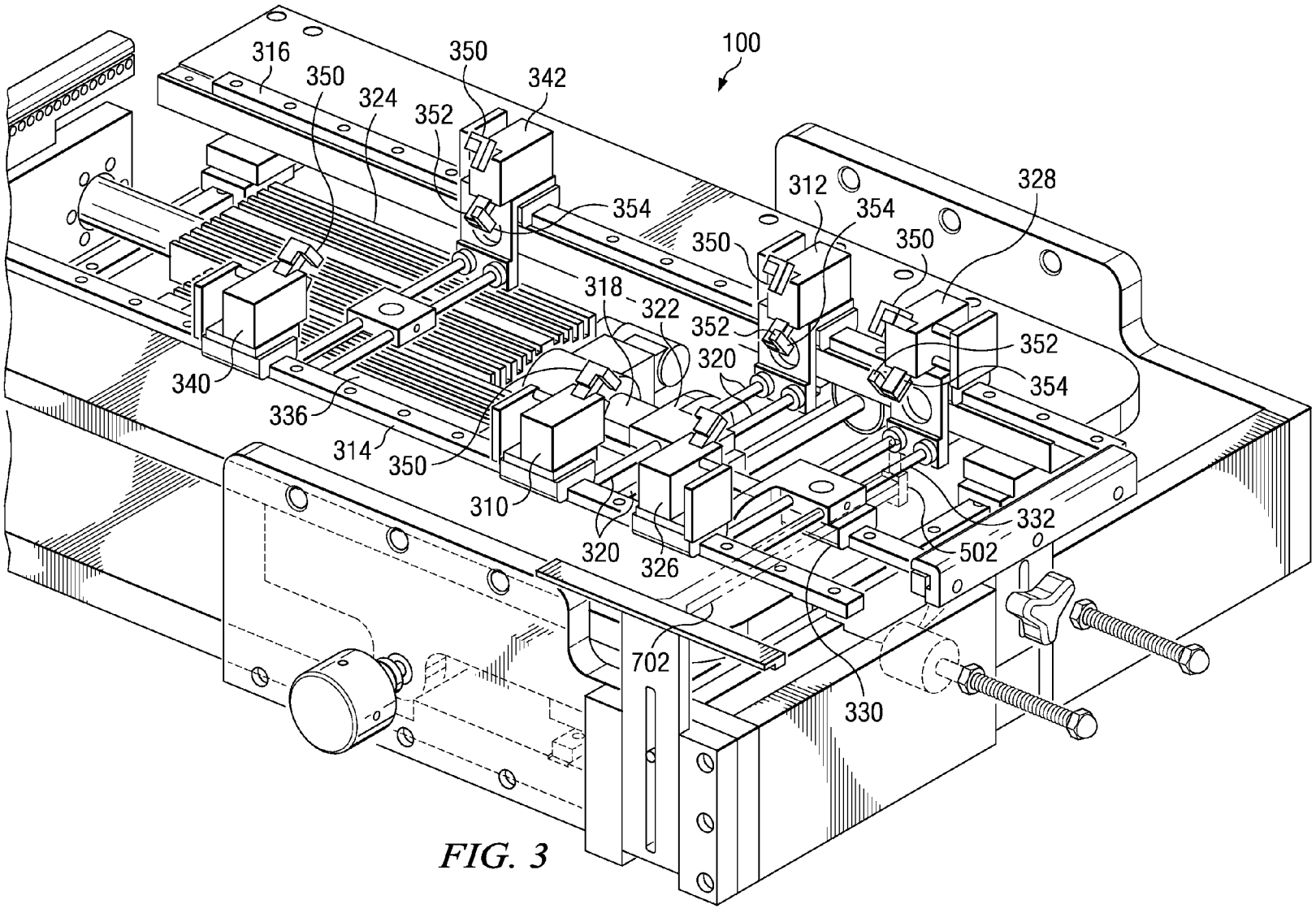
FIG. 3 is an isometric view of the fragile premium separator shown in FIG. 1, certain parts being shown in phantom for purposes of clarity.
Figure 4:
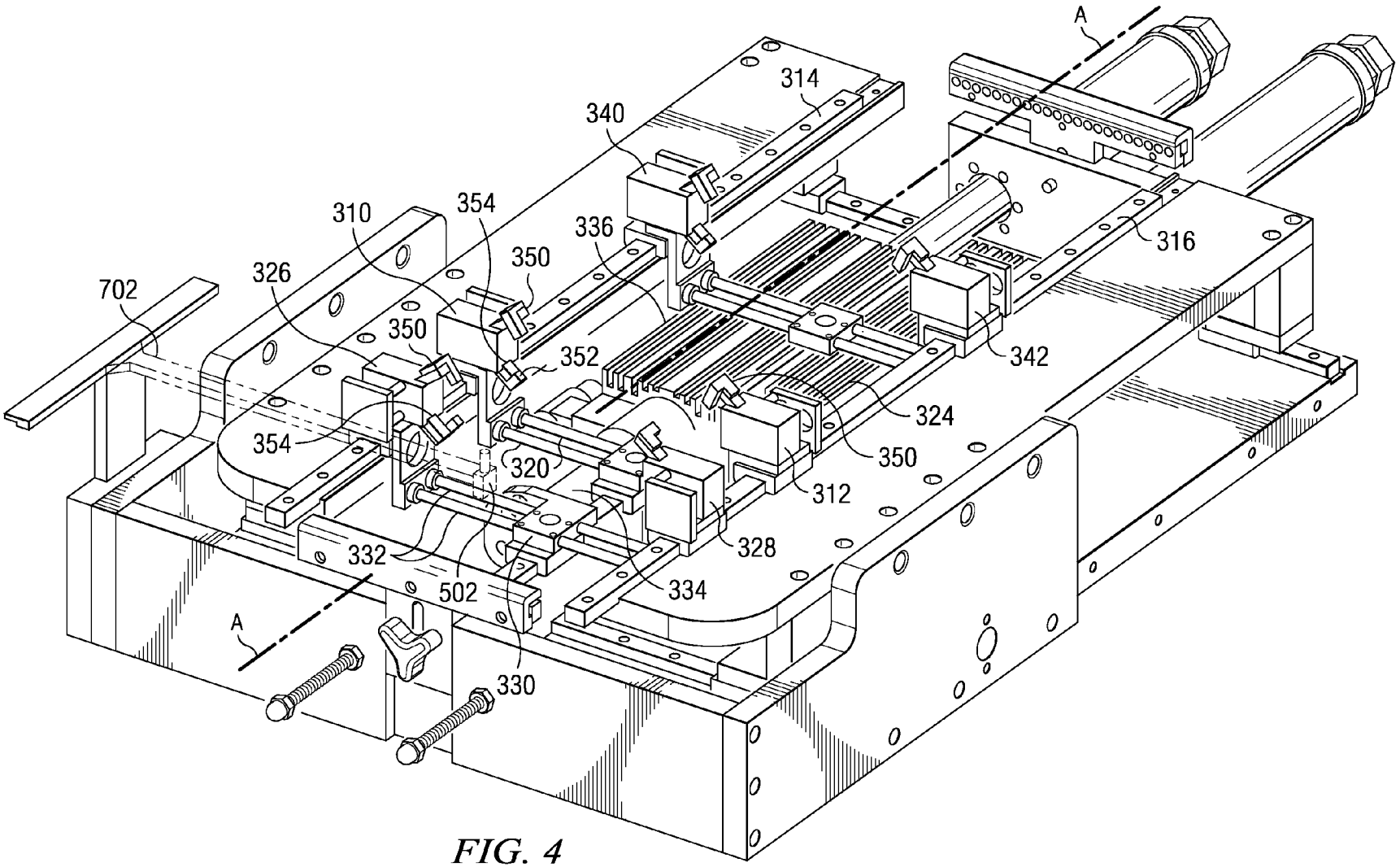
FIG. 4 is an isometric view of the fragile premium separator shown in FIG. 3, as taken from another angle.

Details of the construction of an exemplary separator 100 according to the invention are shown in FIGS. 3 and 4. In the illustrated embodiment, there are provided a left upstream gripper 310 and a right upstream gripper 312, where "upstream" is a direction upward and to the left in FIG. 3. The gripper 310 slides, in an upstream and downstream direction, on a left track 314 while the gripper 312 slides, in an upstream and downstream direction, on a right track 316. The upstream grippers 310 and 312 are connected to a longitudinal piston 318 by connecting rods 320 and block 322. The piston 318 in turn is displaced in an upstream or downstream direction by an upstream gripper motive device 324, which in the illustrated embodiment is an electric motor but which instead could be a linear actuator or a hydraulic or pneumatic valve. The connection of the upstream grippers 310, 312 to a single piston 318 means that the grippers 310, 312 will displace up and down tracks 314, 316 in tandem.

The separator 100 further has left and right downstream grippers 326 and 328, which, as their name implies, are disposed downstream from the upstream grippers 310 and 312. The left downstream gripper 326 slides on track 314, while the right downstream gripper 328 slides on track 316. The grippers 326, 328 are affixed to a central block 330 by connecting rods 332. The block 330 in turn is connected to a piston 334, which in turn is extended in a downstream direction, or retracted in an upstream direction, by a downstream gripper motive device 336. Since both grippers 326, 328 are affixed to a single piston 334, the grippers 326, 328 will slide in tandem upstream or downstream along tracks 314, 316. The motive device 336 is in the illustrated embodiment an electrical motor, but could also be a linear actuator or a hydraulic or pneumatic valve.

The mobile grippers 310, 312, 326, 328 are preferably accompanied by left and right stationary grippers 340, 342. Left stationary gripper 340 is aligned to be upstream from left upstream gripper 310. Right stationary gripper 342 is disposed to be upstream from right upstream gripper 312. These stationary grippers 340, 342 are the same lateral distance away from the bandolier path axis A as are grippers 310, 312, 326 and 328, but are not displaceable upstream or downstream, and are not connected to any motive device for accomplishing this.

Each of the grippers 310-342 has at least one finger 350, which in an unactuated condition is suspended over the plane which the bandolier 104 occupies in separator 100. The finger 350 is actuable to clamp a seal zone of a package 106 to an opposed surface of the gripper—preferably, a terminal surface 352 of an opposed finger 354 that, in an unactuated condition, is disposed below the plane of bandolier 104. It is also possible to have only an actuable lower finger 354 and a non actuable opposed surface above the bandolier plane. Preferably, however, each gripper 310, 312, 326, 328, 340, 342 has upper both lower and upper fingers or jaws 350, 354 that close on a seal zone between them when actuated.

Figure 4A:
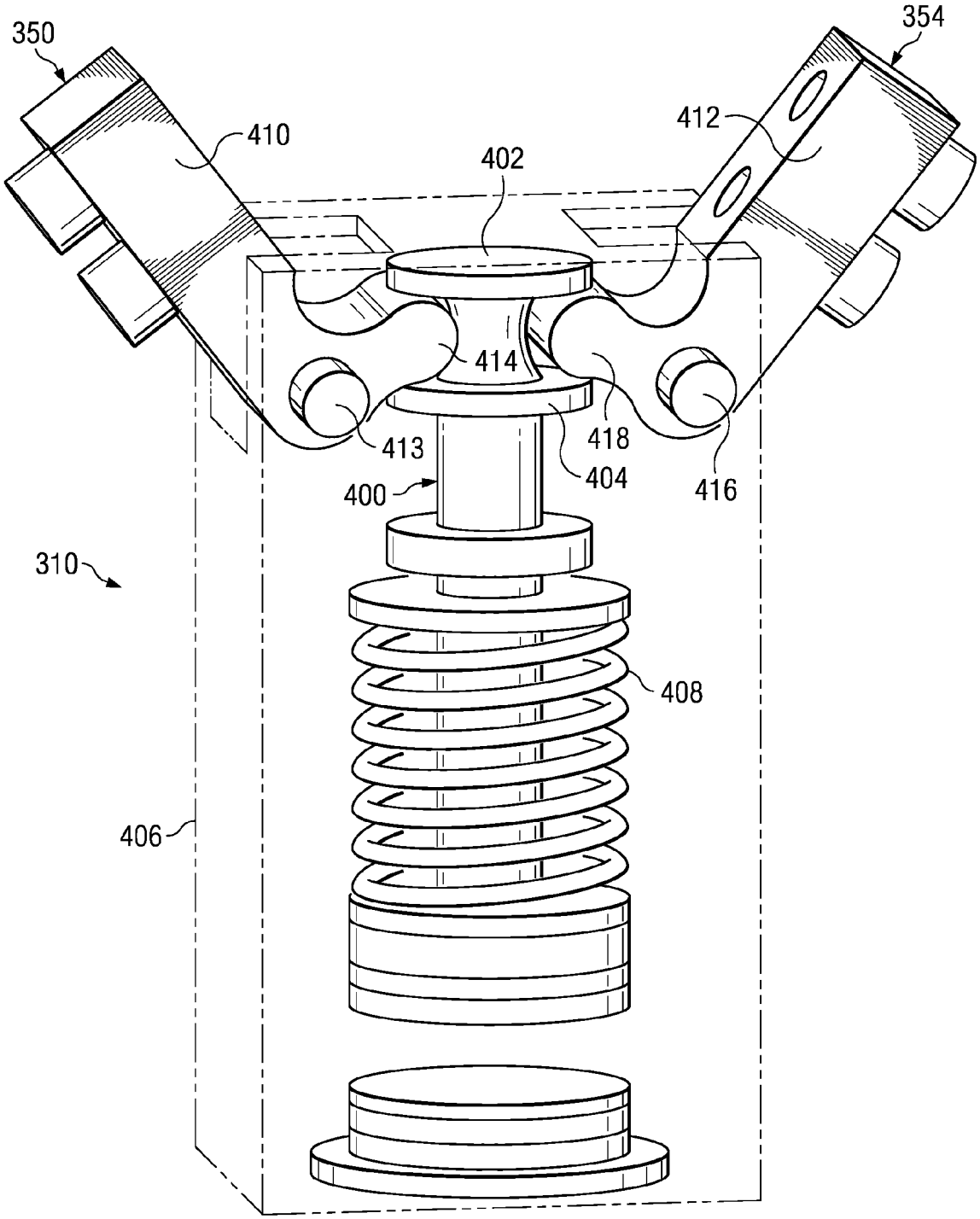
FIG. 4A is a detail sectional view of an exemplary gripper for use with the invention.

FIG. 4A is a sectional view of one of the grippers (by way of example, gripper 310). In this exemplary structure, a piston 400 with upper and lower flanges 402, 404 reciprocates within a gripper body 406. The flanges are urged downwardly when a solenoid is turned on, driving the piston 400 downward. The flanges are urged upwardly by coil spring 408 when the solenoid is not turned on. The gripper 310 has opposed finger elements 410 and 412 that respectively are part of opposed fingers 350 and 354 (first seen in FIG. 3). The finger element 410 pivots around pivot 413 and has an arm 414 which is caged between flange 402 and flange 404. The finger element 412 pivots around a pivot 416 and has an arm 418 which is caged between flange 402 and flange 404. When the piston 400 is urged downwardly, the finger elements 410, 412 (and therefore the entire fingers 350 and 354) pivot toward each other, grasping, pinching or clamping a packaged premium seal zone between them; when the piston 400 is urged upwardly, the finger elements 410 and 412 pivot away from each other. The illustrated internal structure of gripper 310 is representative only and other clamping devices could be employed in its stead.

Figure 5:
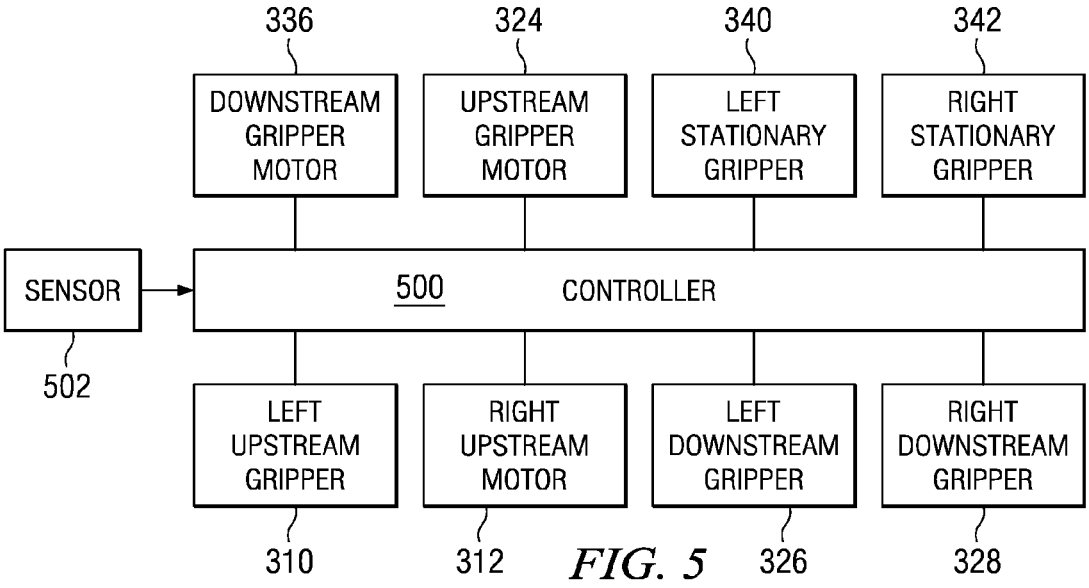
FIG. 5 is a schematic control diagram showing principal components of a fragile premium separator according to the invention.

FIG. 5 is a schematic control diagram showing how a controller or other processor 500, preferably one which is programmable, controls the actuation of each of the gripper motors 336 and 324, and the grippers 310, 312, 340, 342, 326 and 328. Signals are sent to motors 324 and 336 to control the speed and direction of the pistons 318, 334 which they displace. Pistons 318, 334 (FIGS. 3 and 4) will in turn control the upstream and downstream locations and speeds of upstream and downstream grippers 310, 312, 326 and 328. The controller 500 further sends signals to each of the grippers 340, 342, 310, 312, 326 and 328 to open or close their respective fingers 350, 354. In one embodiment the controller 500 will receive feedback or position signals from motors 324 and 336 to control these devices.

A sensor 502 is used (in most modes) to sense the leading edge of the terminal packaged premium in the bandolier 106; in one embodiment, the sensor 502 (which can be an infrared sensor) senses the occlusion of the path between its transmitter and receptor and will sense when this blocking or occlusion ends. A change in a signal from sensor 502 can be used in various ways by the controller 500 to control the actuable components.

Figure 6A:
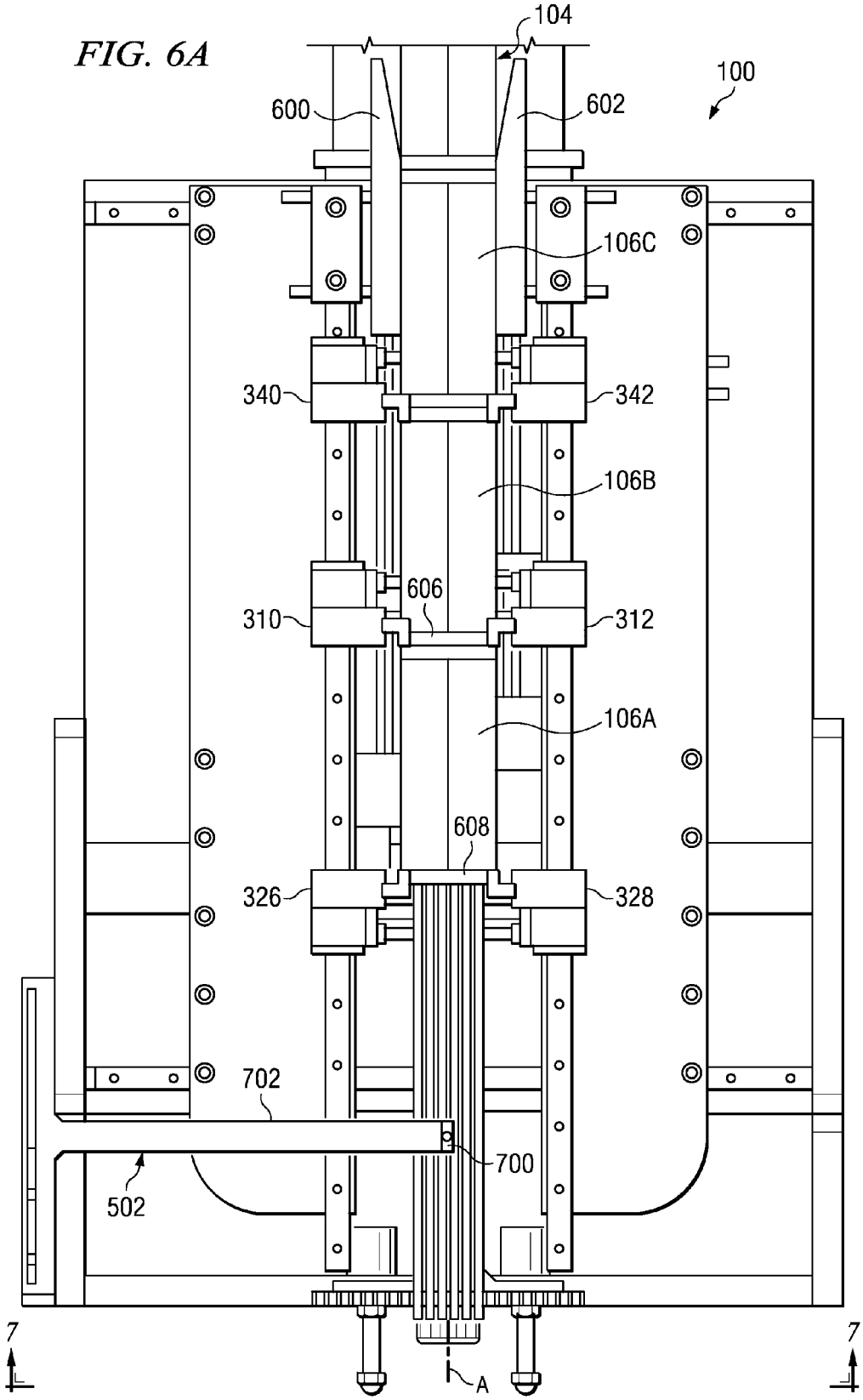
FIGS. 6A-6C are elevational views of a two-sided fragile premium separator, illustrating successive steps in a "pull" mode of operation.
Figure 6B:
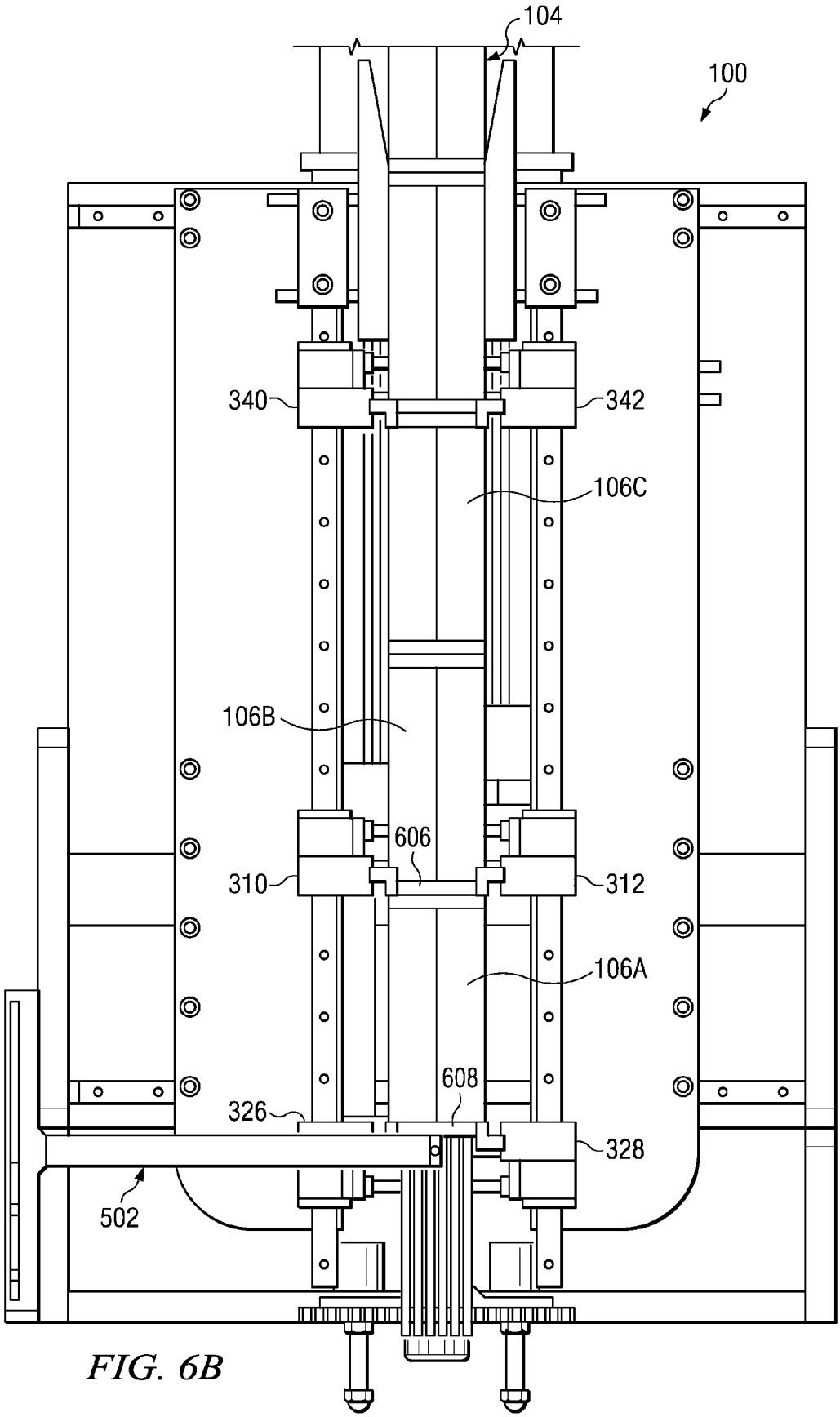
Figure 6C:
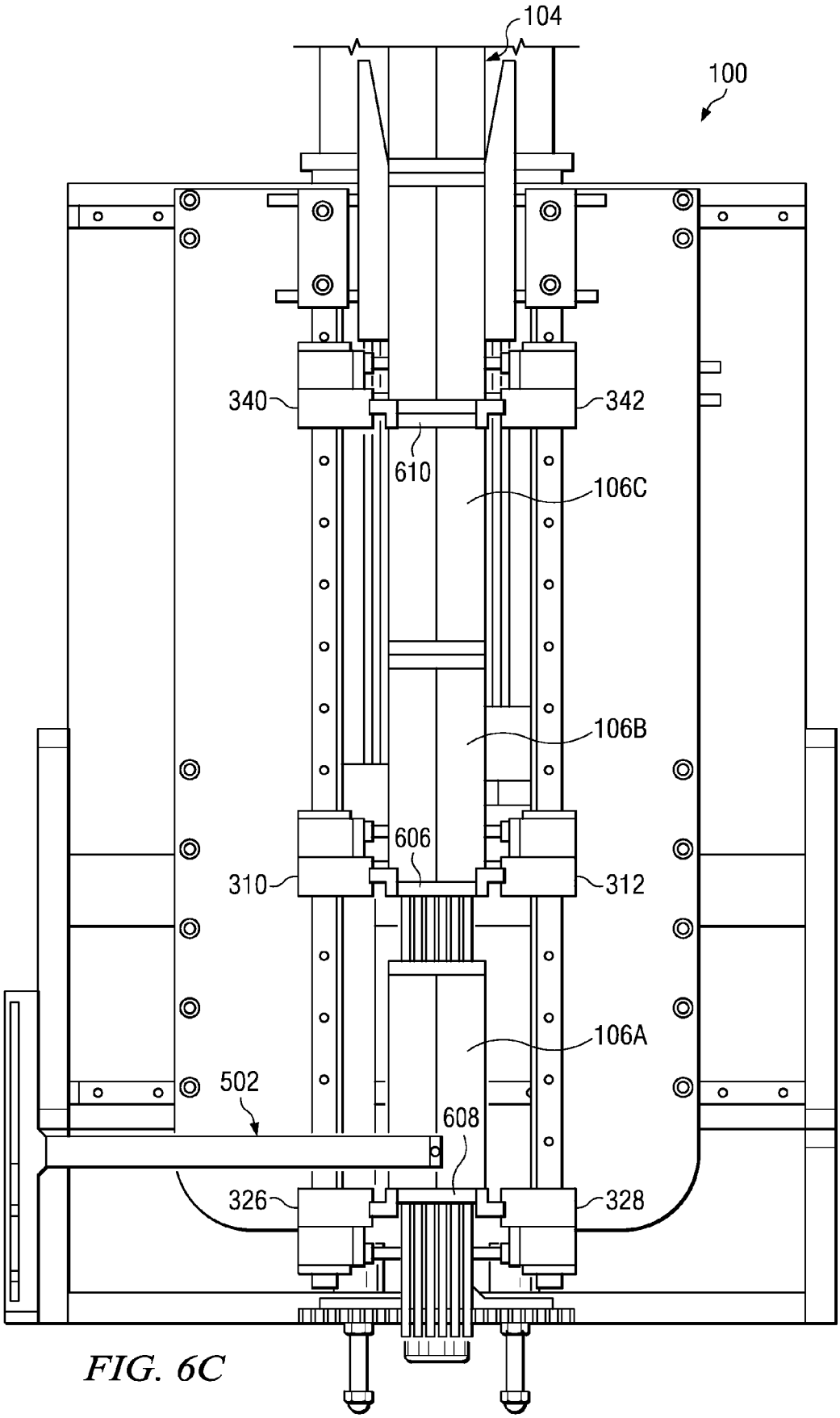
Figure 7:
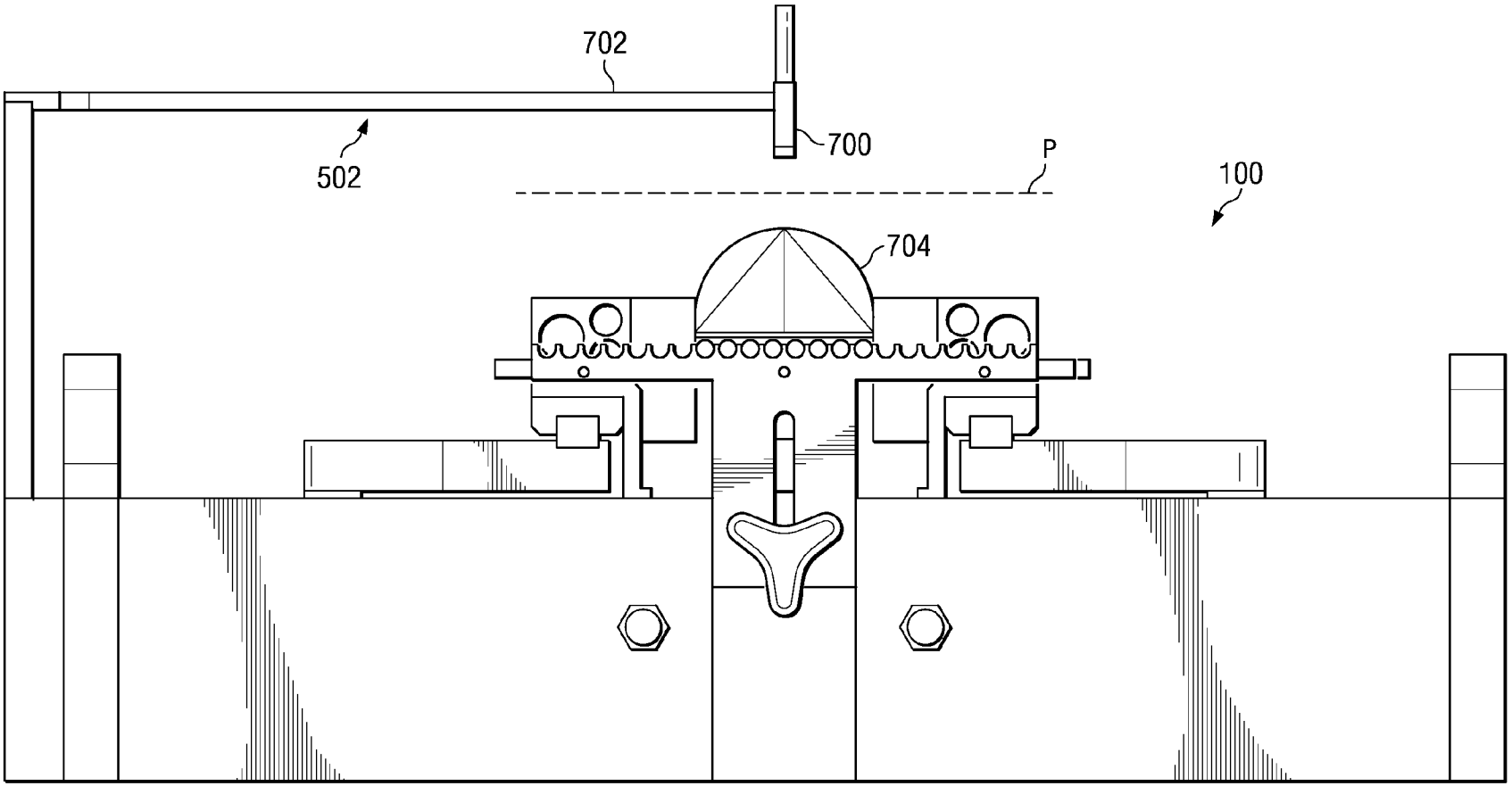
FIG. 7 is a schematic end view taken substantially along line 7-7 of FIG. 6A.

FIG. 6A-6C are successive elevational views of a separator 100 which is equipped with stationary grippers 340 and 342, upstream grippers 310 and 312, and downstream grippers 326 and 328. With reference to FIG. 6A and FIG. 7, the sensor 502 includes a sensor cell 700 suspended on a boom 702 above the plane P occupied by the bandolier 104 of packaged premiums 106A-C, and an emitter 704 disposed below plane P in opposition to the sensor cell 700. The separator 100 may be fitted with a pair of beveled guides 600, 602 disposed at an upstream end of the bandolier path, so as to guide the bandolier 104 into the rest of the separator 100. In FIGS. 6A-6C, 8A-8C, 9A-9C, 10A-10C, 11A-11C, 12A-12C, 20A-20K and 23A-23H, the top of the figure is in an upstream direction, and the bottom of the figure is in a downstream direction.

FIGS. 6A through 6C illustrate three successive steps in a two-sided "pull" mode of operating the separator 100. In FIG. 6A, stationary grippers 340, 342 are disengaged from the bandolier 104. The upstream grippers 310, 312 have gripped a leading seal subzone 606 of packaged premium 106B. The downstream grippers 326 and 328 have gripped a leading seal subzone 608 of the packaged premium 106A.

In FIG. 6B, grippers 310 and 312, and grippers 326 and 328, have all moved downstream by a predetermined displacement equal to the length of one of the packages 106A-C. This predetermined displacement can be programmed into the software of controller 500, and suitable signals can be sent back from the motive devices 324, 336 when this amount of displacement has been achieved. At this point, the sensor 502 will note the leading edge of subzone 608 and inform controller 500.

At this point the upstream motive device 324 is commanded to stop, but motive device keeps going and pushes grippers 326 and 328 through an additional predetermined amount of displacement, which can also be a variable programmed into the controller software. The result is shown in FIG. 6C. Once the additional displacement $\Delta x$ has been achieved, the controller 500 commands the grippers 340 and 342 to land on subzone 610 of package 106C, and commands the grippers 310, 312, 326 and 328 to return to the positions they occupy in FIG. 6A. As a consequence of the grippers 326 and 328 disengaging, the premium 106A is dropped into a box, bag, chute, etc.

Figure 14:
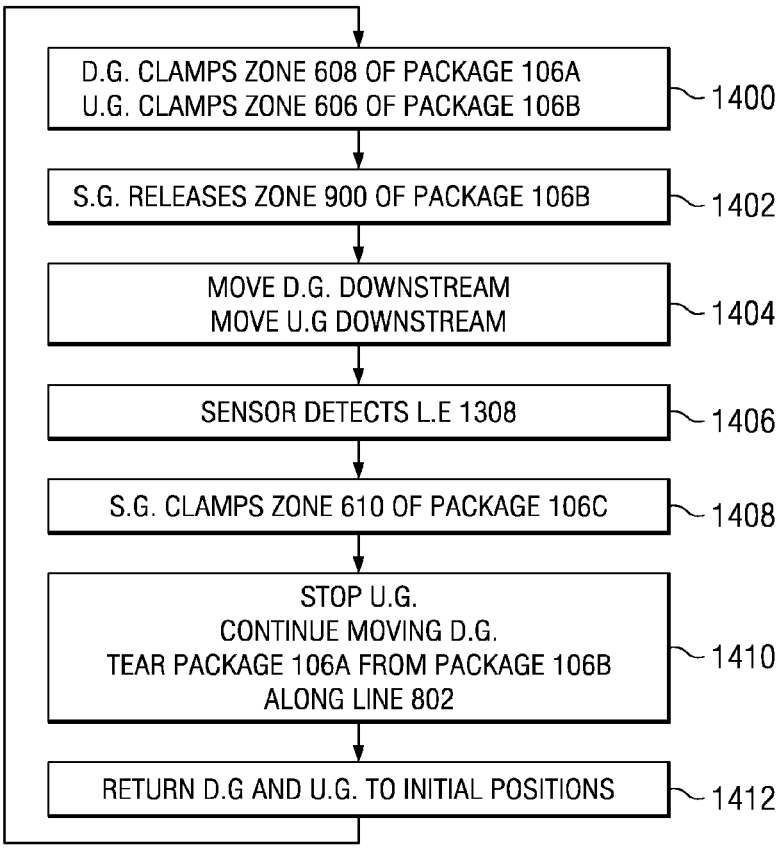
FIG. 14 is a flow diagram illustrating a "pull" mode of operation.
Figure 15:
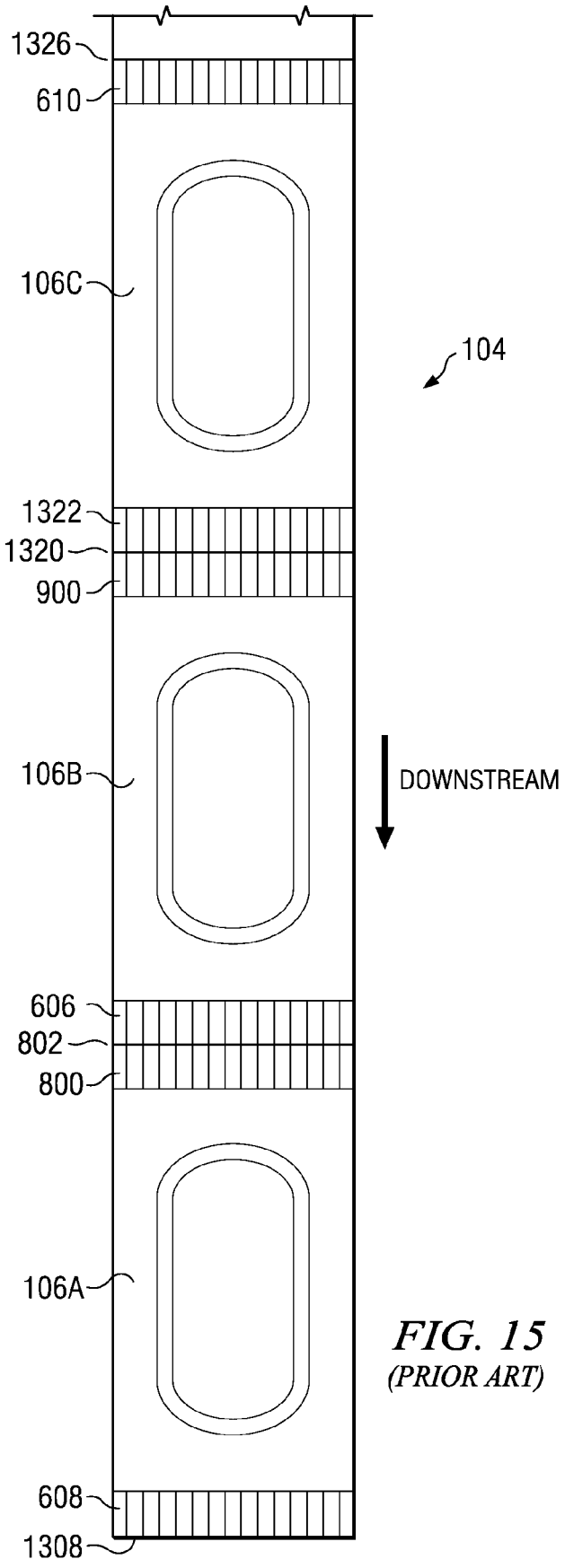
FIG. 15 (PRIOR ART)
FIG. 15 is a schematic plan view of a terminal section of a packaged premium bandolier, referred to by process steps in FIGS. 14 and 16-17.

One possible precise "pull" sequence is diagrammed in FIG. 14, which should be read in conjunction with FIG. 15 and which can apply to the sequence illustrated in FIGS. 6A-6C. At step 1400, the downstream gripper(s) clamp to leading seal zone 608 of package 106A and the upstream gripper(s) clamp to the leading seal zone 606 of package 106B. Next, at step 1402, the stationary gripper(s) release from the trailing seal zone of package 106B. Subsequent to this, at step 1404, the upstream and downstream gripper(s) are sent downstream in concert. At step 1406, the sensor 502 detects the leading edge 1308 of the first package 106A. This causes the processor 500 to instruct the stationary gripper(s) to clamp to trailing seal zone 610 of package 106C at step 1408. After this clamping step, at 1410 the upper gripper will be stopped but the downstream gripper keeps moving. This will tear package 106A from the bandolier 104. At step 1412 the controller 500 instructs the mobile grippers to return to their initial positions.

Figure 8A:
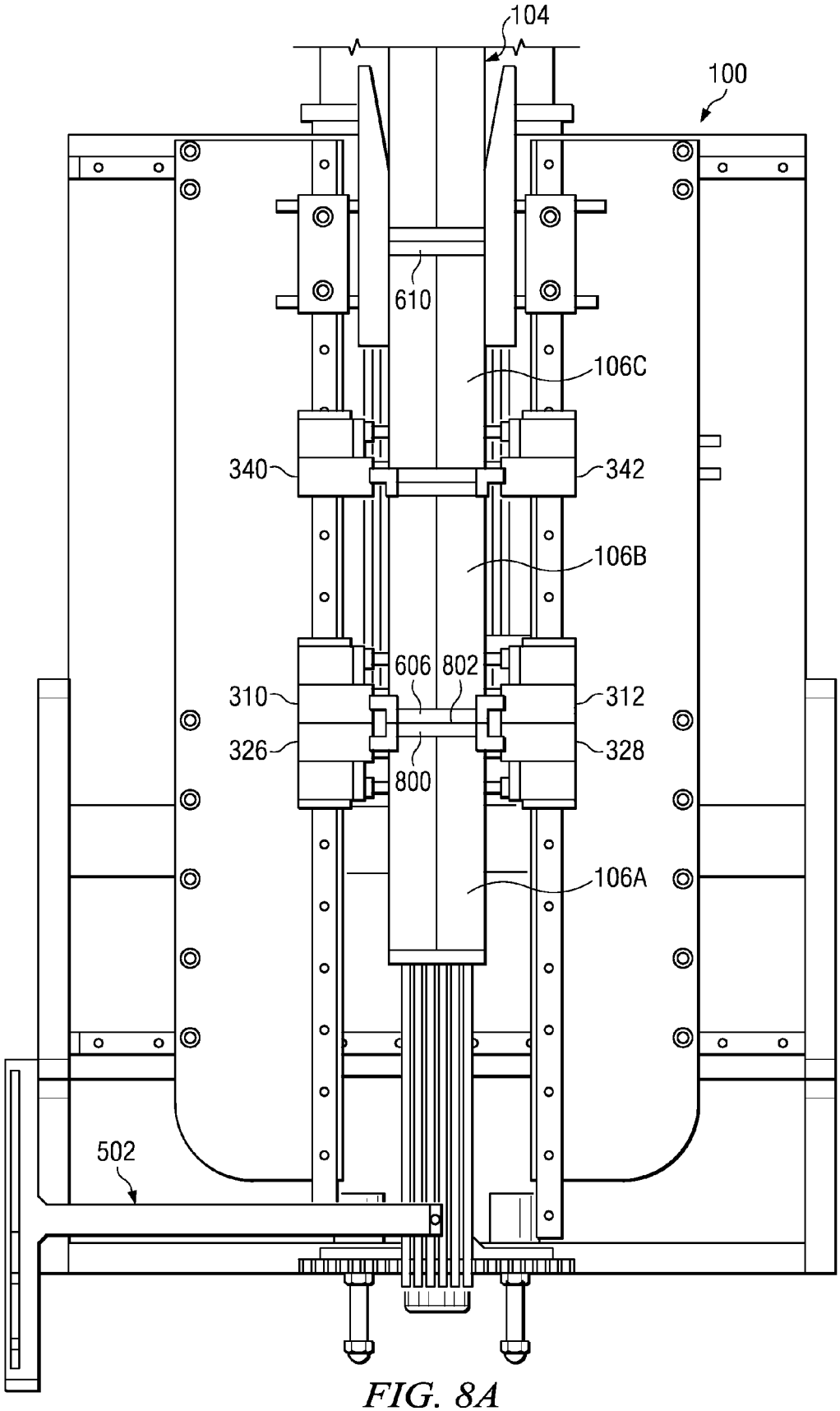
FIGS. 8A-8C are elevational views of a two-sided premium separator, illustrating successive steps in a "push" mode of operation.
Figure 8B:
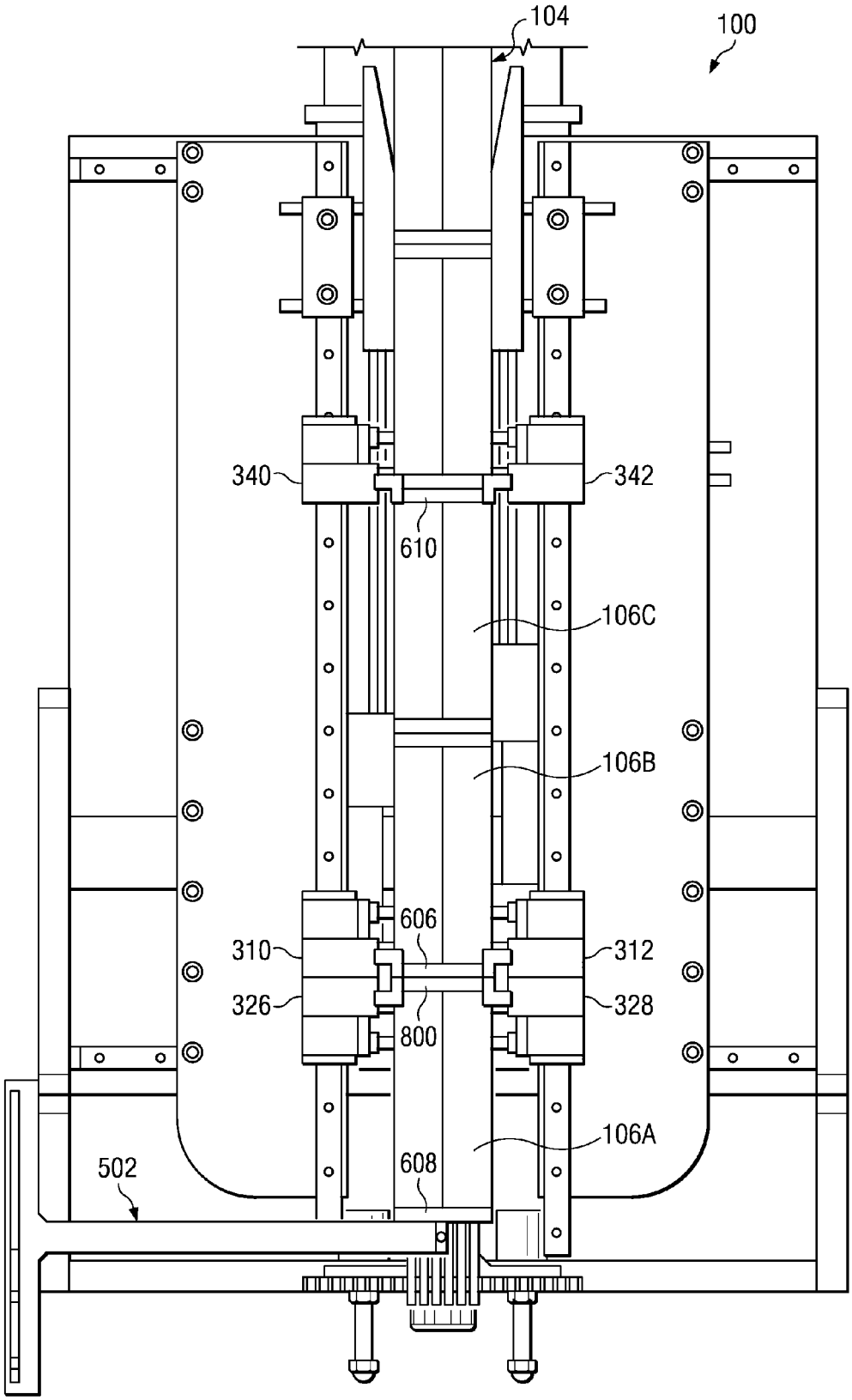
Figure 8C:
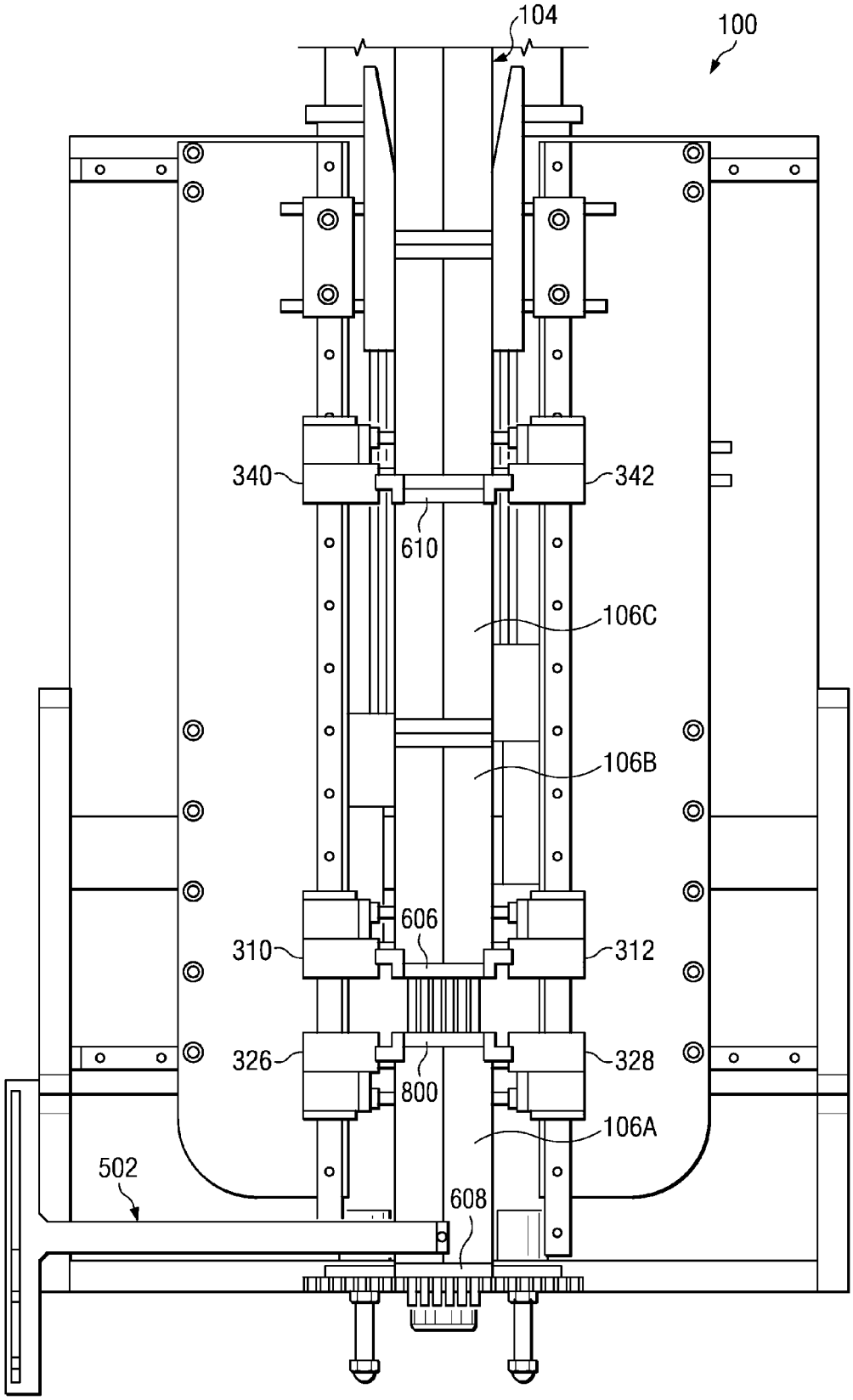

FIGS. 8A-8C illustrate a two-sided "push" mode of operation. In FIG. 8A, stationary grippers 340, 342 are disengaged. Upstream grippers 310, 312 have landed on leading seal subzone 606 of package 106B. Downstream grippers 326, 328 have landed on an adjacent subzone 800 of package 106C, which is separated from subzone 606 by a wakened separation line 802.

In FIG. 8B, grippers 310, 312, 326 and 328 have all been advanced downstream at the same rate. The edge of seal zone 608 is about to be sensed by sensor 502. Stationary grippers 340 and 342 remain unengaged while the concerted displacement of the other grippers happens.

By the time shown in FIG. 8C, grippers 340, 342 engage and upstream grippers 310, 312 stop. Downstream grippers 326, 328 keep going, detaching the package 106A from the remainder of the bandolier. Shortly after this the downstream grippers 326, 328 open, allowing the package 106A to drop. Sensor 502 reports the absence of the package 106A and this datum is in turn used to send grippers 310, 312, 326 and 328 back to their initial positions.

Figure 16:
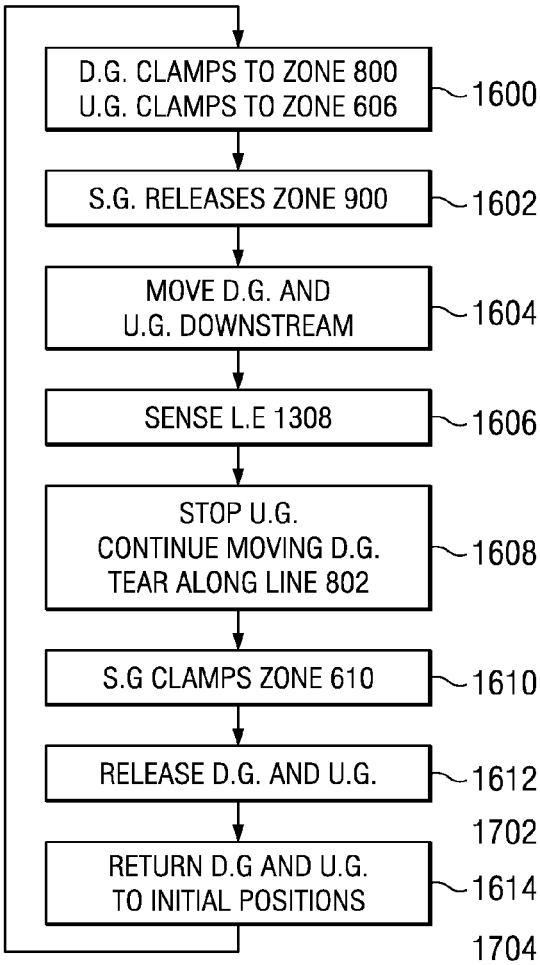
FIG. 16 is a flow diagram illustrating a "push" mode of operation.

One possible "push" sequence of events is diagrammed by FIG. 16, which can apply to the apparatus and mode illustrated in FIGS. 8A-8C and which should be read in conjunction with FIG. 15. At step 1600, the downstream gripper(s) clamp to trailing seal zone 800 of package 106A, while the upstream gripper(s) clamp to leading seal zone 606 of next adjacent package 106B. After this happens, at step 1602 the stationary gripper(s) release from trailing seal zone 900 of package 106B. The downstream and upstream gripper(s) are then moved together downstream at step 1604, until (step 1606) a leading edge 1308 of package 106A is sensed. Responsive to this, at step 1608 the upstream gripper is stopped, while the downstream gripper continues to be pushed downstream, tearing off the leading premium package 106A. At some point after the bandolier 104 is halted by the halting of the upstream gripper(s), the stationary gripper(s) are again closed at step 1610 onto the trailing seal zone of package 106C. Once this is done, at step 1612 the downstream gripper(s) and upstream gripper(s) release, and at step 1614 the upstream and downstream gripper(s) return to their initial positions.

Figure 9A:
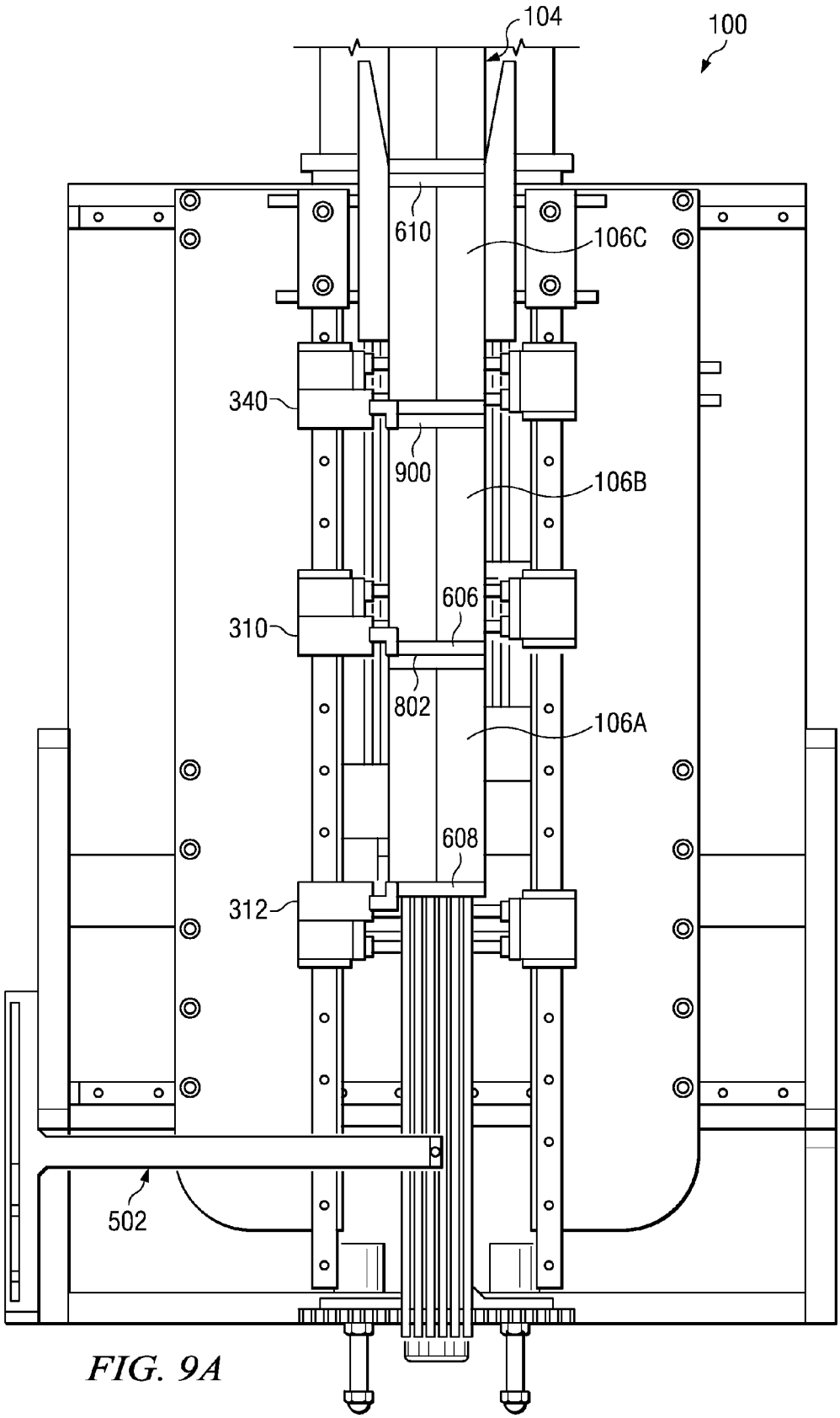
FIGS. 9A-9C are elevational views of a one-sided premium separator, illustrating successive steps in a "pull" mode of operation.
Figure 9B:
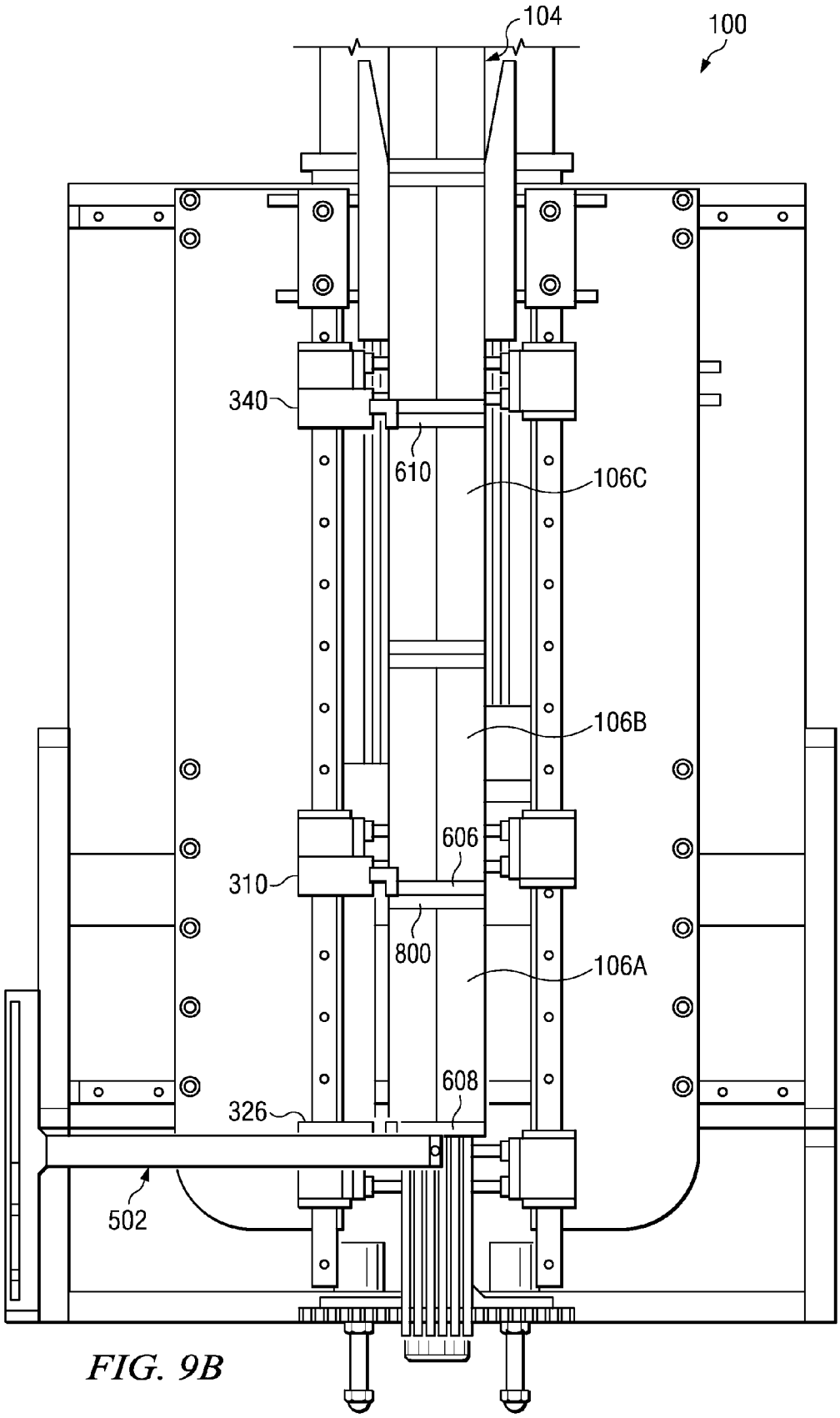
Figure 9C:
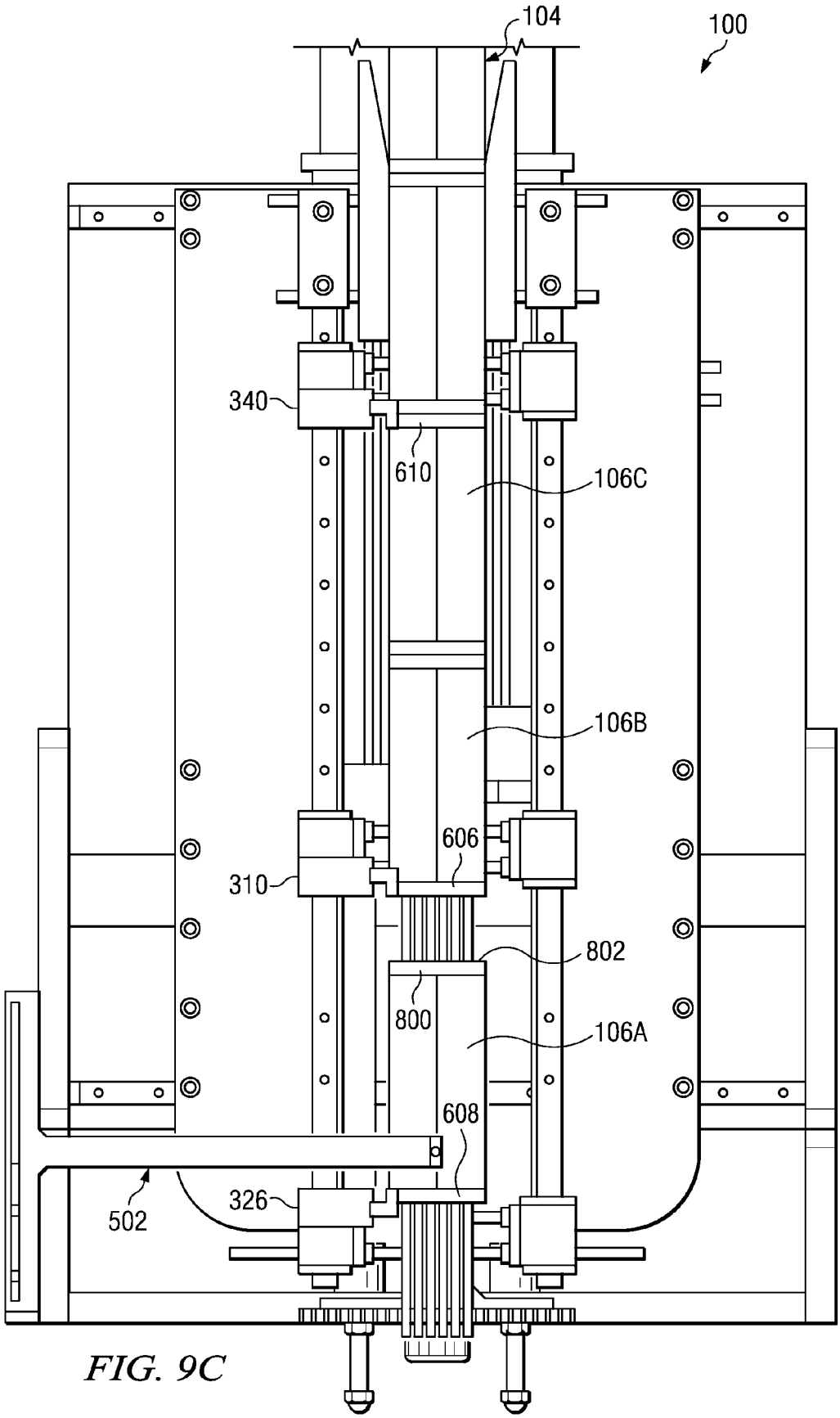

FIGS. 9A-9C show an embodiment in which only one side is supplied with grippers (340, 310 and 312) and the other side has none. FIG. 9A shows an initial position in which stationary gripper 340 has disengaged, and upstream gripper 310 and downstream gripper 312 are engaged, with gripper 310 gripping leading seal zone 606 of package 106B, and gripper 312 gripping leading seal zone 608 of the package 106A. This embodiment shows a "pull" mode of operation in which the landed-on seal zones are not adjacent to each other. Nonetheless only a single wakened separation line 802 occurs on the bandolier between the positions of grippers 310 and 312.

In FIG. 9B, the upstream and downstream grippers 310 and 326 have been advanced together in a downstream direction at the same rate, by an increment selected to be the same as one premium package length. Since gripper 340 is disengaged, this pulls the bandolier downstream by one package. Stationary gripper 340 will now grip trailing seal zone 610 of the package 106C. Sensor senses the downstream edge of package 106A.

Responsive to this, in FIG. 9C, gripper 310 stops, but gripper 326 keeps going. This difference in displacement separates package 106A from adjacent package 106B along the wakened separation line 802. Since the grippers are only on one side of the bandolier axis, the tearing along line 802 will be gradual, starting at one side and tearing through the axis to the other side. At the end of its travel, gripper 326 will be commanded to disengage, dropping premium 106A. Sensor 502 then senses the absence of premium 106A, and this datum is used to retract the grippers 310, 326 to their initial positions seen in FIG. 9A.

A "pull" sequence of operation which can be employed in conjunction with this embodiment is illustrated in FIG. 14.

Figure 10A:
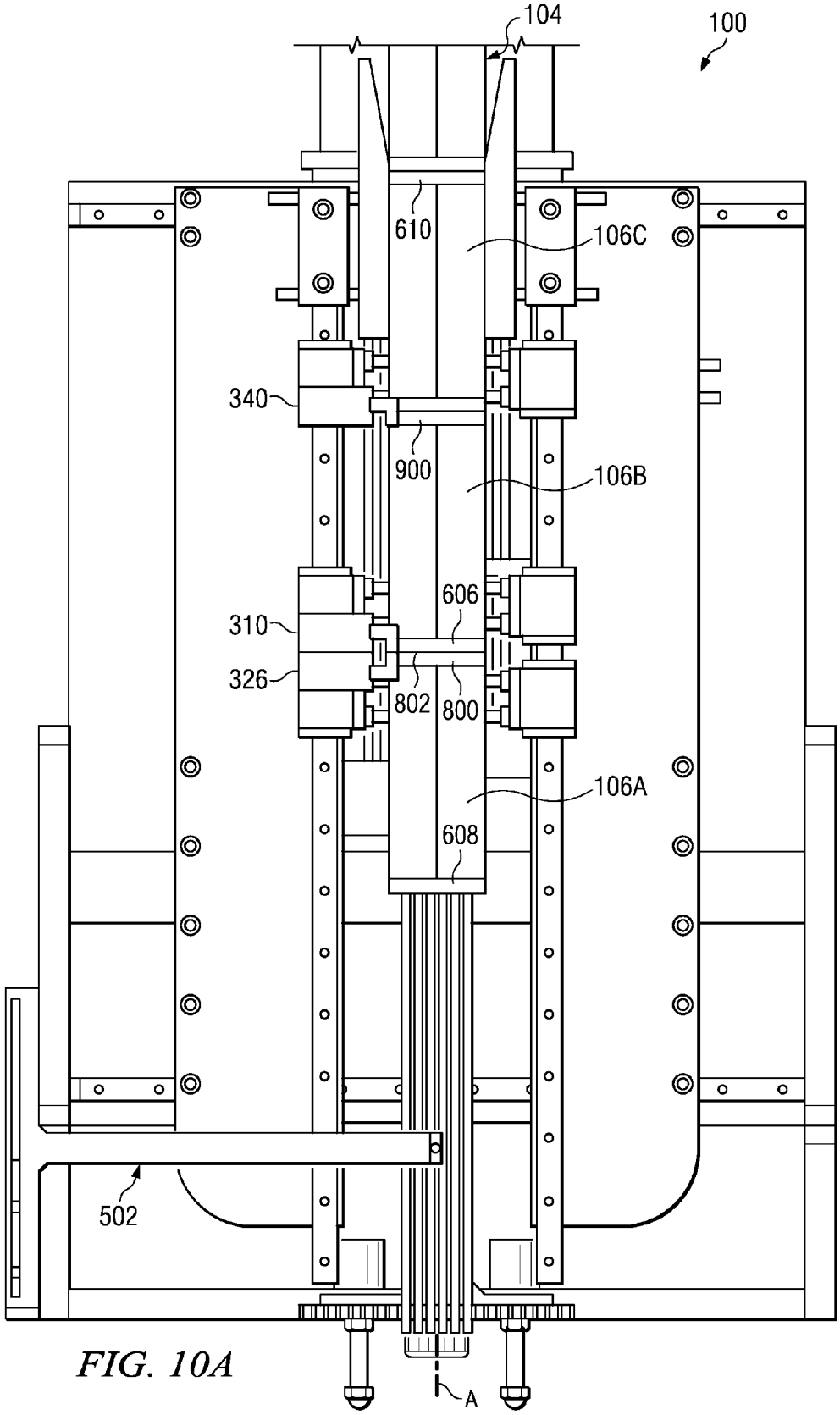
FIGS. 10A-10C are elevational views of a one-sided premium separator, illustrating successive steps in a "push" mode of operation.
Figure 10B:
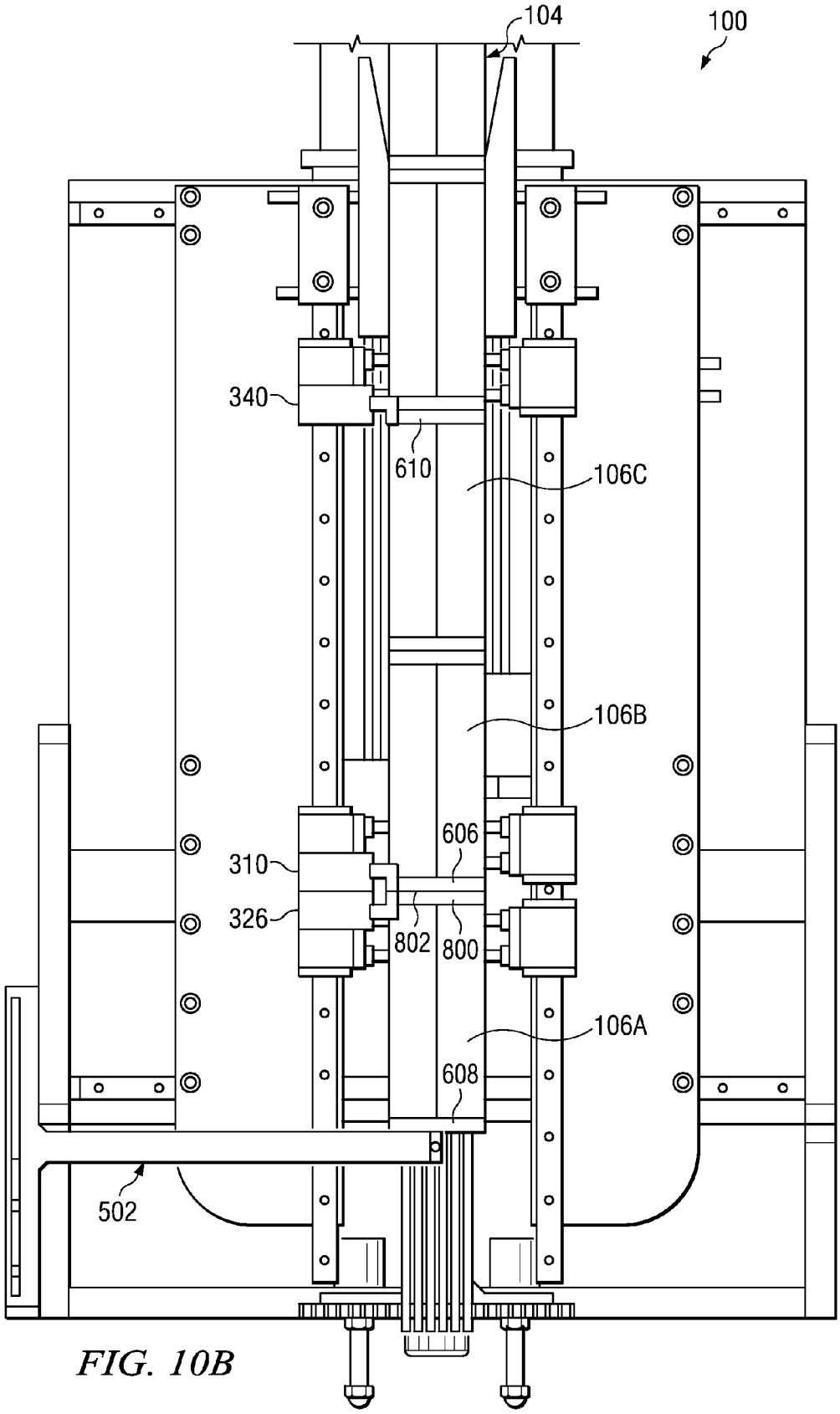
Figure 10C:
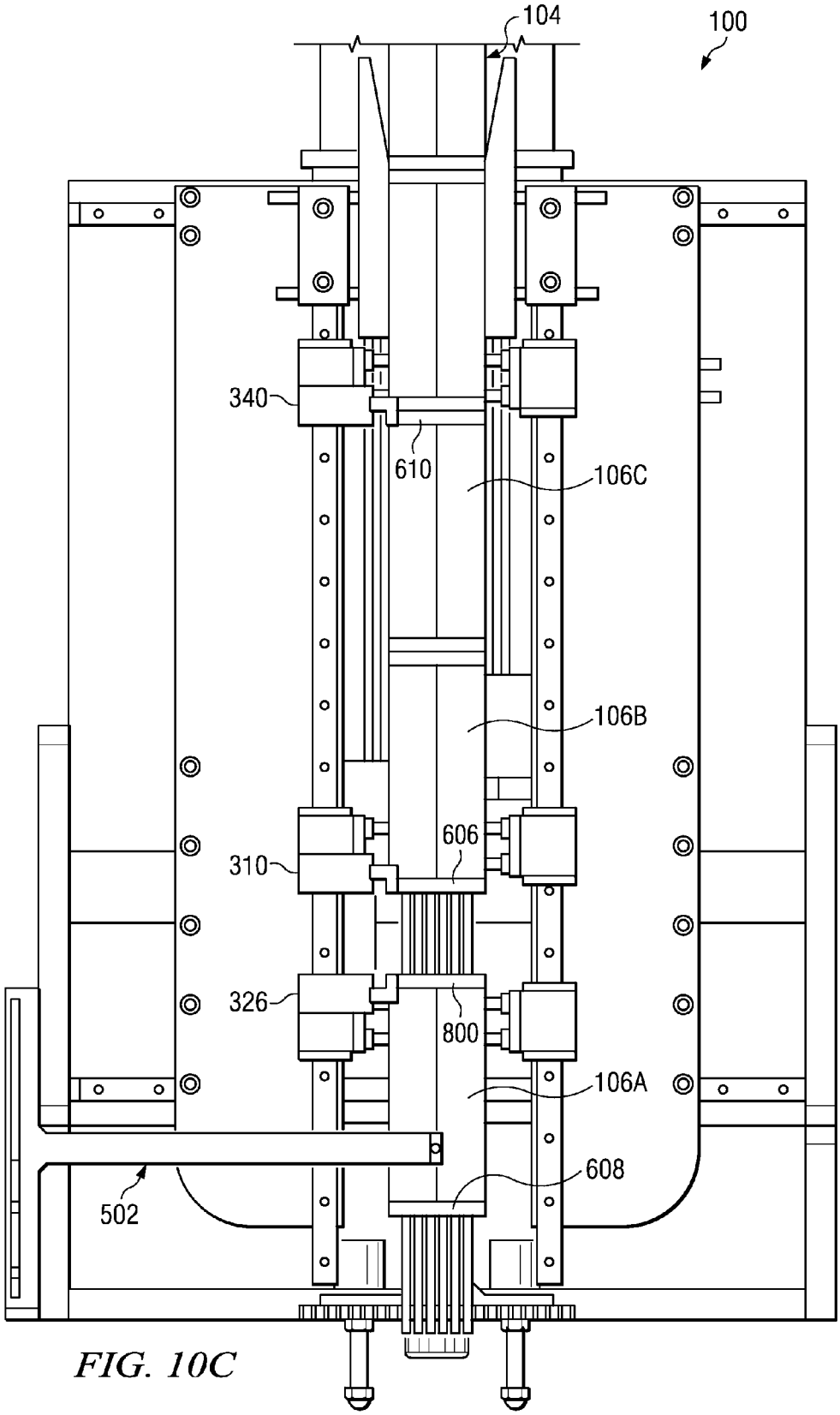

FIGS. 10A-10C illustrate successive steps in a one-sided "push" method of premium separation. In this mode of operation, the separator 100 is equipped with one stationary gripper 340, one upstream gripper 310, and one downstream gripper 326, all on one side of the axis A of the bandolier 104. FIG. 10A shows an initial position. The stationary gripper 340 grips trailing seal zone 900 of premium package 106B. The upstream gripper 310 grips a leading seal zone 606 of premium package 106B. The downstream gripper 326 grips a trailing seal zone 800 of a premium package 106A; the seal zones or subzones 606, 800 are separated by a wakened partition line 802.

Next, the stationary gripper 340 disengages and the upstream and downstream grippers 310, 326 travel downstream in concert to the position shown in FIG. 10B, pulling the bandolier downstream by one premium package length. Thereafter the stationary gripper 340 will clamp to the trailing seal zone of package 106C. The sensor 502 will sense the leading edge of leading seal zone 608 of package 106A.

This causes the upstream gripper 310 to stop (FIG. 10C) while the downstream gripper keeps going, separating seal zone 606 from 800. Gripper 326 then disengages, causing package 106A to drop. When sensor 502 detects the absence of package 106A, the gripper 310 will disengage and grippers 310 and 326 will retract to the position shown in FIG. 10A.

A "push" sequence of operation which can be employed with the embodiment shown in FIGS. 10A-10C is diagrammed in FIG. 16.

Figure 11A:
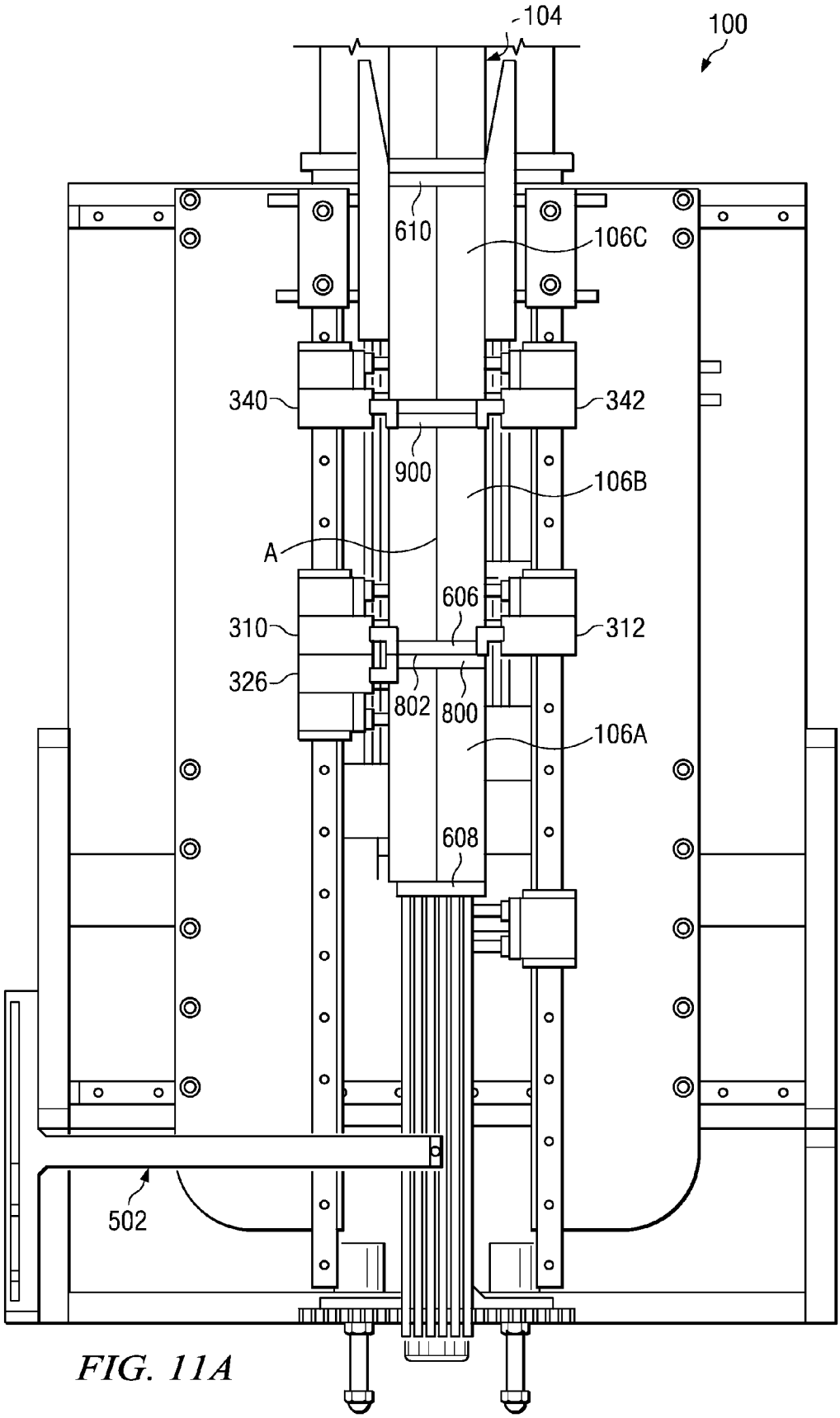
FIGS. 11A-11C are elevational views of a premium separator in which there are two upstream grippers and one downstream gripper, illustrating successive steps in a "push" mode of operation.
Figure 11B:
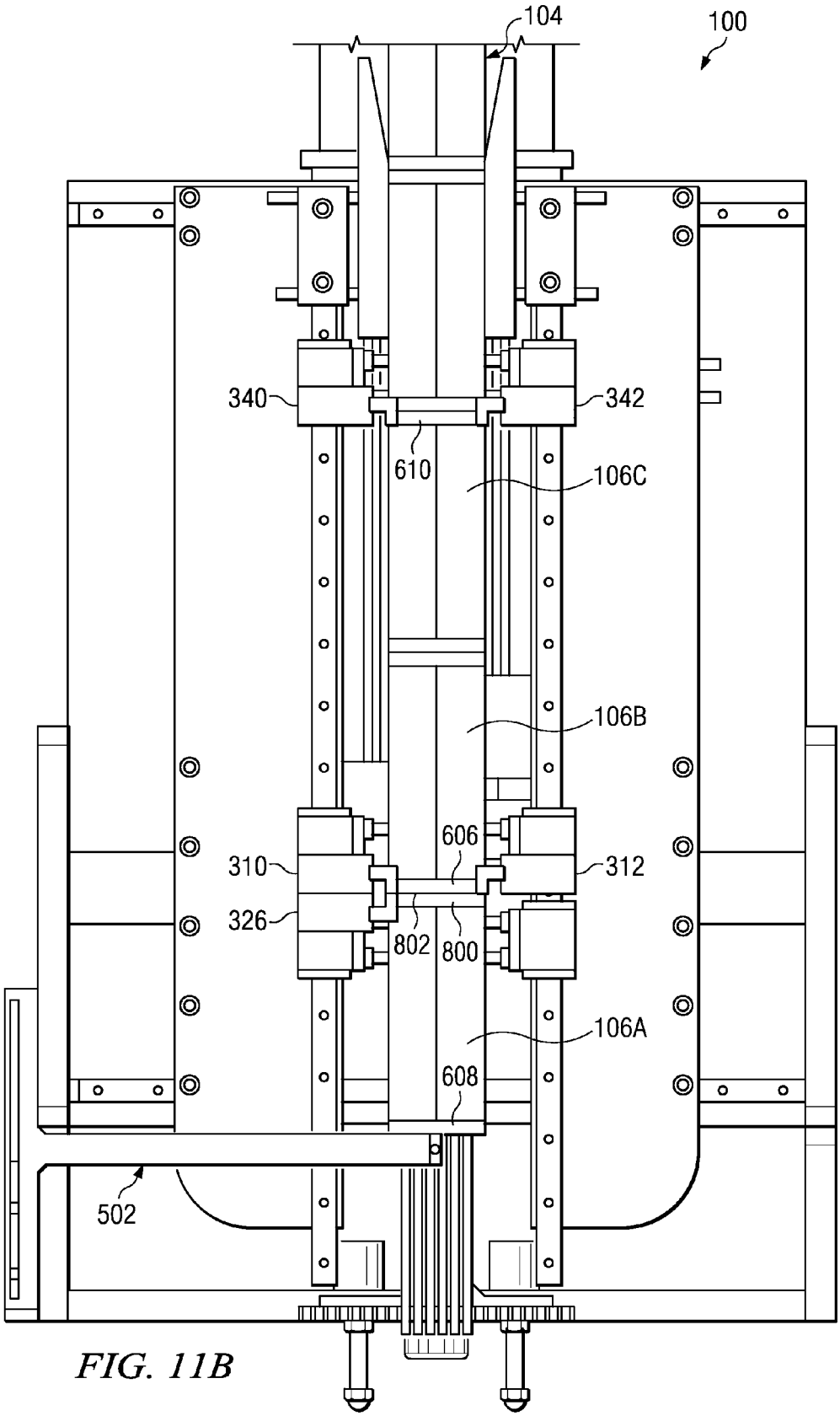
Figure 11C:
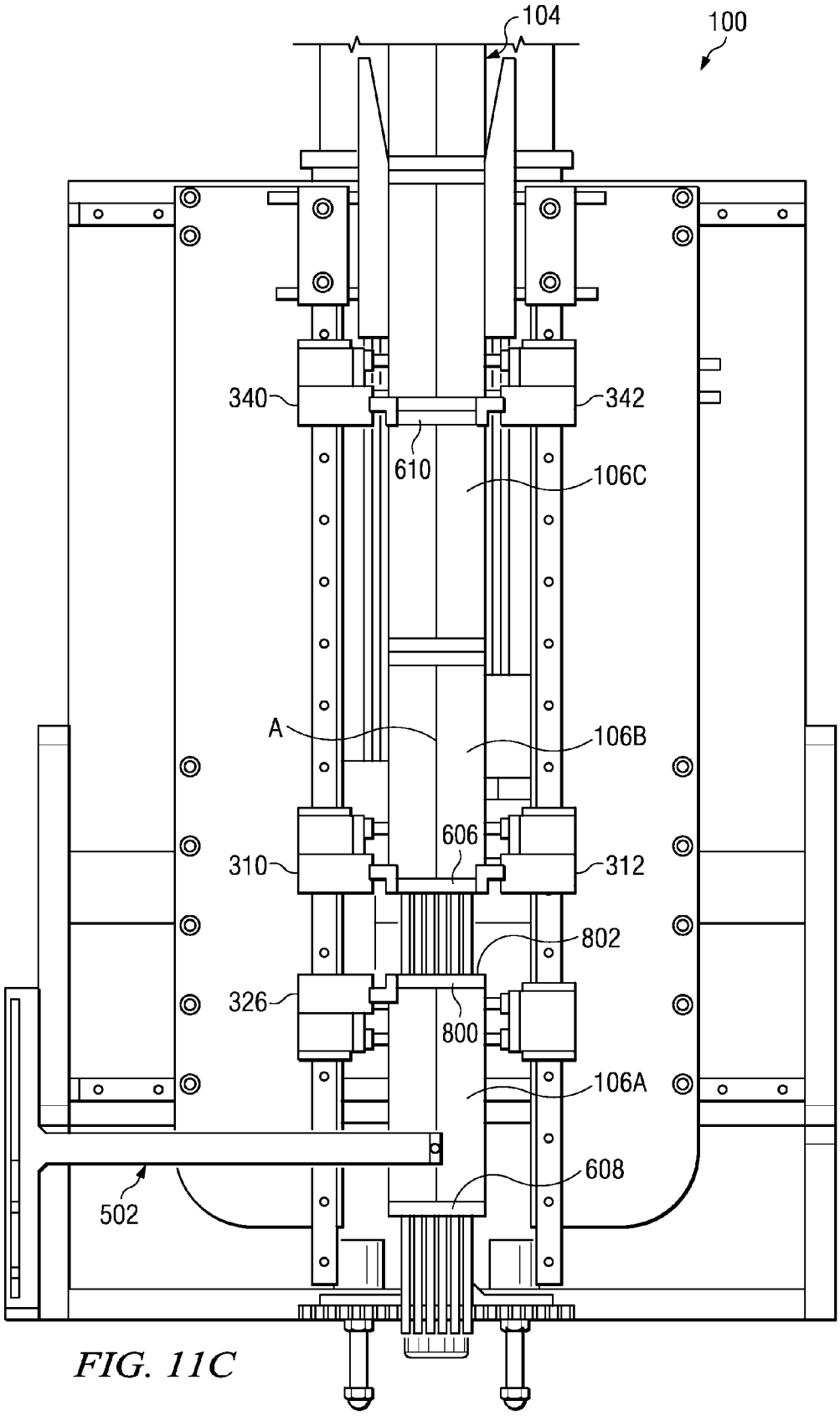

A further embodiment is illustrated in FIGS. 11A-11C, in which there are provided two upstream grippers 310 and 312, two stationary grippers 340 and 342, but only one downstream gripper 326. In the initial position shown in FIG. 11A, stationary grippers 340, 342 are clamped to the trailing seal zone 900 of package 106B. Upstream grippers 310 and 312 are clamped to the leading seal zone 606 of package 106B. The single downstream gripper 326 is clamped to the trailing seal zone 800 of package 106A to one side of axis A. A wakened separation line 802 separates zones 606 from 800, as before. FIGS. 11A-11C illustrate a "push" mode of operation.

Stationary grippers 340, 342 will disengage, while grippers 310, 312, 326 will stay engaged and will be advanced in a downstream direction by one package length, pulling the bandolier 104 with them. The result is shown in FIG. 11B. At or shortly after this instant the sensor 502 will detect the leading edge of leading seal zone 608 of the first package 106A. Stationary grippers 340, 342 will be actuated to clamp to the trailing seal zone 610 of package 106C.

Sensing the leading edge of seal zone 608 will cause grippers 310, 312 to stop advancing, while downstream gripper 326 continues to be displaced in a downstream direction. This causes the gradual tearing, from the left side, across the bandolier axis A and to the right side, of package 106A from package 106B along wakened separation line 802. After this the gripper 326 will disengage, permitting package 106A to drop. Once sensor 502 no longer detects the presence of package 106A, the grippers 310, 312 will disengage and all three movable grippers 310, 312, 326 will retract to the initial position shown in FIG. 11A.

A "push" sequence of operation which can be employed in conjunction with the embodiment shown in FIGS. 11A-11C is diagrammed in FIG. 16.

Figure 12A:
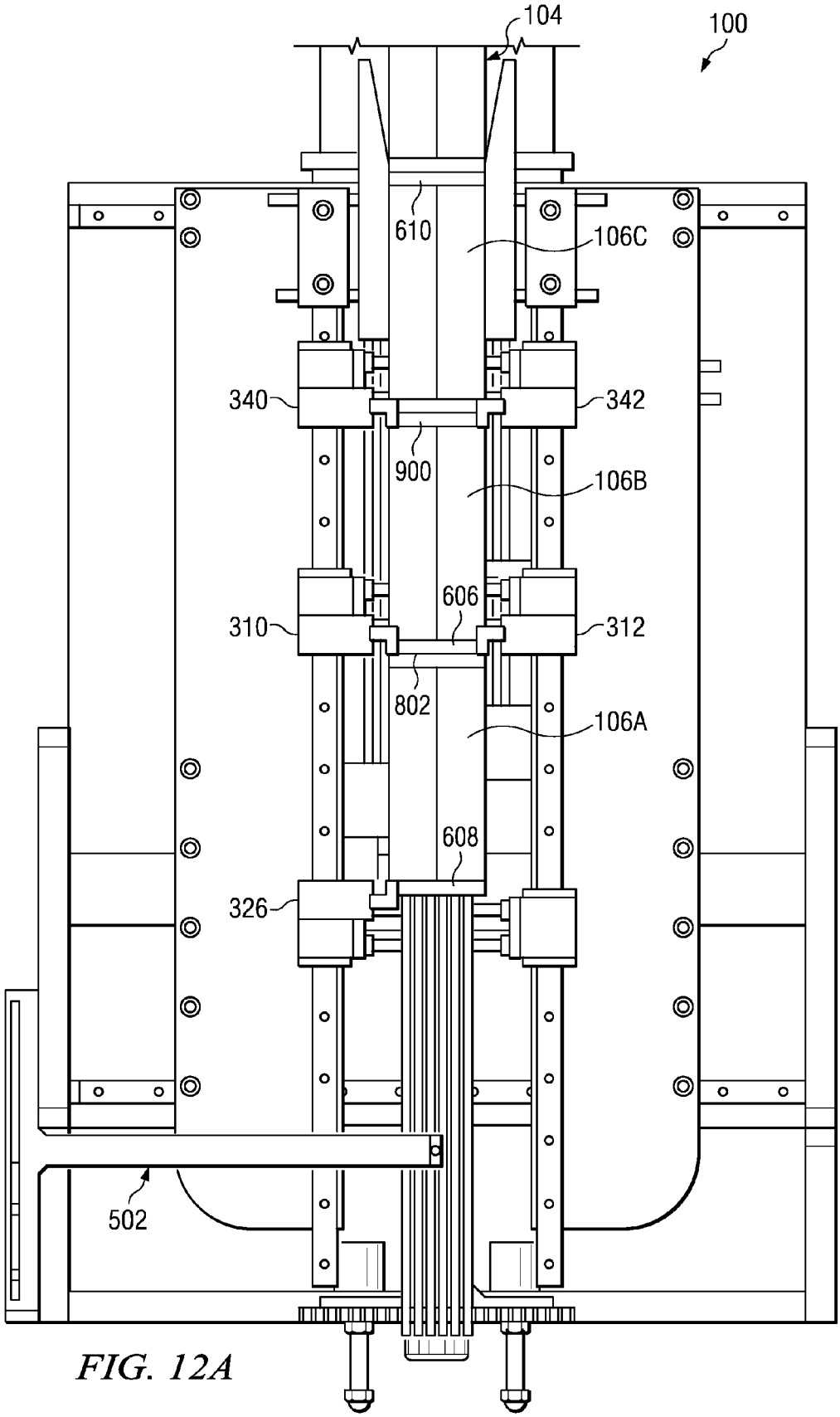
FIGS. 12A-12C are elevational views of a premium separator in which there are two upstream grippers and one downstream gripper, illustrating successive steps in a "pull" mode of operation.
Figure 12B:
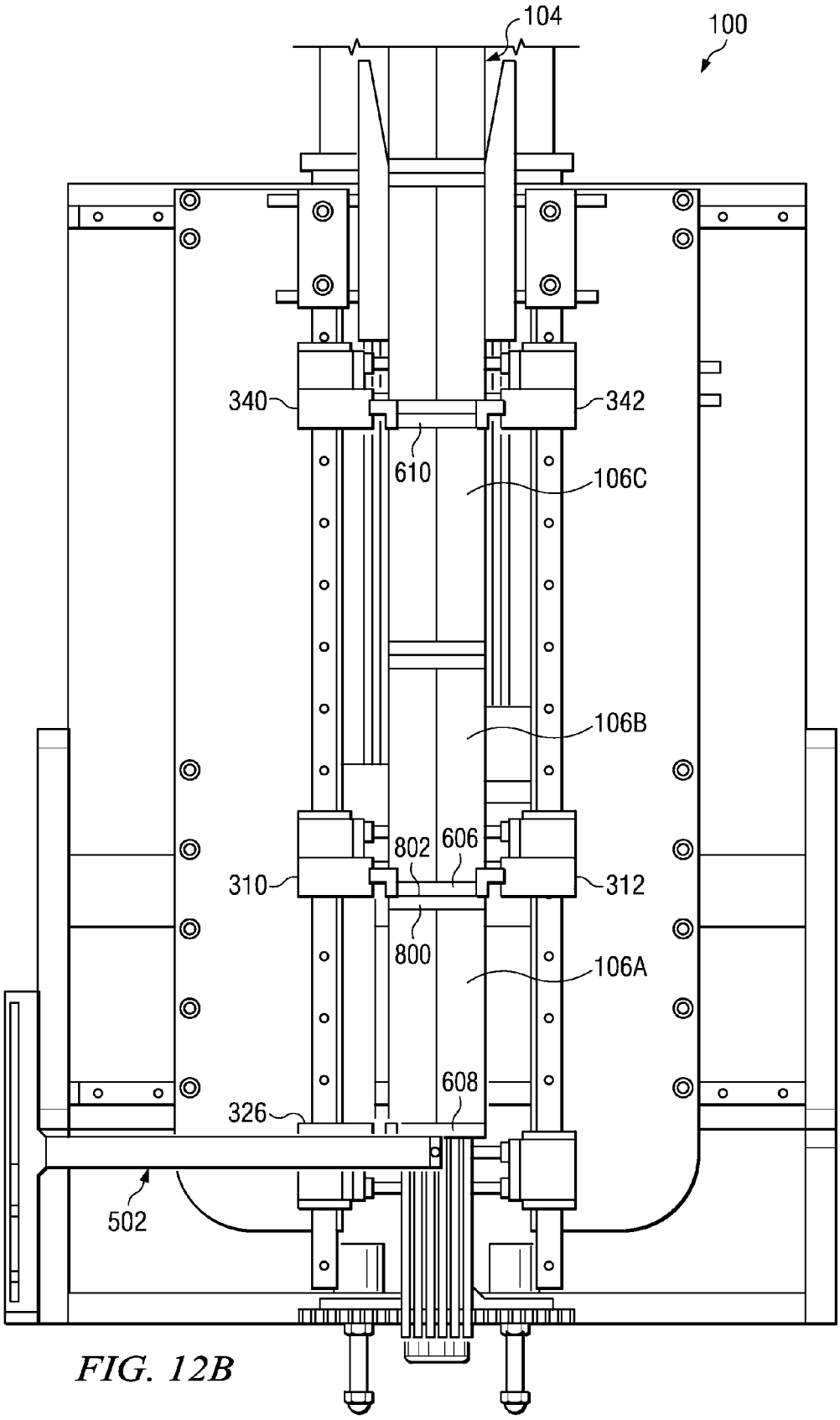
Figure 12C:
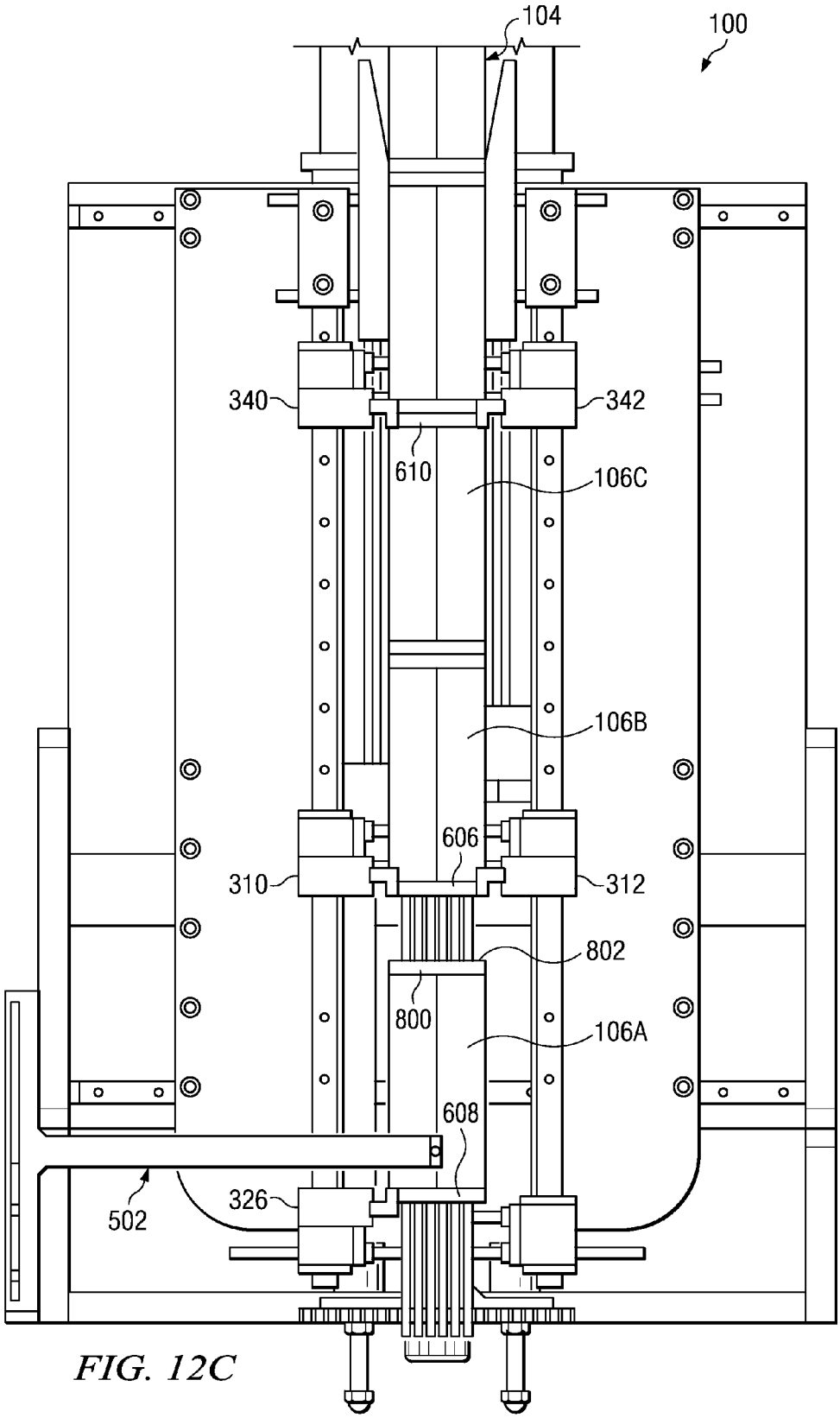

FIGS. 12A-12C show the embodiment illustrated in FIGS. 11A-11C, but this time operated in a "pull" mode. In the initial position shown in FIG. 12A, stationary grippers 340, 342 are clamped to the trailing seal zone 900 of package 106B. Upstream grippers 310 and 312 are clamped to the leading seal zone of package 106B. The sole downstream gripper 326 is clamped to the leading seal zone 608 of package 106A.

To begin a separation cycle, the stationary grippers 340, 342 will disengage and grippers 310, 312 and 326 will be pushed downstream in concert, to assume their respective positions seen in FIG. 12B. Stationary grippers 340, 342, at any time during the remainder of the cycle, can be actuated to clamp to the next trailing seal zone 610. A leading edge of the leading seal zone 608 is sensed by sensor 502. The electronic signal resulting from this detection can be used to halt the piston on which grippers 310 and 312 are mounted.

The piston on which is mounted gripper 326 does not halt, however. Its downstream displacement relative to upstream grippers 310 and 312 will cause package 106A to be torn from package 106B and the rest of bandolier 104, along wakened separation line 802, and from left to right as seen in FIG. 12C. Upon being displaced downstream by an amount selected to assure a complete separation, the gripper 326 will release the package 106A. When the sensor 502 detects that the package is no longer in its line of sight, the electronic signal generated thereby can be used by the processor to cause grippers 310, 312 to disengage, and grippers 310, 312 and 326 to retract to their initial positions seen in FIG. 12A.

A "pull" sequence of operation which can be employed in conjunction with the embodiment shown in FIGS. 12A-12C is diagrammed in FIG. 14.

Figure 13:
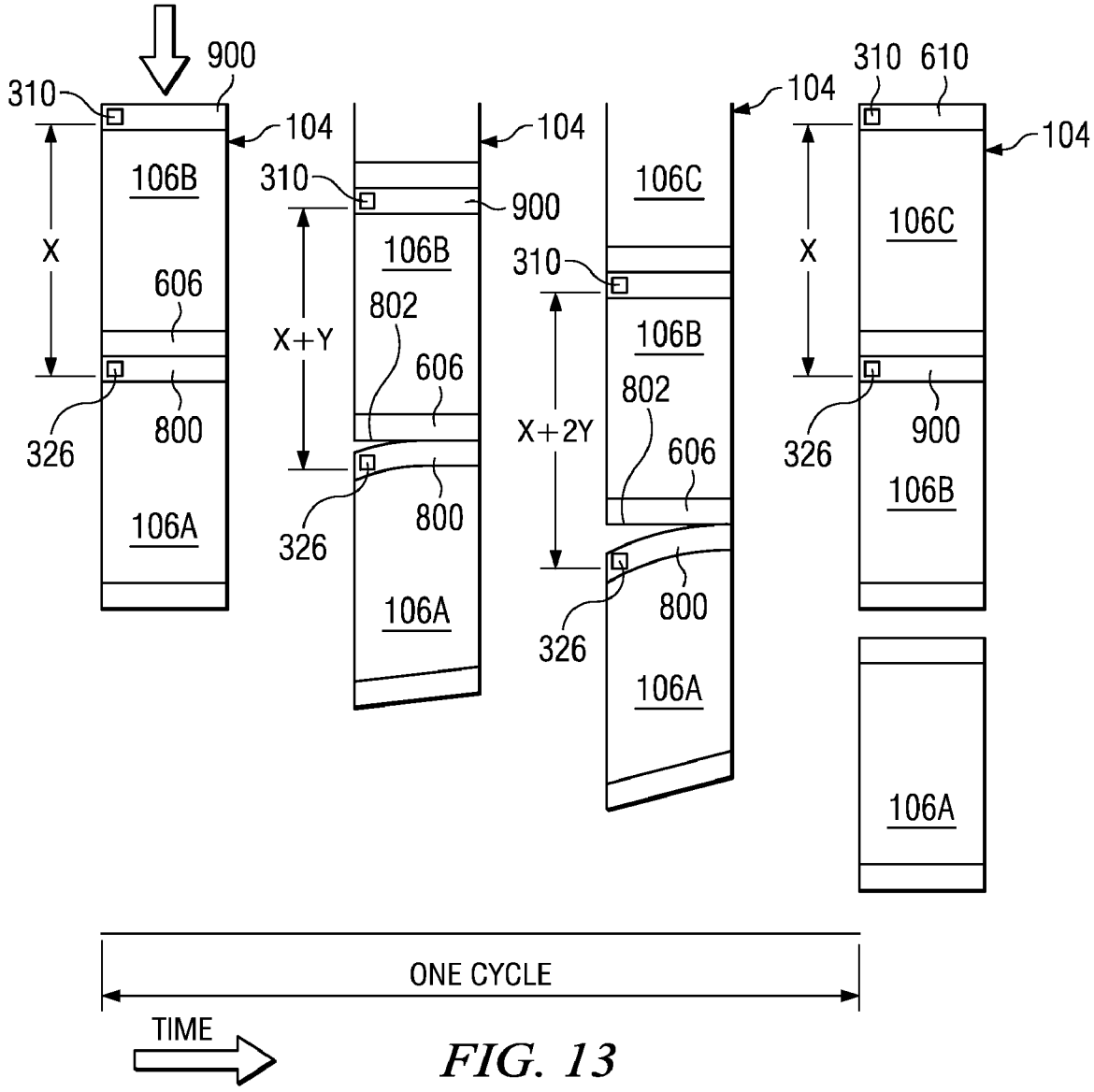
FIG. 13 is a schematic diagram showing successive steps of a one-sided premium separator in an "on the fly" mode of operation.

FIG. 13 is a schematic illustration of a single-side "on the fly" mode of operation. In the beginning of a cycle in this mode, an upstream gripper lands on and clamps to a trailing seal zone 900 of a package 106B. At about the same time, a downstream gripper 326 lands on and clamps to a trailing seal zone 800 of package 106A. In this initial clamping or "landing" phase, the bandolier 104 can be advanced downstream by means other than the grippers, and the grippers' downstream speed is initially set to be the same as the speed of bandolier 104. An initial displacement X between grippers 310 and 326 is set to be the same as the length of the packages 106.

After grippers 310, 326 are clamped in place, the grippers are moved downstream at different speeds. FIG. 13 includes four schematic snapshots of bandolier 104 at even intervals from each other. In the second snapshot, gripper 310 has advanced downstream by a certain amount, but gripper 326 has advanced by an additional amount Y, such that the displacement between grippers 310 and 326 is X+Y. The causes the bandolier to start tearing at the wakened separation line 802 between gripper 326 and 310. The displacement X+Y won't be enough to completely tear off package 106A, but the tearing will have started. Where, as here, the packages 106 have a substantial width, a gradual tearing is desirable, as the tensioning force is localized to the point of separation. The films or packaging layers to be torn tend to be flexible. For any particular increase in displacement between grippers 310 and 326, the amount of tensioning force across line 802 produced by that displacement lessens as a function of distance from the side on which the grippers 310, 326 are placed. The separation line 802 therefore tears a little bit at a time. Less tensioning force is needed to perform a gradual tearing operation than to burst one package from the rest of the bandolier 104 all at once, and this reduced force will produce less shock to the possibly fragile contents of the packages.

In the third snapshot, the displacement between the grippers 310, 326 has grown to X+2Y. This produces more tearing. In the fourth snapshot, the displacement between the grippers 310, 326 has increased to X+3Y, and this amount is sufficient to complete the tear and completely separate package 106A from the rest of bandolier 104.

The "on the fly" mode of operation can also be used with two upstream grippers, or two upstream and two downstream grippers. Further, while FIG. 13 shows operation in a "pull" mode, in which successive trailing seal zones are clamped, this can also be done in a "push" mode, wherein one of the tensioning grippers clamps to a leading seal zone, and another of the tensioning grippers clamps to a trailing seal zone adjacent to the last said leading seal zone, and separated therefrom by a wakened separation line.

Figure 17:
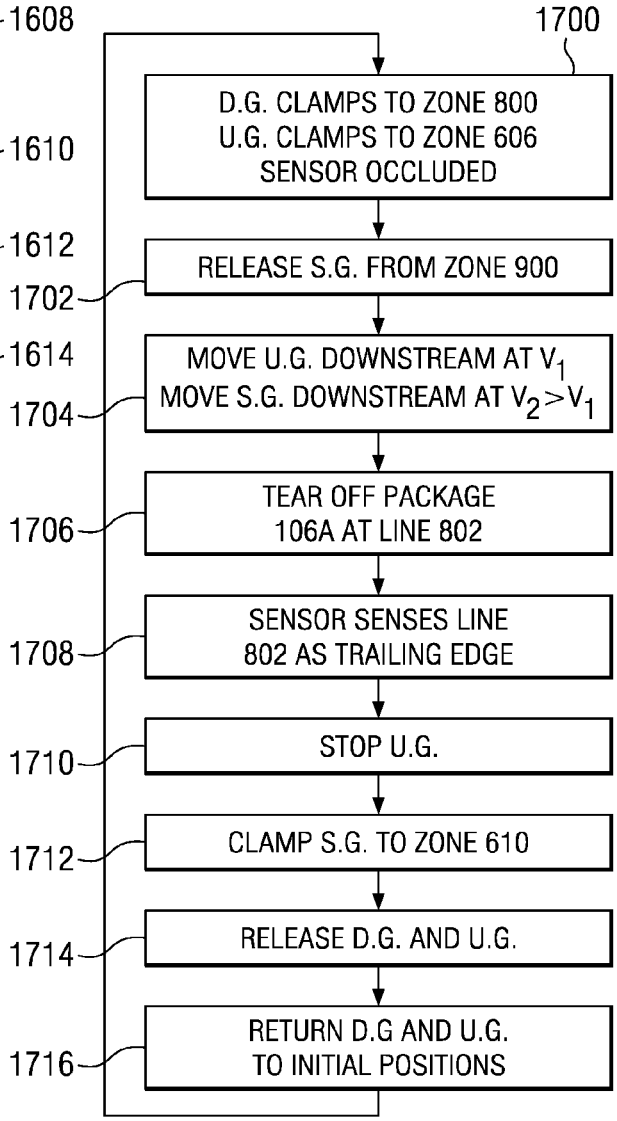
FIG. 17 is a flow diagram illustrating an "on the fly" mode of operation.

FIG. 17 is a schematic block diagram showing a slightly different "on the fly" mode of operation, in which the bandolier is propelled downstream by the grippers. Like the mode illustrated in FIG. 13, it is preferred to employ only one side of grippers in this mode. At beginning step 1700, the downstream gripper clamps to trailing seal zone 800 of leading premium package 106A, and the upstream gripper clamps to leading seal zone 606 of the next premium package 106B. This "on the fly" mode is additionally, a "push" mode in that only a separation line 802 separates the grippers between which tension will be applied.

Once the downstream and upstream grippers are engaged, at step 1702 a stationary gripper may be released from trailing seal zone 900 of premium package 106B. At step 1704, the upstream and downstream grippers are moved downstream, with the downstream gripper being moved at a faster rate than the upstream gripper. This advances the entire bandolier 104, while (step 1706) eventually tearing off the lead package 106A from it. At step 1708, the sensor 502 will sense separation line 802 as the trailing edge of now-separated package 106A. The upstream gripper is then stopped at step 1710. At 1712 the stationary gripper is reactuated to clamp to the trailing seal zone 610 of the premium package 106C. Once the stationary gripper has clamped, the downstream and upstream grippers can be released at step 1714, and they can be returned to their initial positions at step 1716.

The premium separator 100 according to the invention can be integrated into a packaging assembly line in a variety of ways. Two of these are shown in FIGS. 18 and 19. In FIG. 18, the premium separator 100 drops a separated package into a space 1800 on a belt 1802, one side of the space 1800 being defined by a movable partition 1804. As the belt 1802 advances, the partition 1804 pushes the premium into a pre-aligned horizontally disposed box 1806.

In FIG. 19, the separator 100 is positioned vertically, and simply vertically drops separated packages into respective vertically disposed boxes 1900.

FIGS. 20A-20K illustrate a further embodiment of the invention in which each of four grippers 2002, 2004, 2006 and 2008 are independently movable and controllable. A left upstream or transfer gripper 2002 is slidable upstream and downstream on a track 2012 that is parallel to the axis A of advance of a bandolier 2014 of packaged premiums. The left transfer gripper 2002 is affixed to a displacing cylinder 2016 that is displaced by a motor 2018. A right upstream or transfer gripper 2004 is slidable upstream and downstream on a track 2020 that is parallel to axis A. The right transfer gripper 2004 is displaceable by a displacement cylinder 2022 that is in turn displaced by a motor 2024. A left downstream or tear gripper 2006 is slidable up and down track 2012 but is affixed to a separate rod or cylinder 2026. The cylinder 2026 is reciprocally displaceable by a motor or actuator 2028. A right downstream or tear gripper 2008 is slidable up and down track 2020 in a direction parallel to axis A and is affixed to rod or cylinder 2030. The cylinder 2030 is reciprocally displaceable by a motor or actuator 2032.

A leading edge sensor 2010, which is similar in its operation to the sensor 502 of the embodiment shown in FIGS. 1-19, is disposed over and under the plane along which bandolier 2014 travels. The sensor 2010 can sense the presence or absence of a packaged premium by detecting whether its light path through the plane is occluded. In the operation of this embodiment, the sensor 2010 is disposed over a predetermined location on the bandolier path at which a hand-off of the bandolier occurs between an upstream gripper and at least one downstream gripper.

Figure 22:
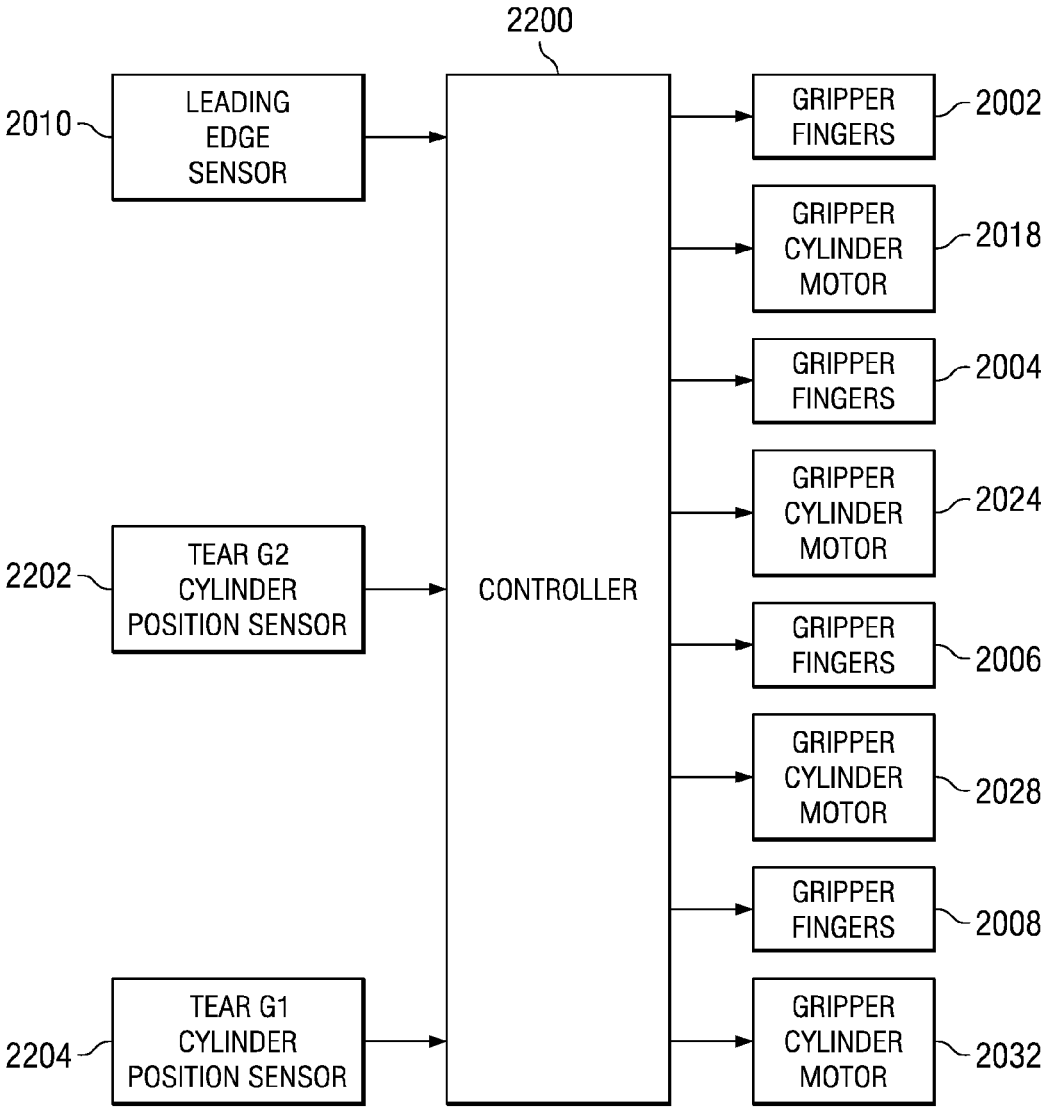
FIG. 22 is a schematic control diagram showing signal and control paths for the embodiment shown in FIGS. 20A-20K.

A schematic electronic diagram of this embodiment is shown in FIG. 22. Therein, a processor or controller 2200, typically a general-purpose controller of the kind which has been programmed with software instructions, receives at least signals from the leading edge or product sensor 2010, a cylinder position sensor 2202 and a cylinder position sensor 2204. Cylinder position sensor 2202 senses the position of left tear gripper cylinder 2026. Cylinder position sensor 2204 senses the position of the right tear gripper cylinder 2030.

Based on signals received from these sensors and a clock signal, the controller 2200 controls the operation of the left transfer gripper motor 2018, the right transfer gripper motor 2024, the left tear gripper motor 2028, and the right tear gripper motor 2032. The controller also controls whether the fingers or claws on the grippers 2002-2008 are open (not gripping a package) or closed (gripping a package).

Figure 20A:
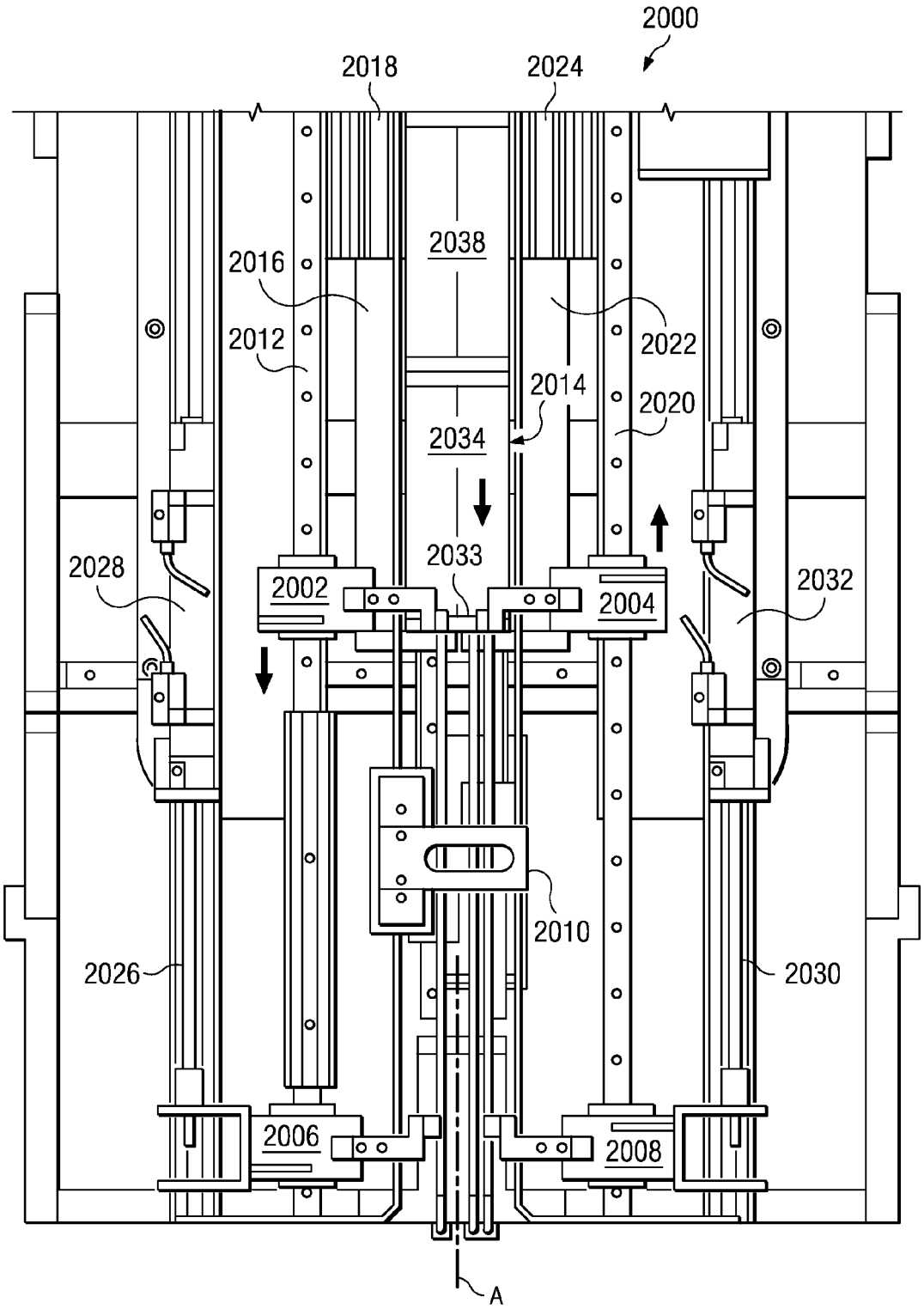
FIGS. 20A-20K are elevational views of a further premium separator according to the invention, showing independent articulation of four grippers.
Figure 20B:
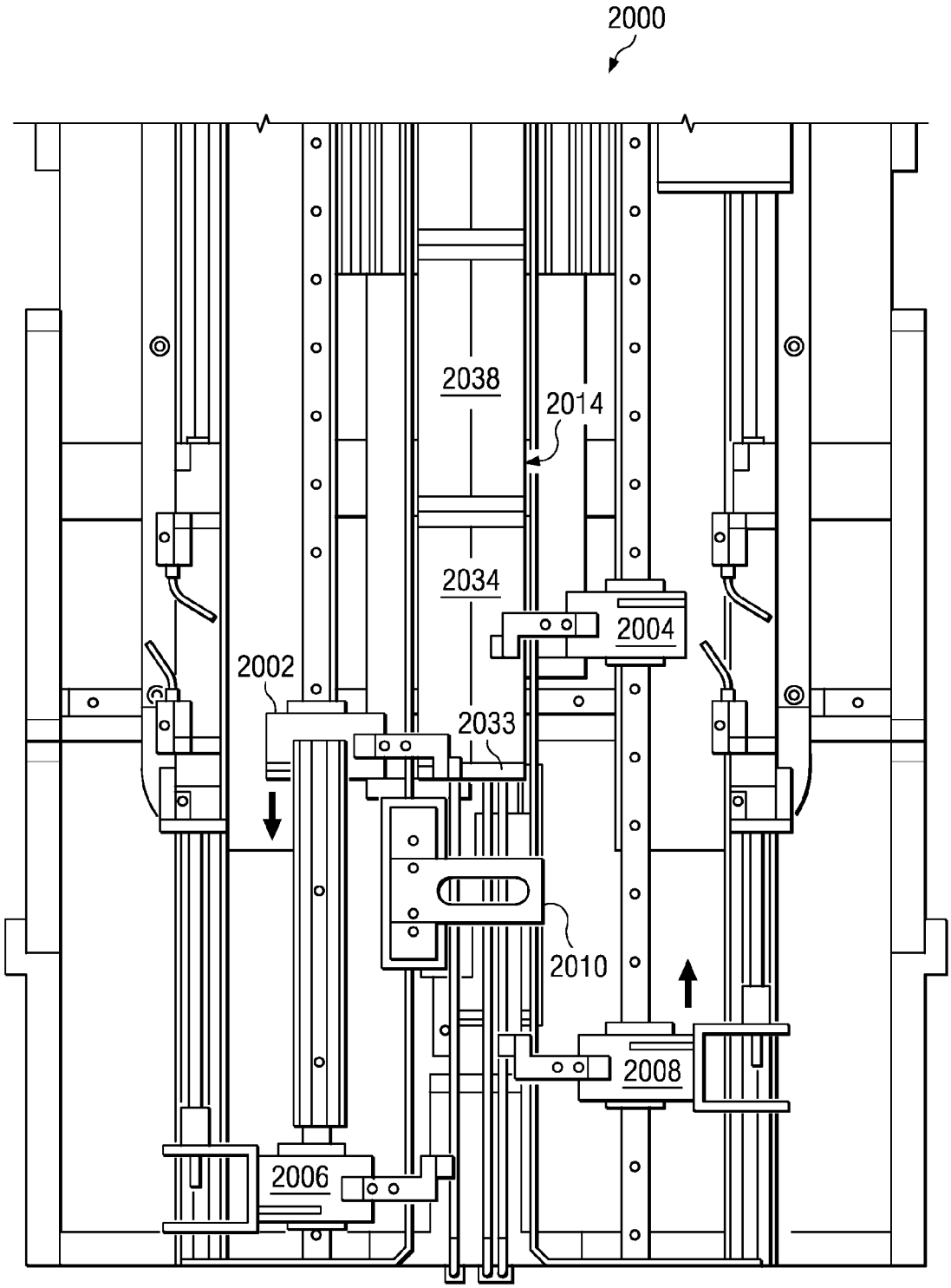
Figure 20C:
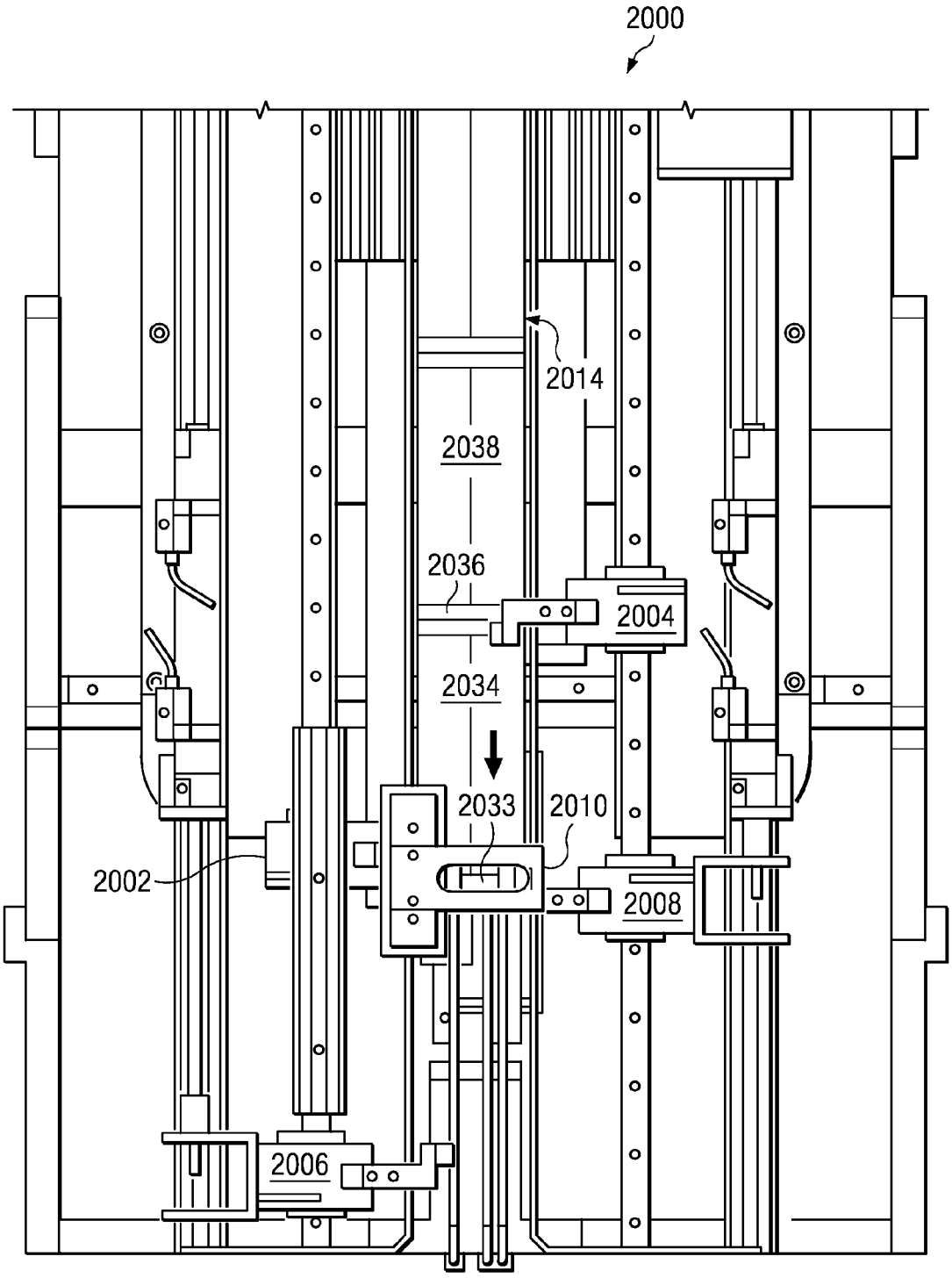
Figure 20D:
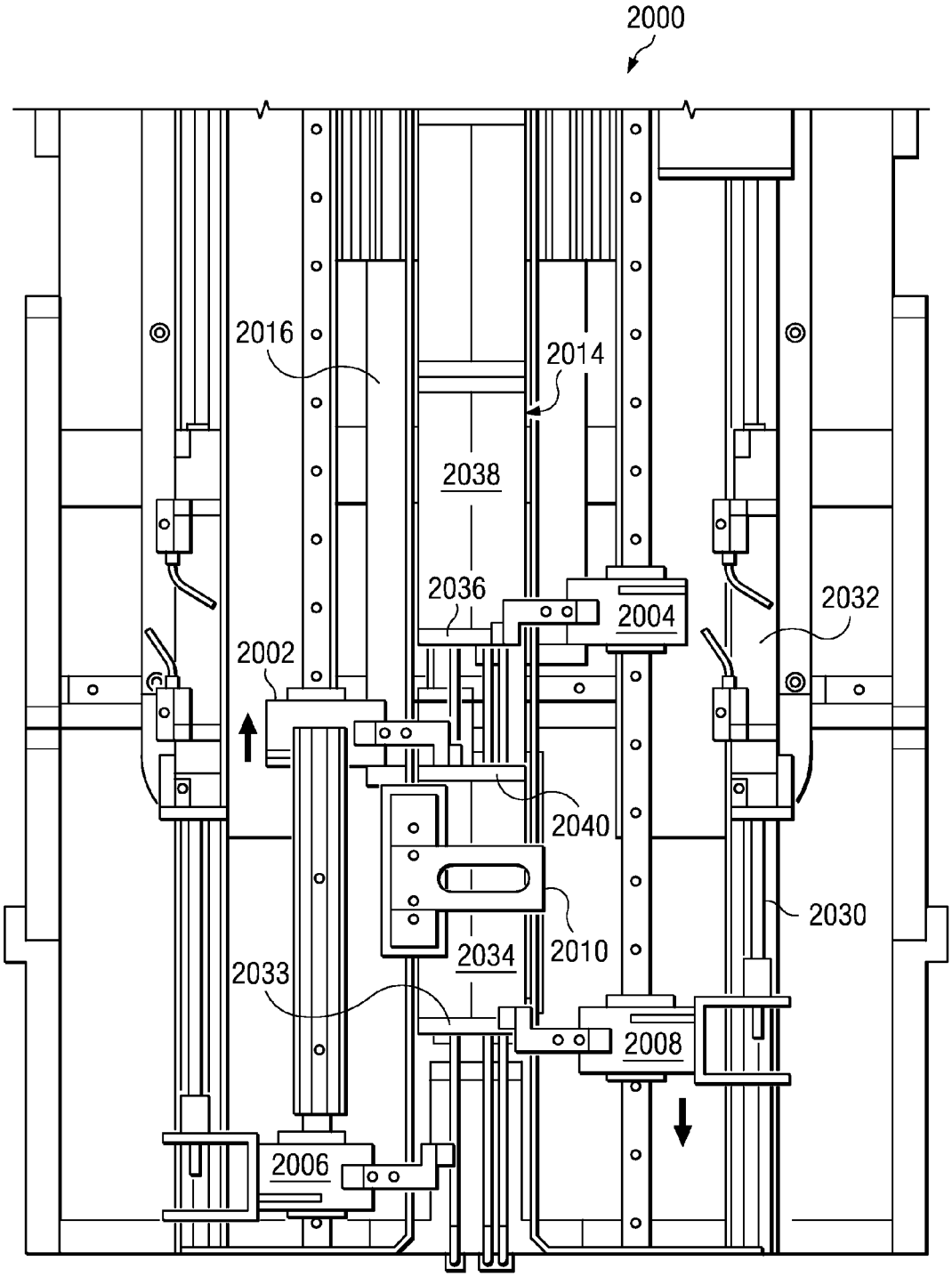
Figure 20E:
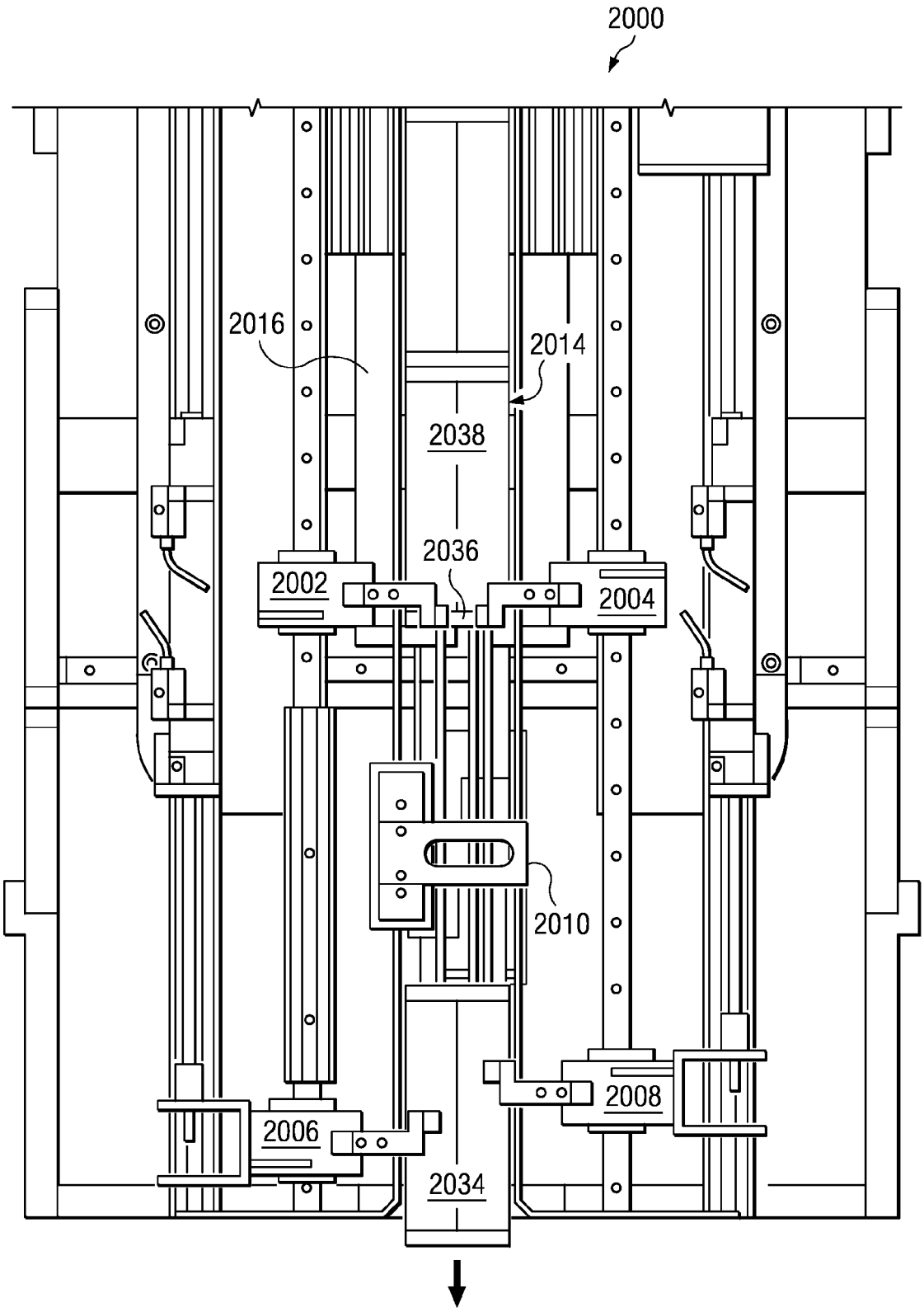
Figure 20F:
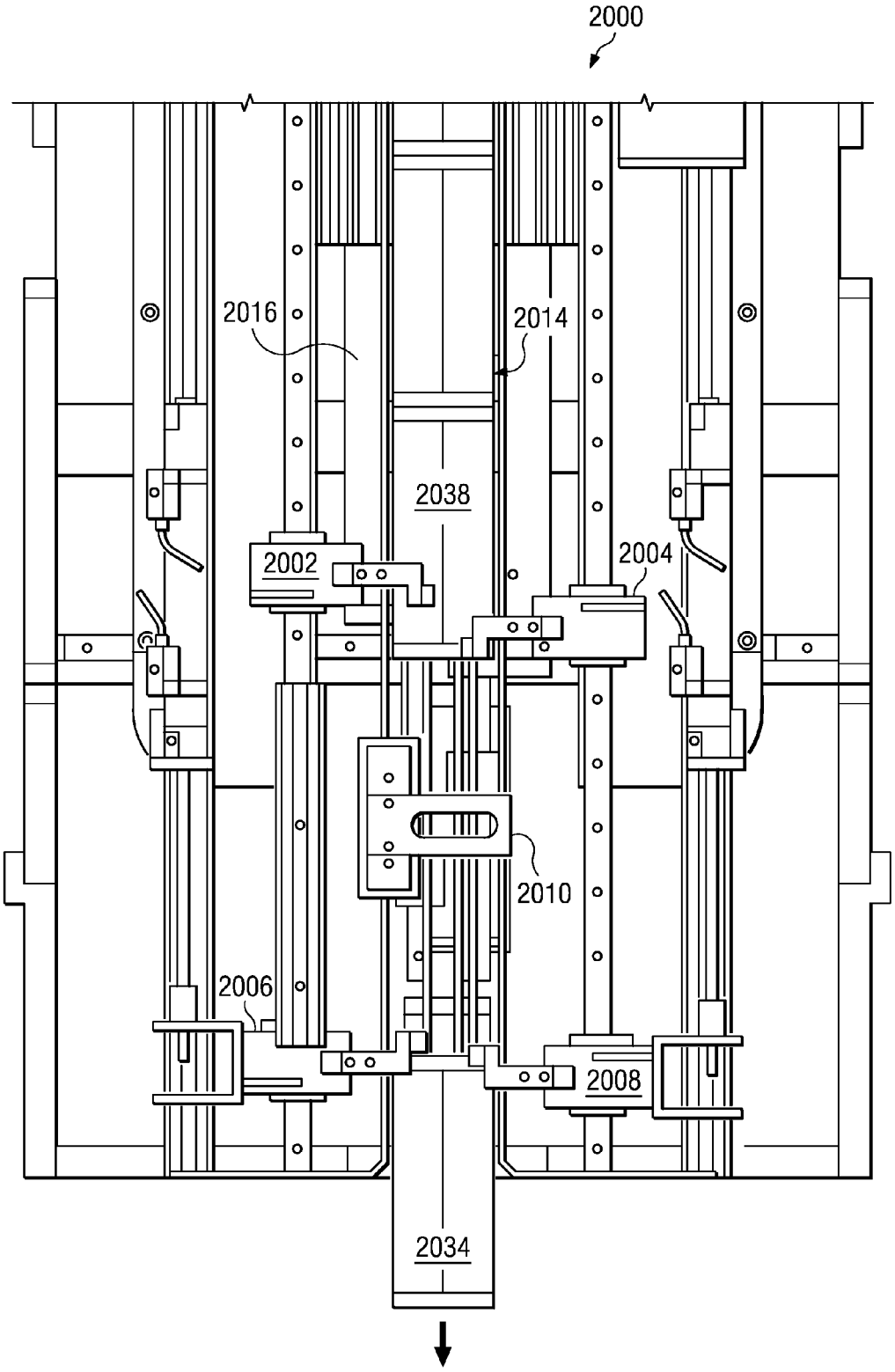
Figure 20G:
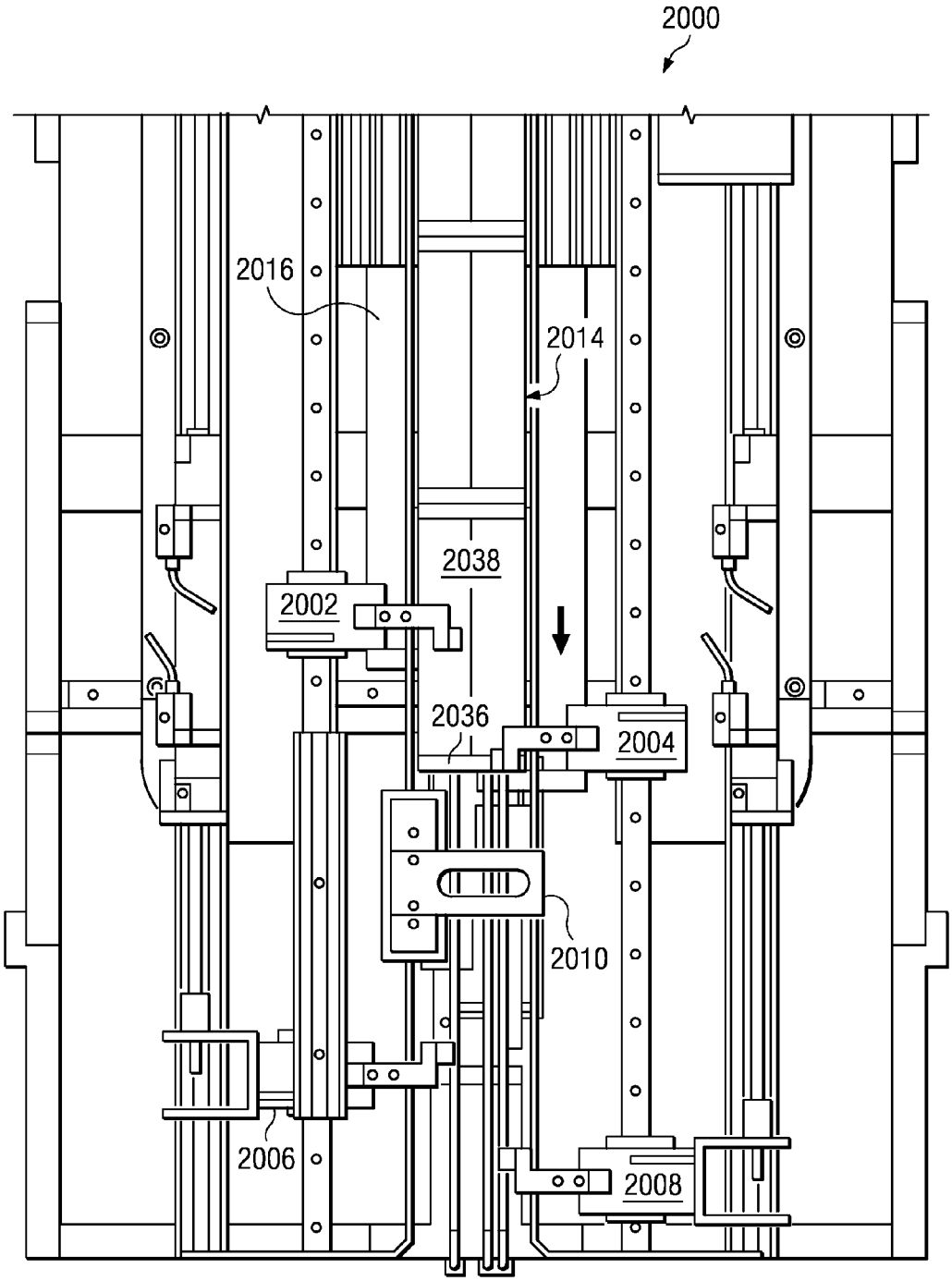
Figure 20H:
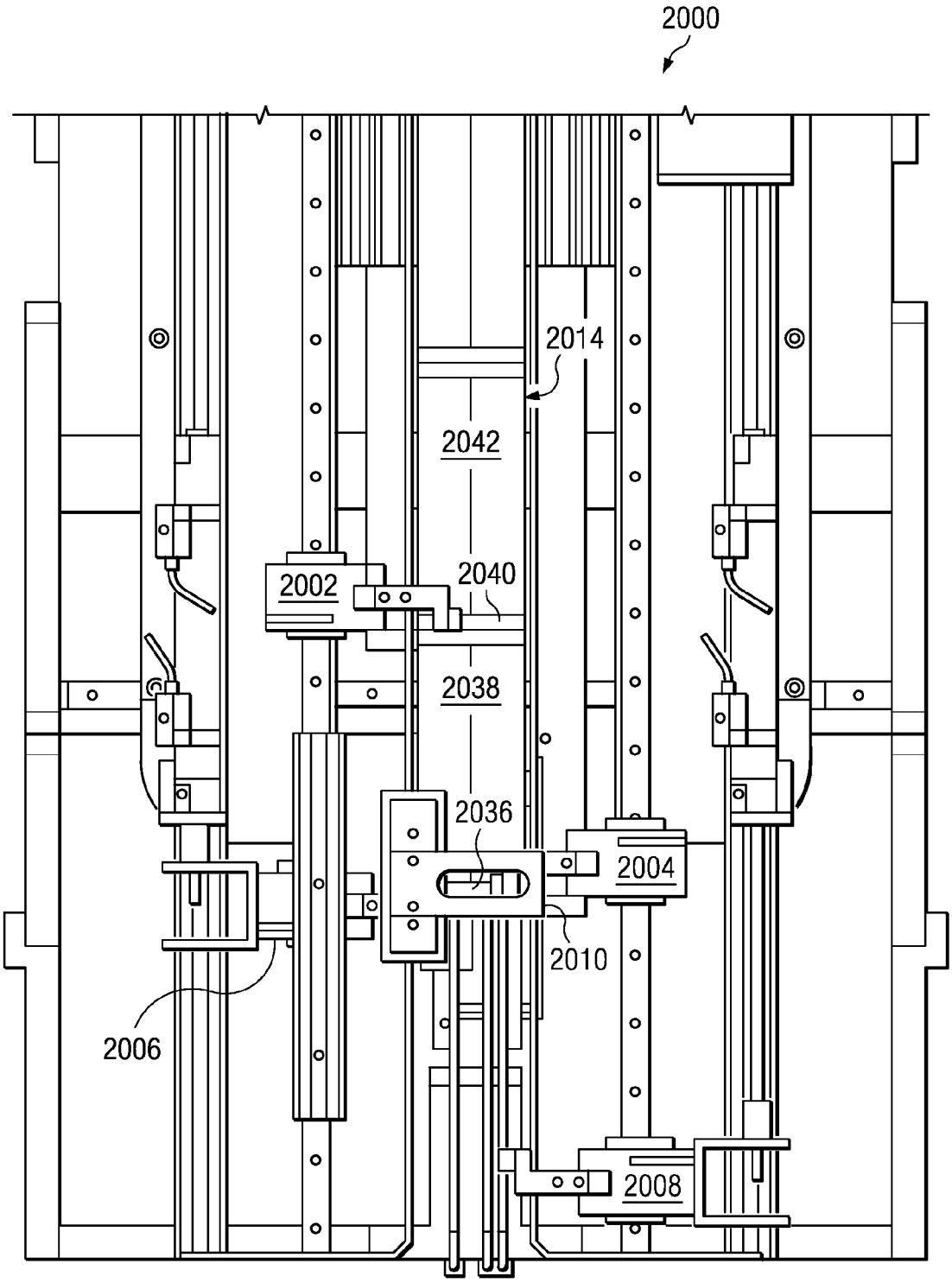
Figure 20I:
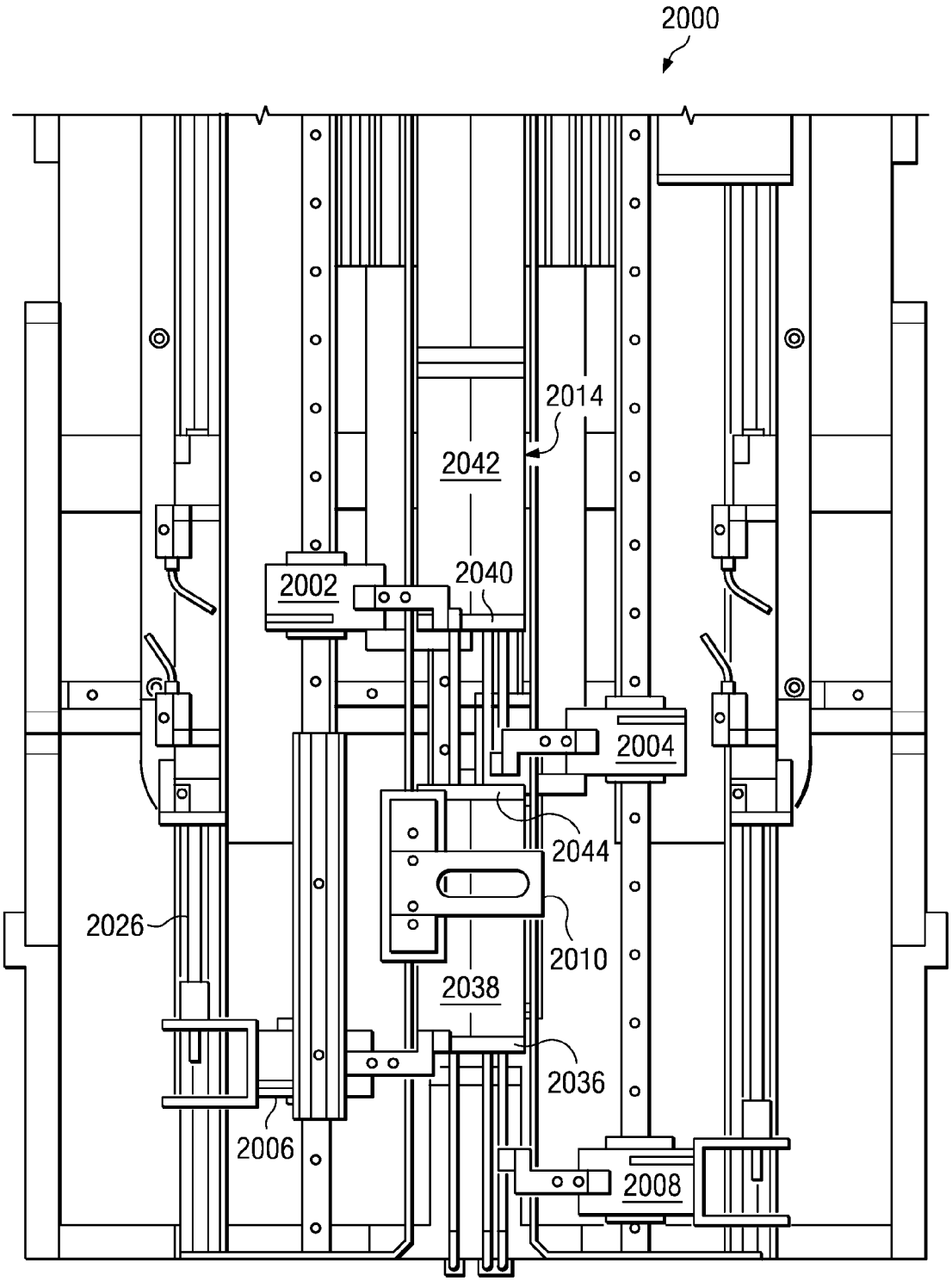
Figure 20J:
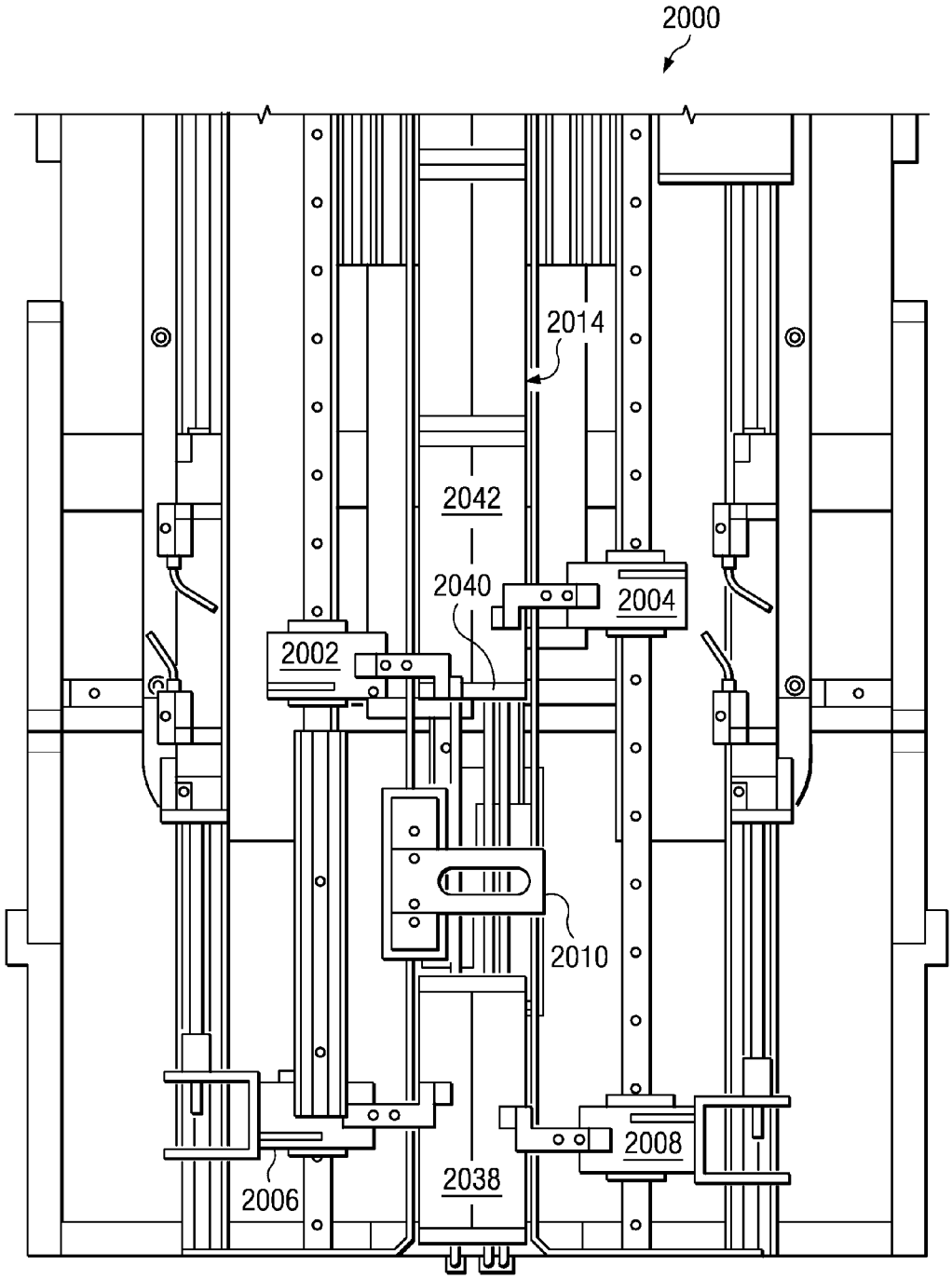
Figure 20K:
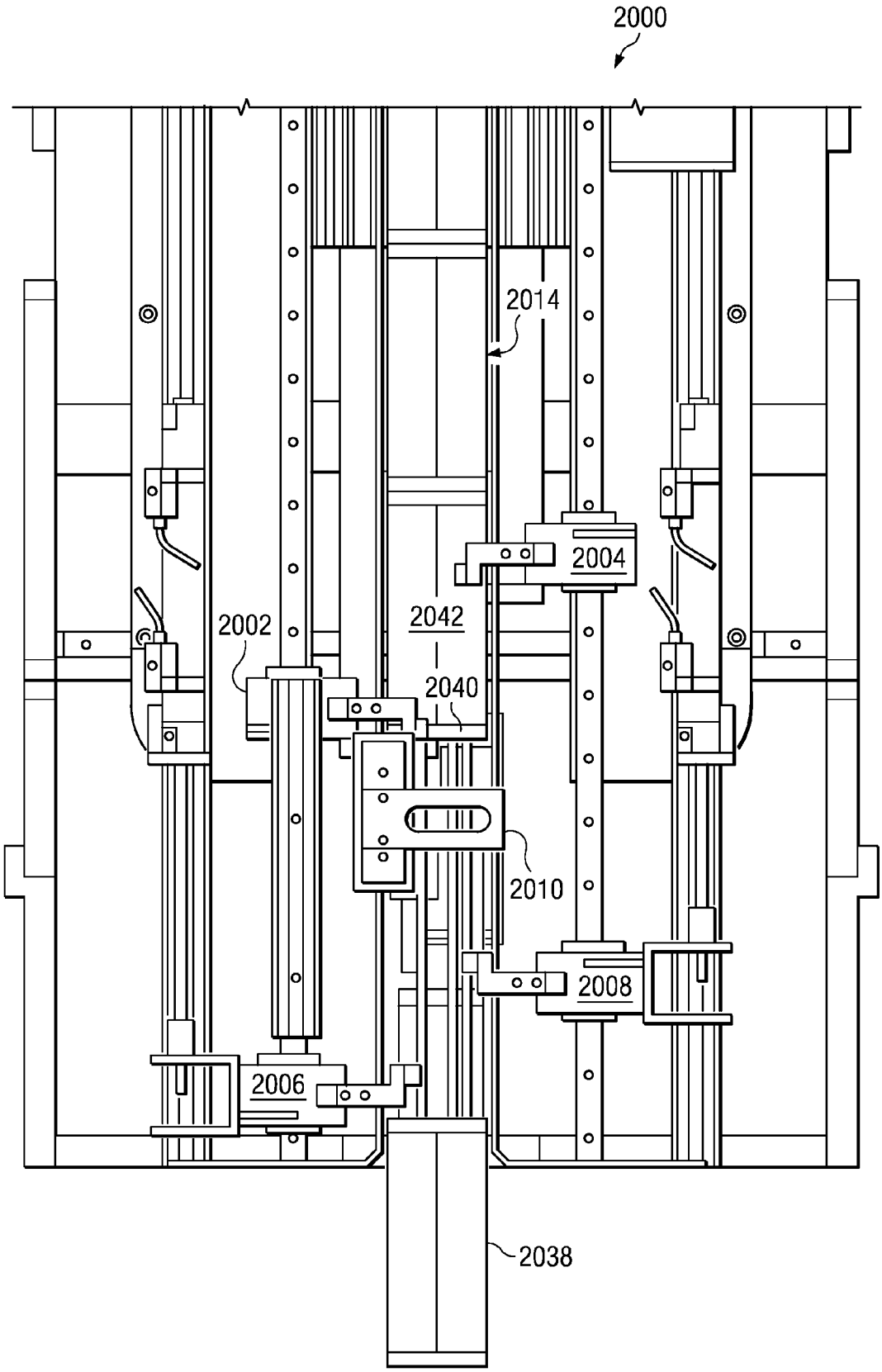
Figure 21:
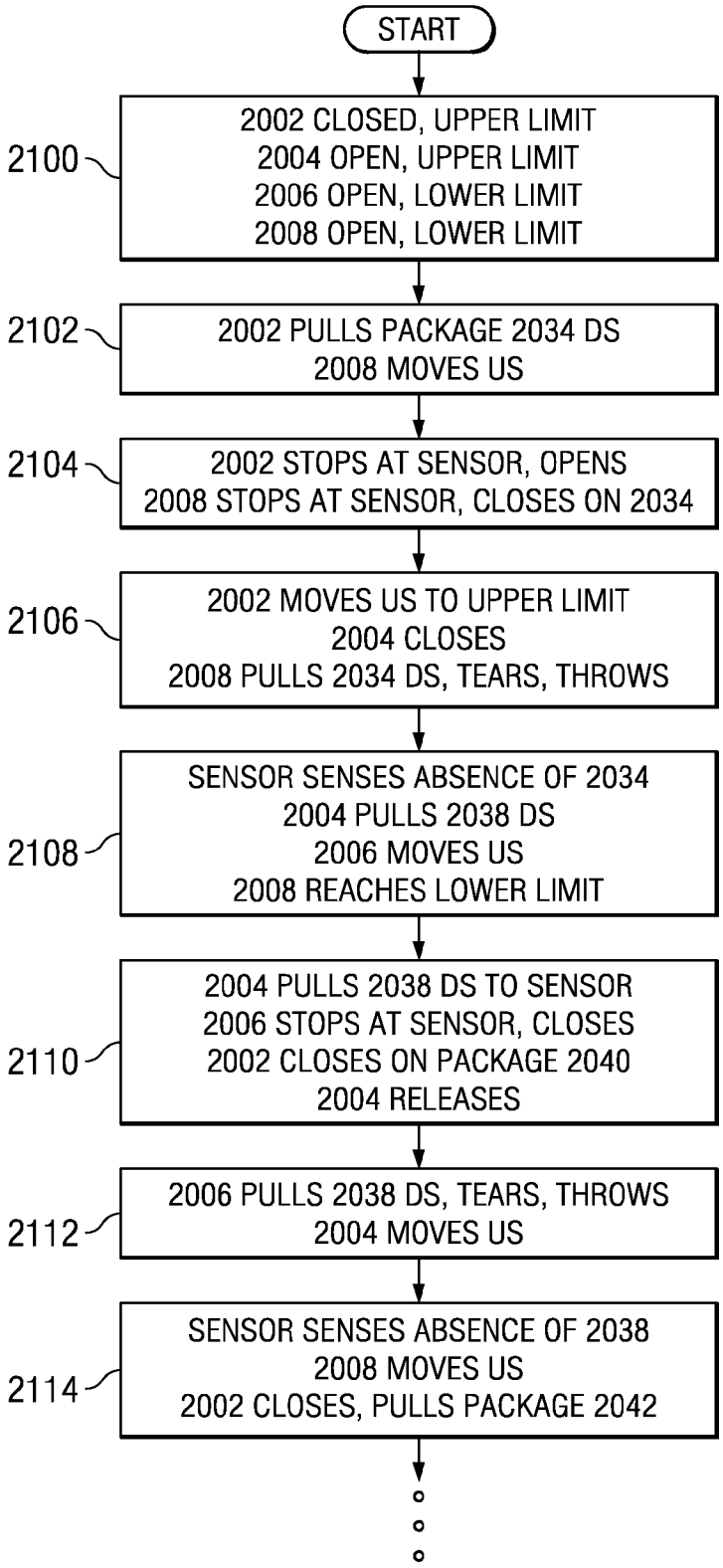
FIG. 21 is a flow diagram illustrating the operation of the embodiment shown in FIGS. 20A-20K.

FIG. 21 is a flow diagram showing the operation of the embodiment shown in FIGS. 20A-20K according to a double-transfer, double-throw ("DSDM") method. FIG. 20A shows the configuration of the separator 2000 as of step 2100 in FIG. 21. At the beginning of a cycle, left transfer gripper 2002 and right transfer gripper 2004 are at the upper limits of their respective cylinder strokes. Left tear gripper 2006 and right tear gripper 2008 are at the lower limits of their respective cylinder strokes. Gripper 2002 is closed on a downstream seal zone 2033 of a first premium package 2034 in the bandolier 2014. Grippers 2004, 2006 and 2008 are open.

At step 2102, shown in FIG. 20B, the left upstream gripper 2002 begins pulling package 2034 downstream. Meanwhile, right downstream gripper 2008 begins moving upstream. At step 2104, illustrated in FIG. 20C, gripper 2002 advances further downstream until it reaches the level of leading edge sensor 2010. Right downstream gripper 2008 has advanced upstream until it also is at the level of leading edge sensor 2010. Gripper 2008 is commanded to close on the leading seal zone 2033 of the package 2034. Gripper 2002 releases its grip from this zone. This effectively hands off the bandolier 2014 from gripper 2002 to gripper 2008.

At step 2106, illustrated in FIG. 20D, Right upstream or transfer gripper 2004 closes on the leading seal zone 2036 of a second premium package 2038. But right downstream or tear gripper 2008 keeps moving. This causes package 2034 to be torn, right to left, along the wakened separation line separating the leading seal zone 2036 of second package 2038 from the trailing seal zone 2040 of the first package 2034. During this period, left upstream or transfer gripper 2002 is moving upstream toward the upper limit of the stroke of cylinder 2016. After tearing off premium package 2034, gripper 2008 continues to advance downstream. The fingers of gripper 2008 and the cylinder motor 2032 are so controlled that while cylinder 2030 continues to be displaced in a downstream direction, the fingers of gripper 2008 open. This effectively "throws" the package 2034 in a downstream direction at a velocity which is initially the same as the velocity of the downstream displacement of cylinder 2030.

In FIG. 20E, the package 2034 is seen continuing on its downstream trajectory but right downstream gripper 2008 is no longer moving with it. As shown at step 2108 in FIG. 21, the sensor 2010 no longer senses the presence of a package in its light beam. This change can be used by controller 2200 to start left downstream gripper 2006 upstream and for right upstream gripper 204 to start pulling bandolier 2014 in a downstream direction. Right downstream gripper 2008 reaches the lower limit of its travel as seen in FIG. 20F. FIG. 20G is a snapshot of the operation of this embodiment, taken slightly later.

At step 2110, corresponding to FIG. 20H, the right upstream or transfer gripper 2004 has advanced downstream, pulling bandolier 2014 with it, to sensor 2010. Sensor 2010 now senses the presence of second premium package 2038. Left downstream gripper 2006 completes its travel upstream until it is on the same level as right upstream gripper 2004. Gripper 2006 closes on leading seal zone 2036 of package 2038 and gripper 2004 lets go slightly later. Gripper 2002 clamps to a leading seal zone 2040 of a third premium package 2042.

At step 2112, corresponding to FIG. 20I, the left downstream or tear gripper 2006 continues to pull package 2038, separating package 2038 from package 2042 at the wakened separation line between trailing seal zone 2044 of second package 2038 and leading seal zone 2040 of package 2042. The separation line will gradually tear, left to right. After separation, downstream left gripper 2006 continues to advance downstream until a sensor (not shown) senses that cylinder 2026 has reached a certain position. A signal back from this sensor is the controller 2200's cue to open gripper 2006, "throwing" the package 2038 in a downstream trajectory. Gripper 2006 will stop (FIG. 20J) at the bottom of the stroke of its cylinder 2026.

At step 2114, the sensor 2010 senses that second package 2038 is no longer there. This will cause gripper 2008 (FIG. 20K) to move upstream. Gripper 2002 is commanded to start pulling down third package 2042 and the process repeats back to FIG. 20C.

This embodiment thus shows a separation method in which one downstream gripper tears off and throws a premium package, alternating with the operation of the other downstream gripper that tears off and throws the next premium package. The ability to throw rather than simply drop a separated package confers a further technical advantage.

Figure 23A:
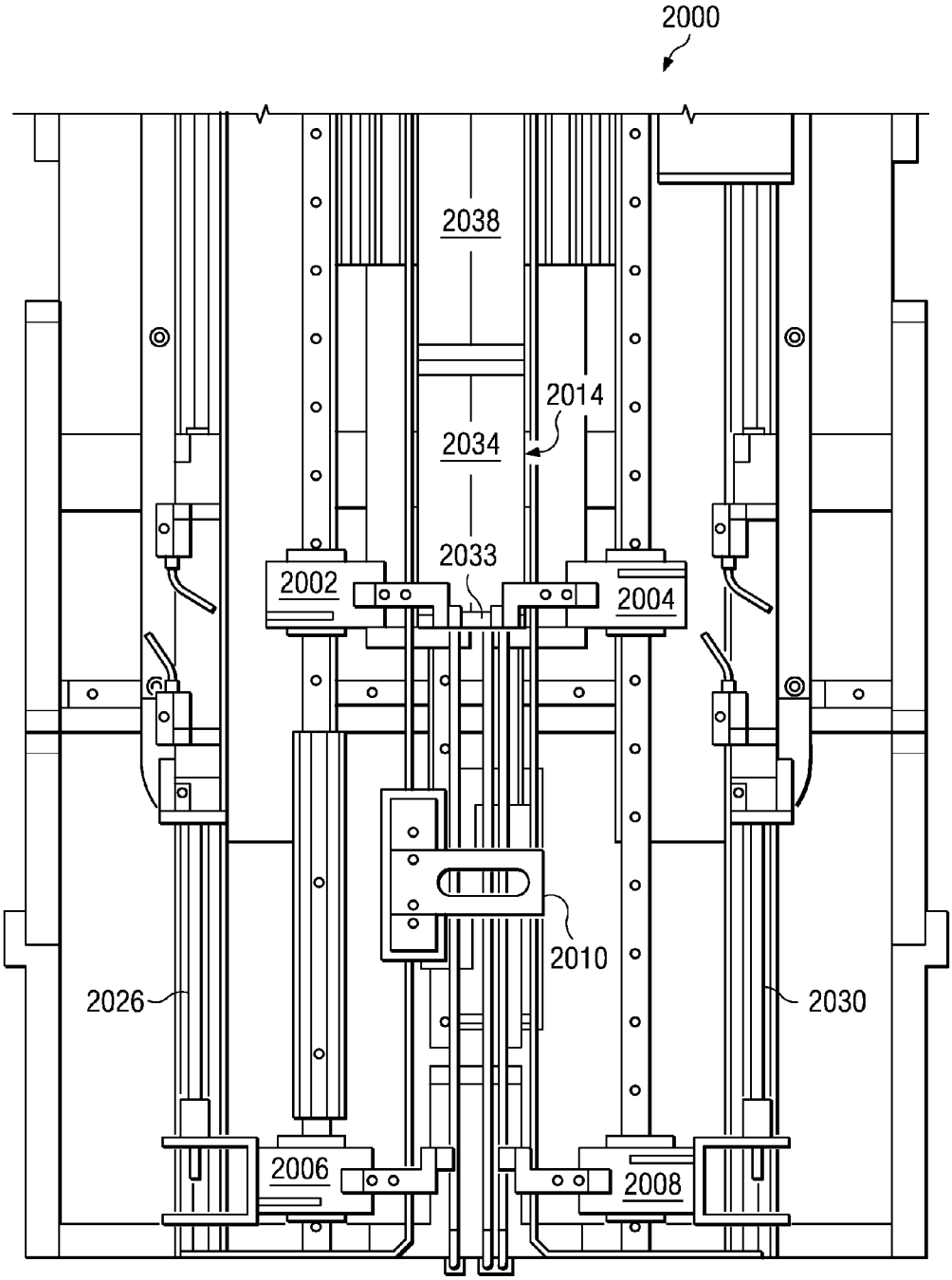
FIG. 23A-23H are elevational views of the embodiment of the premium separator introduced in FIGS. 20A-20K, but illustrating successive steps of a "double pull" mode.
Figure 23B:
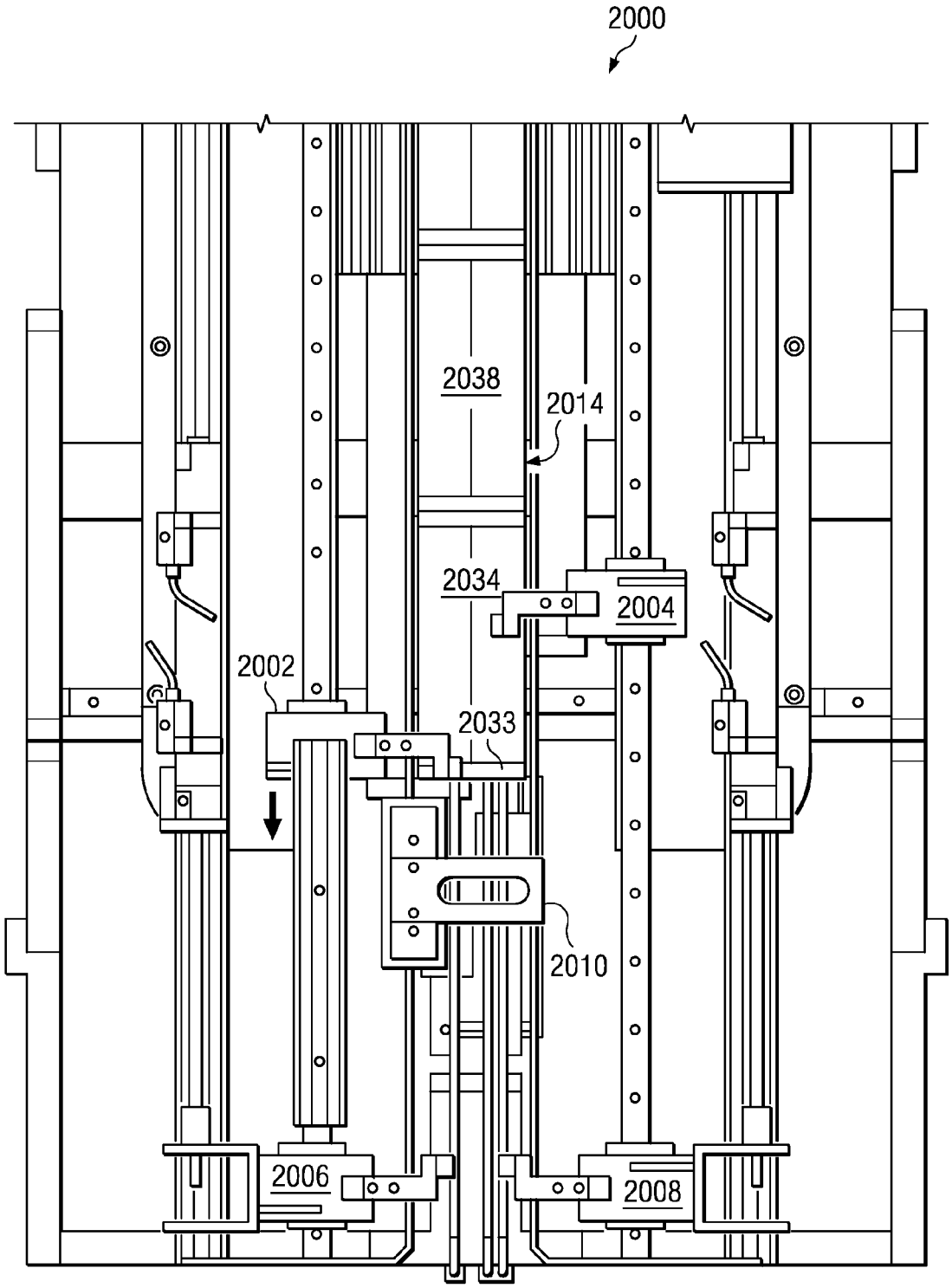
Figure 23C:
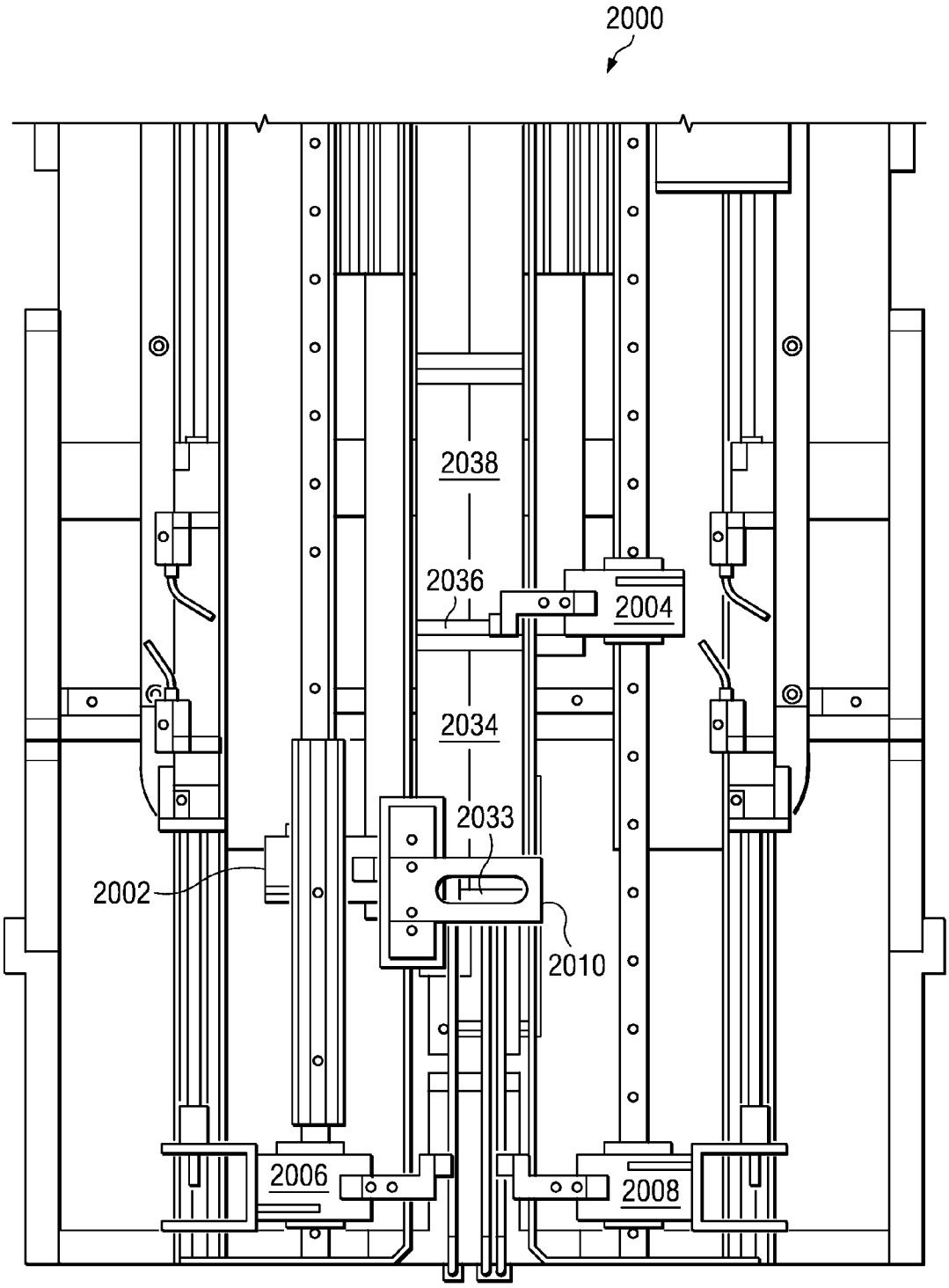
Figure 23D:
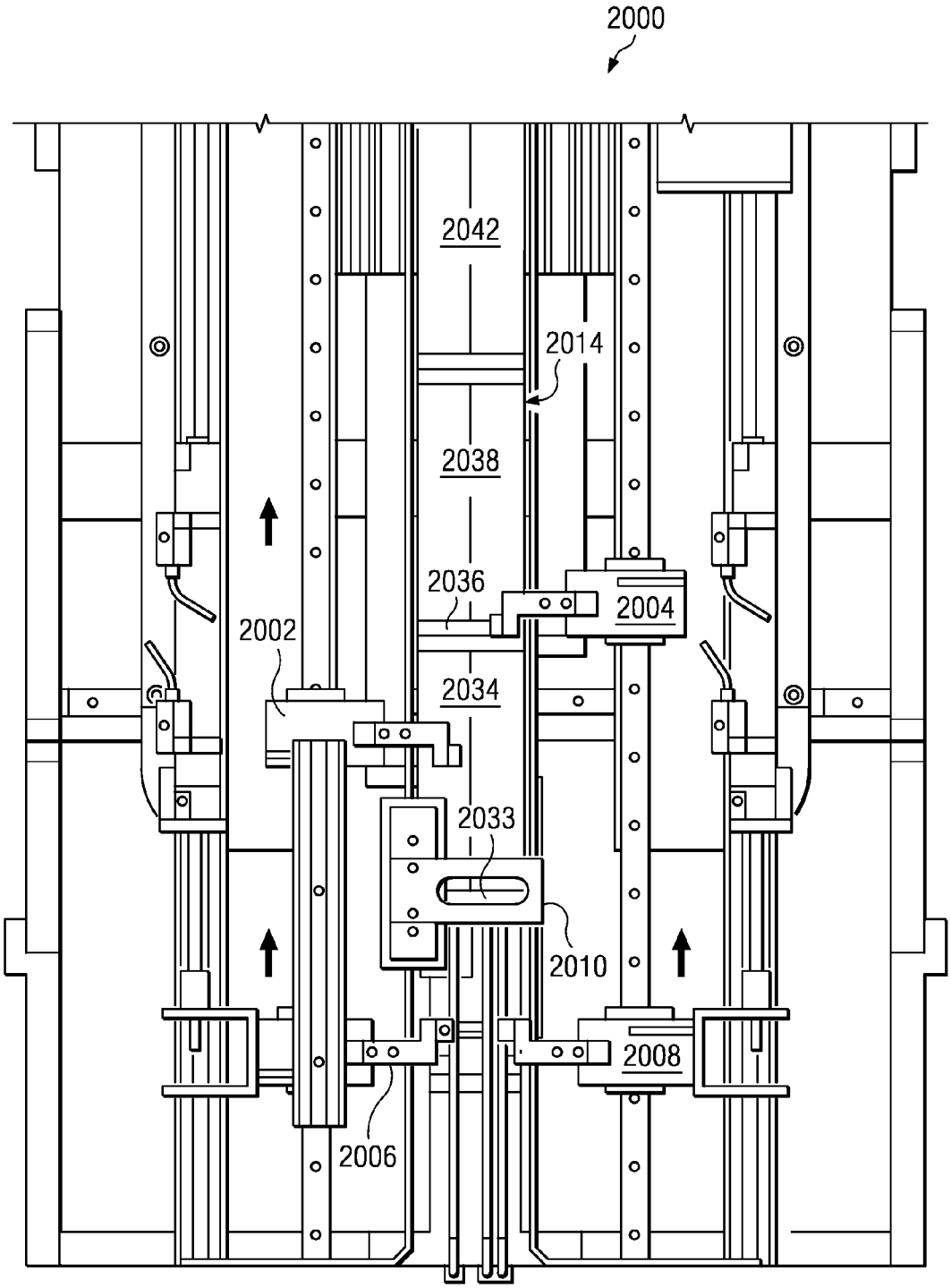
Figure 23E:
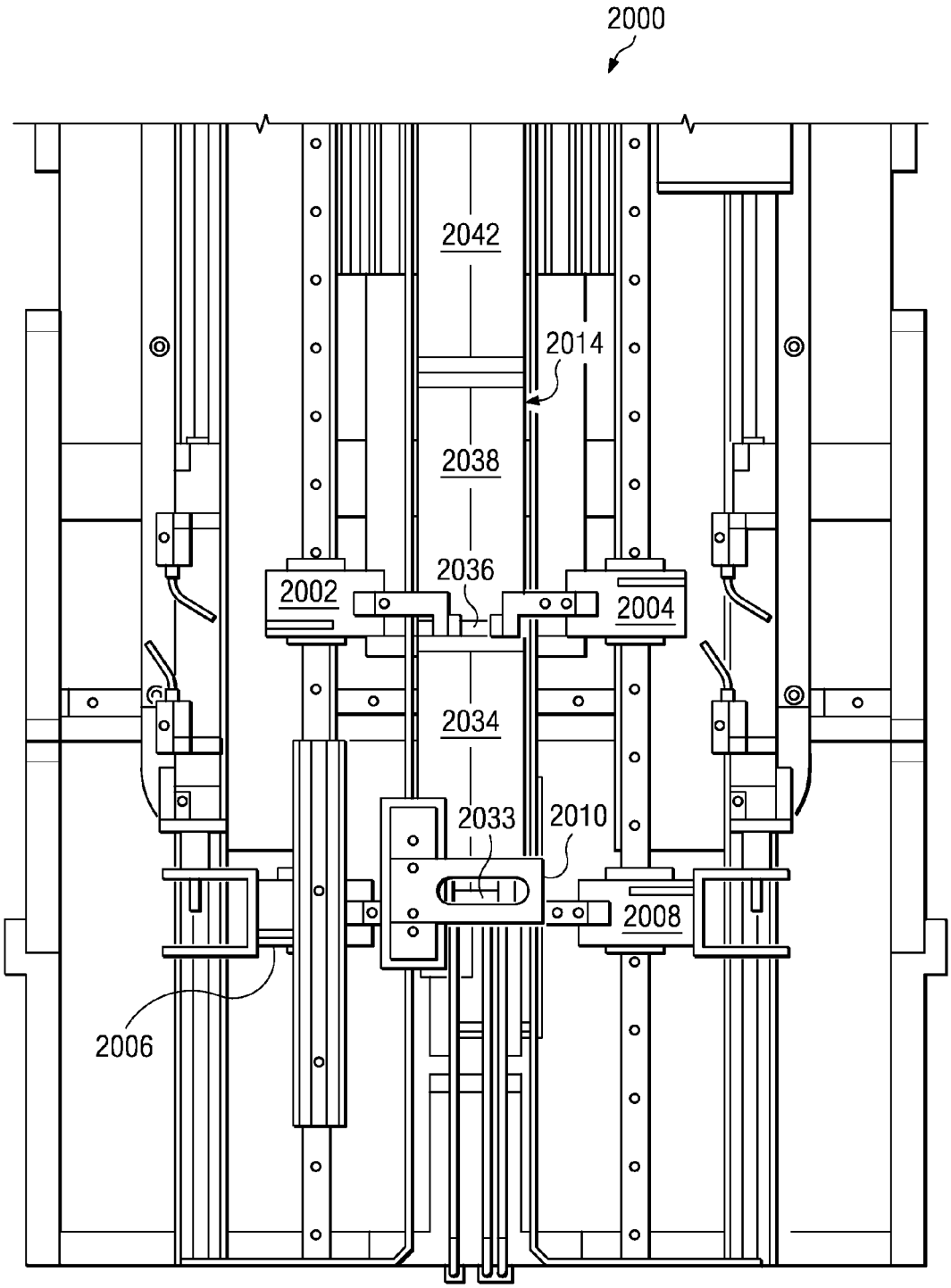
Figure 23F:
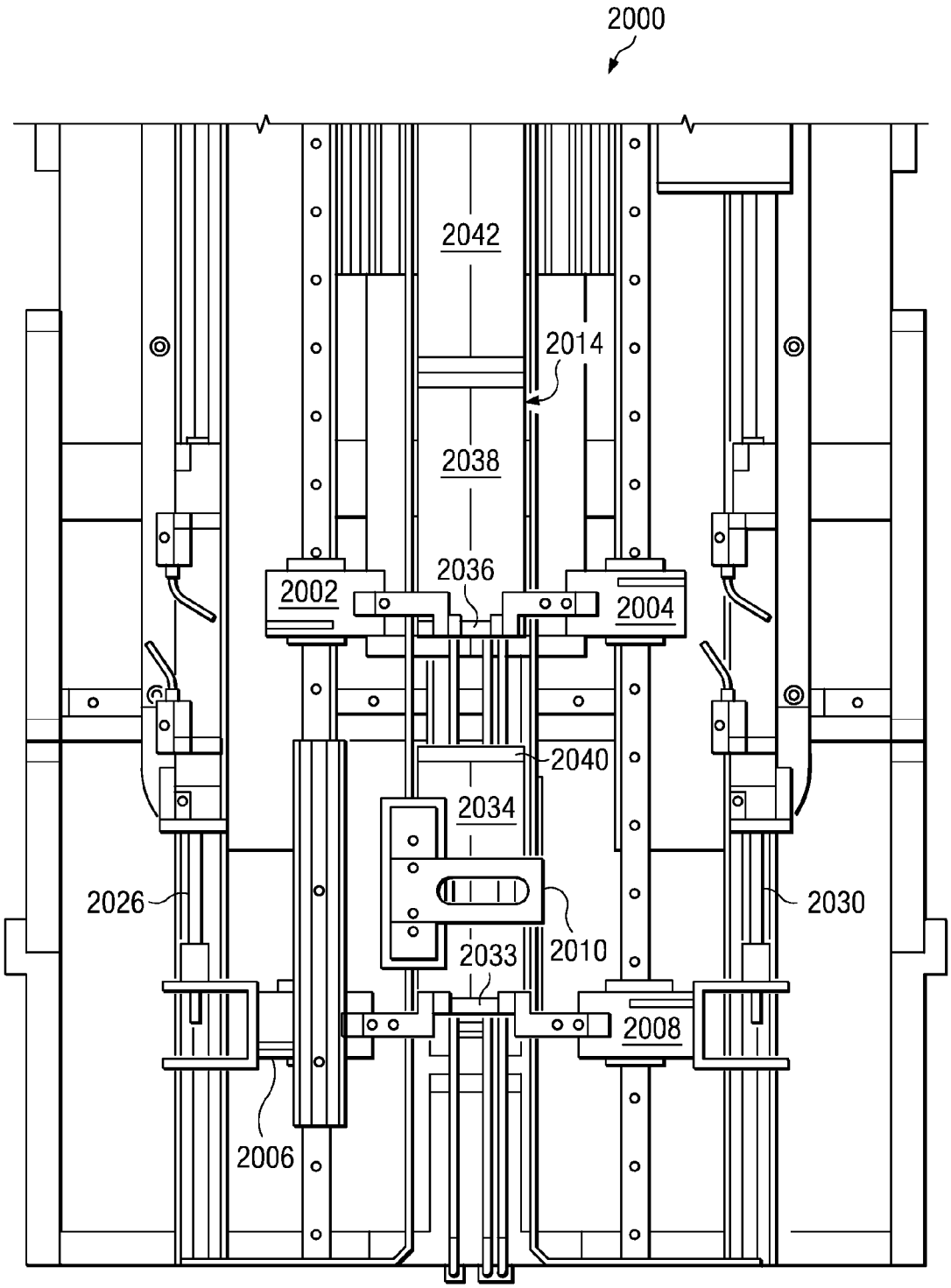
Figure 23G:
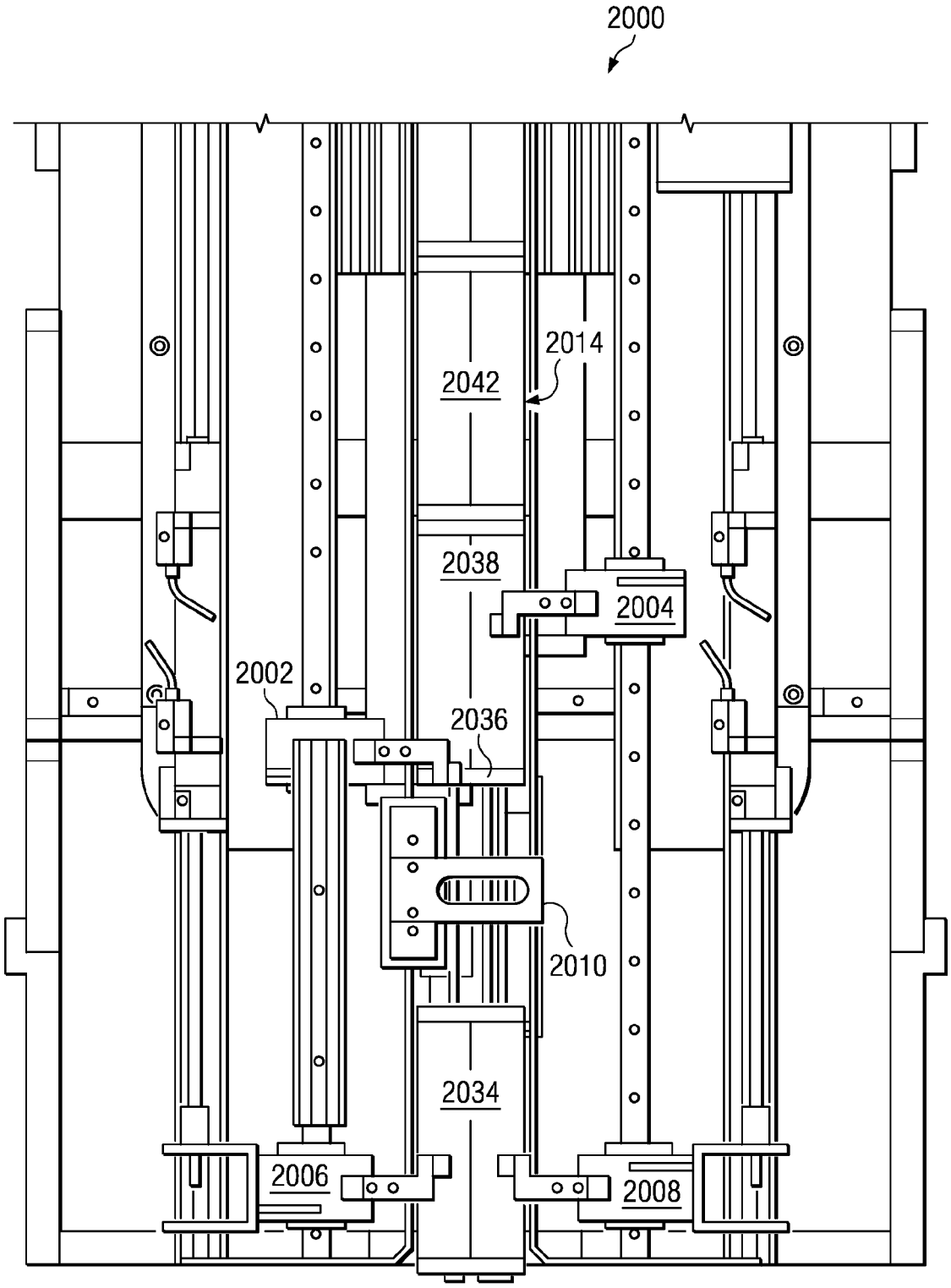
Figure 23H:
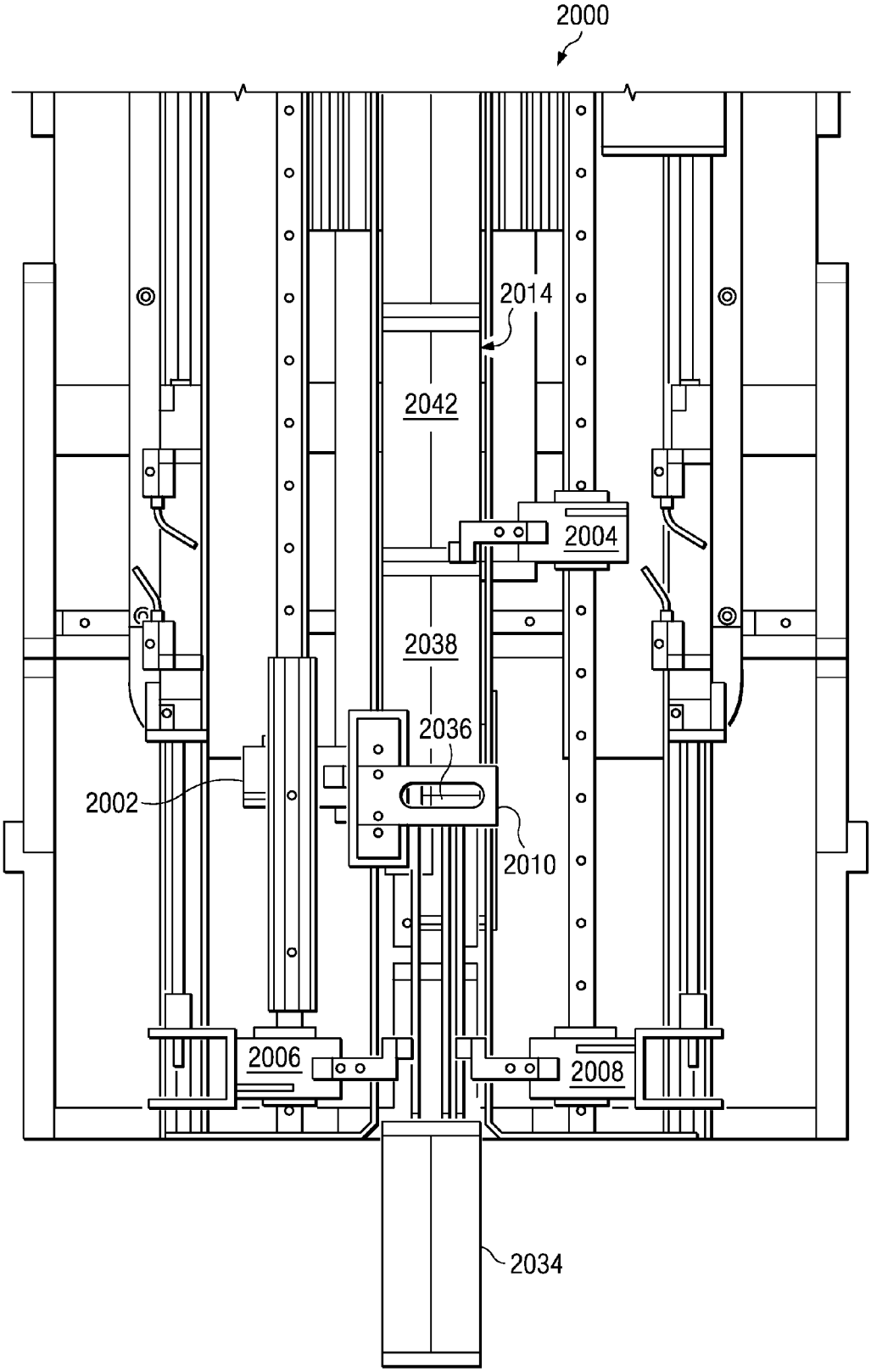
Figure 24:
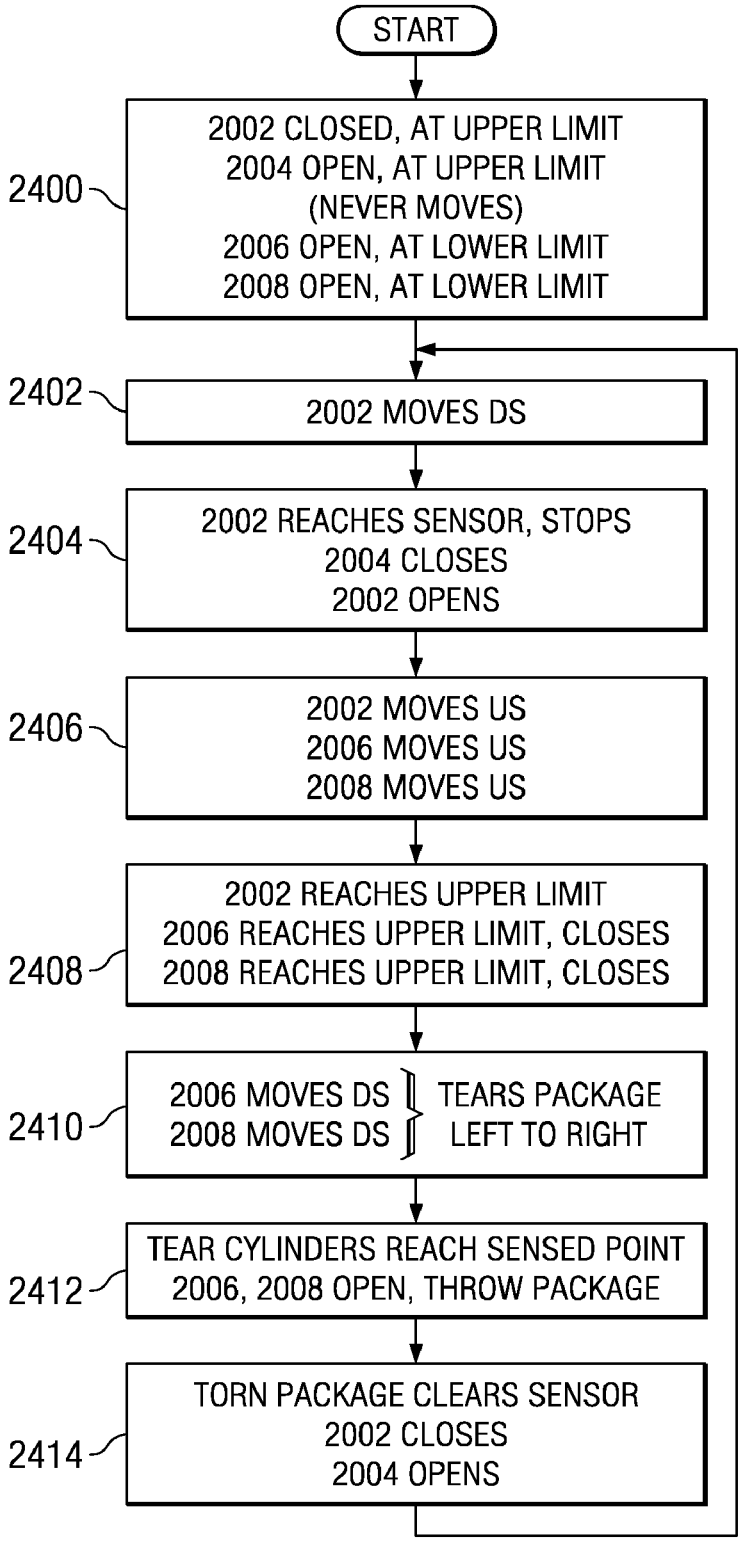
FIG. 24 is a process flow diagram illustrating operation of the embodiment shown in FIGS. 23A-23H according to a "double pull" mode.

The elevational views shown in FIGS. 23A-23H and the process flow diagram shown in FIG. 24 show another way in which this separator 2000 can be operated. Separator 2000 is physically identical to the embodiment shown in FIGS. 20A-20K. At a starting step 2400 in FIG. 24 and as shown in FIG. 23A, The upstream grippers 2002 and 2004 are at the upper limits of their movement and downstream grippers 2006 and 2008 are at the lower limits of the strokes of carrying cylinders 2026 and 2030. Left upstream or transfer gripper 2002 starts in a closed position, gripping leading seal zone 2033 of a first bandolier package 2034. Right upstream gripper 2004 starts in an open condition. In this mode of operation, gripper 2004 never moves. In an alternative embodiment, the roles of grippers 2002 and 2004 can be reversed. In yet a further embodiment (not shown), the motor and cylinder associated with gripper 2004 are omitted.

At step 2402, illustrated in FIG. 23B, the left upstream gripper 2002 starts moving downstream, pulling bandolier 2014 with it.

At step 2404, illustrated in FIG. 23C, the gripper 2002 reaches sensor 2010, at which point the sensor 2010 senses the leading edge of the package 2034. The controller 2200 uses the signal encoding this to command gripper 2004 to close and gripper 2002 to open.

Next, at step 2406, illustrated in FIG. 23D, grippers 2002, 2006 and 2008 all reverse and start moving upstream. While this is happening the bandolier 2014 is held in place by stationary gripper 2004.

At the time shown in FIG. 23E (step 2408), the left upstream or transfer gripper 2002 has returned to its upper limit, at the same level as stationary gripper 2004. Grippers 2006 and 2008 have reached the level of sensor 2010 and after they do this, they are commanded to close on the leading seal zone 2033 of the first premium package 2034.

At step 2410, best seen in FIG. 23F, grippers 2006 and 2008 simultaneously move downstream. Since gripper 2004 is holding the right side of leading seal zone 2036 and since gripper 2002 is open, when downstream grippers 2006 and 2008 put tension on the wakened separation line separating leading seal zone 2036 from trailing seal zone 2040, the right side of the separation line will start parting, but the left side of the separation line will start sagging in a downstream direction as the tension distorts the flexible material making up the premium packages 2034 and 2038. Thus, instead of a bursting separation, there will still be a tearing separation starting on the right and finishing on the left.

At step 2412, the tear gripper cylinders 2026, 2030 will have been extended to a predetermined point sensed by associated sensors, and the controller 2200 is supplied by signals indicating this. In response the controller will command grippers 2006 and 2008 to open, even while the grippers 2006 and 2008 continue to move downstream. This "throws" the package 2034 in a downstream trajectory with an initial velocity that matches the velocity of the grippers 2006, 2008 at the time of release.

At step 2414, the thrown package 2034 clears the sensor 2010. This datum is used to trigger the closing of gripper 2002 and the opening of gripper 2004. In FIG. 23G, the transfer gripper 2002 is pulling down the next package 2038, corresponding to step 2402. FIG. 23H shows a time at which the leading seal zone 2036 of package 2038 has been brought down to the level of sensor 2010, approximating step 2404. The process continues in this fashion for as long as desired.

The separation method described immediately above is useful for setups having relatively tight inserting windows and relatively slow line speeds.

Any of the separators according to the invention may additionally employ a further pair of grippers (not shown), upstream from the ones shown, and spaced from the illustrated upstream grippers shown by one package length. This would reduce the number of physically unguided premiums between the infeed machine (not shown) and the location of separation. This would also reduce the weight pulling on the downstream-most wakened separation line by one premium, but would not require an additional cylinder displacement motors.

In summary, different embodiments of a premium package separator have been shown and described. In many embodiments the separator can be operated in such a way that the leading package is gradually torn across a wakened separation line, instead of being suddenly burst from the bandolier. This more gentle separation action makes the separator an optimal choice for fragile premiums with limited shock-withstanding capability. Some embodiments are capable of throwing the separated packaged premium on a predetermined trajectory instead of dropping it.

While illustrated embodiments of the present invention have been described and illustrated in the appended drawings, the present invention is not limited thereto but only by the scope and spirit of the appended claims.

We claim:

1. Apparatus for separating a packaged premium from a bandolier of packaged premiums, the apparatus comprising:

a plurality of independently actuable grippers disposed to be alongside a path of the bandolier, the path having a first side, a second side opposite the first side, and a longitudinal axis between the first and second sides, each gripper actuable to assume an engaged position and a disengaged position, the plurality of grippers including an upstream first side gripper disposed on the first side of the path and having a first downstream speed;

a downstream first side gripper disposed on the first side of the path and spaced from the upstream first side gripper in a downstream direction along the path, the downstream first side gripper having a second downstream speed;

an upstream second side gripper disposed on the second side of the path and having a third downstream speed;

a downstream second side gripper disposed on the second side of the path and spaced from the upstream second side gripper in a downstream direction along the path, the downstream second side gripper having a fourth downstream speed;

an upstream first side gripper motive device coupled to the upstream first side gripper and independently actuable to move the upstream first side gripper downward alongside the path at the first downstream speed;

a downstream first side gripper motive device coupled to the downstream first side gripper and independently actuable to move the downstream first side gripper downward along-side the path at the second downstream speed;

an upstream second side gripper motive device coupled to the upstream second side gripper and independently actuable to move the upstream second side gripper downward along-side the path at the third downstream speed; and a downstream second side gripper motive device coupled to the downstream second side gripper and independently actuable to move the downstream second side gripper downward along-side the path at the fourth downstream speed;

wherein, during a predetermined period of time, a difference between the second downstream speed and the first downstream speed is greater than a difference between the fourth downstream speed and the third downstream speed;

wherein the path includes a portion which is disposed in a plane, each of said grippers having at least one articulable finger, the finger disposed in the disengaged position to have a free end spaced perpendicularly from said plane, each of said grippers further having an opposed surface located, in the disengaged position, to be spaced from said plane and on the other side of said plane from the end of the finger, the finger articulating to clamp a selected seal zone of a selected packaged premium between the finger end and the opposed surface when the gripper is actuated to assume the engaged position.

2. The apparatus of claim 1, wherein the opposed surface of the gripper is an end of a second articulating finger.

3. The apparatus of claim 1, wherein each gripper further comprises a piston reciprocally movable between an upward position and a downward position within a gripper body and connected to a solenoid, the piston having an upper flange and a lower flange which cage an arm of at least one finger, the at least one finger being rotatable around a pivot.

4. The apparatus of claim 3, wherein each gripper further comprises a coil spring affixed to the piston such that the piston is biased in the upward position when the solenoid is active.

5. Apparatus for separating a packaged premium from a bandolier of packaged premiums, the apparatus comprising:

a plurality of independently actuable grippers disposed to be alongside a path of the bandolier, the path having a first side, a second side opposite the first side, and a longitudinal axis between the first and second sides, each gripper actuable to assume an engaged position and a disengaged position, the plurality of grippers including an upstream first side gripper disposed on the first side of the path and having a first downstream speed;

a downstream first side gripper disposed on the first side of the path and spaced from the upstream first side gripper in a downstream direction along the path, the downstream first side gripper having a second downstream speed;

an upstream second side gripper disposed on the second side of the path and having a third downstream speed;

a downstream second side gripper disposed on the second side of the path and spaced from the upstream second side gripper in a downstream direction along the path, the downstream second side gripper having a fourth downstream speed;

an upstream first side gripper motive device coupled to the upstream first side gripper and independently actuable to move the upstream first side gripper downward along-side the path at the first downstream speed;

a downstream first side gripper motive device coupled to the downstream first side gripper and independently actuable to move the downstream first side gripper downward along-side the path at the second downstream speed;

an upstream second side gripper motive device coupled to the upstream second side gripper and independently actuable to move the upstream second side gripper downward along-side the path at the third downstream speed; and a downstream second side gripper motive device coupled to the downstream second side gripper and independently actuable to move the downstream second side gripper downward along-side the path at the fourth downstream speed;

wherein, during a predetermined period of time, a difference between the second downstream speed and the first downstream speed is greater than a difference between the fourth downstream speed and the third downstream speed;

at least one stationary first side gripper disposed to be upstream of the upstream first side gripper and in communication with the processor, the at least one stationary first side gripper actuable by the processor to assume an engaged position in which the stationary gripper clamps to a selected seal zone of the bandolier, and to assume a disengaged position in which the stationary gripper does not clamp to any seal zone.

6. The apparatus of claim 5, further comprising at least one stationary second side gripper disposed in an upstream direction from the upstream second side gripper and across the axis from the stationary first side gripper.

* * * * *